US006631705B1

(12) United States Patent
Rivera

(10) Patent No.: US 6,631,705 B1
(45) Date of Patent: Oct. 14, 2003

(54) MODULAR FUEL CONTROL APPARATUS

(75) Inventor: Donald J. Rivera, Spartanburg, SC (US)

(73) Assignee: Lycoming Engines, Williamsport, PA (US)

( * ) Notice: Subject to any disclaimer, the term of this patent is extended or adjusted under 35 U.S.C. 154(b) by 12 days.

(21) Appl. No.: 09/793,388

(22) Filed: Feb. 27, 2001

Related U.S. Application Data

(60) Provisional application No. 60/217,316, filed on Jul. 10, 2000.

(51) Int. Cl.[7] ..... F02M 69/22
(52) U.S. Cl. ..... 123/454; 123/452
(58) Field of Search ..... 123/452, 454, 123/457, 460, 463

(56) References Cited

U.S. PATENT DOCUMENTS

| | | | | |
|---|---|---|---|---|
| 2,082,325 | A | 6/1937 | Cross | |
| 2,264,656 | A | 12/1941 | Briscoe et al. | |
| 2,281,417 | A | 4/1942 | Darby | |
| 2,301,031 | A | 11/1942 | Ferguson | |
| 2,341,257 | A | 2/1944 | Wunsch | |
| 2,630,791 | A | 3/1953 | Kiekhaefer | |
| 2,643,510 | A | 6/1953 | Kiekhaefer | |
| 2,770,255 | A | 11/1956 | Goddard | |
| 2,882,880 | A | 4/1959 | Reggio | |
| 2,913,231 | A | 11/1959 | Powell | |
| 2,995,125 | A | 8/1961 | Powell | |
| 3,020,707 | A | 2/1962 | Post | |
| 3,114,359 | A | 12/1963 | Haase | 123/450 |
| 3,269,374 | A | 8/1966 | Conover | |
| 3,565,109 | A | 2/1971 | Smith | |
| 3,698,369 | A | 10/1972 | Vuaille | |
| 3,707,144 | A | 12/1972 | Galis | |
| 3,851,631 | A | 12/1974 | Kiekhaefer | |
| 3,886,922 | A | 6/1975 | Frick | |
| 3,926,162 | A | * 12/1975 | Haase et al. | 123/510 |
| 4,079,706 | A | 3/1978 | Konig | |
| 4,227,492 | A | 10/1980 | Haase | |
| 4,228,777 | A | 10/1980 | Haase | 123/454 |
| 4,401,063 | A | 8/1983 | Haase | 123/73 B |

FOREIGN PATENT DOCUMENTS

| | | |
|---|---|---|
| GB | 1353288 | 5/1974 |
| GB | 1447773 | 9/1976 |
| GB | 1538852 | 1/1979 |
| GB | 2072744 | 10/1981 |

OTHER PUBLICATIONS

Precision Airmotive Corporation Training Manual, "RSA Fuel Injection System", dated Jan. 1990.

Bendix, Energy Controls Division, RSA–5 and RSA 10 Fuel Injection Systems Operation and Serve Manual, dated Mar., 1976.

(List continued on next page.)

*Primary Examiner*—Tony M. Argenbright
(74) *Attorney, Agent, or Firm*—Greenberg Traurig, LLP; Paul F. McQuade

(57) ABSTRACT

The present invention provides a fuel control apparatus with a modular fuel pressure modifying mechanism (i.e., a fuel metering section) and modular fuel regulator mechanism (i.e., a fuel regulator section) that can each be calibrated independently of each other, and independent from the modular air passage mechanism (i.e., an airflow section). The modular fuel pressure modifying mechanism is constructed and arranged to be calibrated prior to being mounted to the air passage mechanism. The fuel regulator mechanism is constructed and arranged to communicate with the airflow in the air passage mechanism and the modular fuel pressure modifying mechanism to regulate an amount of fuel delivered to the engine. The modular fuel pressure modifying mechanism and the modular fuel regulator mechanism are removably mountable to the modular air passage mechanism independently from each other.

90 Claims, 39 Drawing Sheets

OTHER PUBLICATIONS

Precision Airmotive Corporation, RSA–7AA1 Fuel Injection System Operation and Service Manual, dated Mar., 1990.

Airflow Performance High Performance Fuel Meterining Systems, Installation and Service Manual, dated 1998.

Kirwin, J.M. and Hasse, E.A., Fuel System Requirements for Light Aircraft Turbocharged Reciprocating Engines, Apr. 2–5, 1974, pp. 1–11.

The Bendix Corporation, RSA–7AA1 Fuel Injection System Operation and Service Manual, Nov. 1, 1970 (changed Aug. 1, 1978).

Allied Bendix Aerospace, RSA–5 and RSA–10 Fuel Injection Systems Operation and Service Manual, Nov. 1, 1968 (changed Jan. 15, 1985).

The Bendix Corporation, RS–5 and RS–10 Fuel Injection Systems Operation and Service Manual, Sep. 1, 1969 (supersedes Mar. 1, 1965).

The Bendix Corporation, RSA–10DB2 Fuel Injection System Operation and Service Manual, Feb. 15, 1973 (changed Mar. 15, 1976).

Allied Bendix Aerospace, RSA–10DB1 and RSA–10ED1 Fuel Injection Systems Operation and Service Manual, Feb. 1, 1973.

The Bendix Corporation, RSA–7DA1 Fuel Injection System Operation and Service Manual, Oct. 15, 1976.

* cited by examiner

MODULAR FUEL CONTROL APPARATUS

The present application claims priority to U.S. Provisional Application of Rivera, filed Jul. 10, 2000, Ser. No. 60/217,310, the entirety of which is hereby incorporated into the present application by reference.

COPYRIGHT NOTICE

This patent document contains information subject to copyright protection. The copyright owner has no objection to the facsimile reproduction by anyone of the patent document or the patent, as it appears in the U.S. Patent and Trademark Office files or records but otherwise reserves all copyright rights whatsoever.

FIELD OF THE INVENTION

This invention relates to a fuel injection system, and more particularly to a fuel control apparatus for an internal combustion engine.

BACKGROUND OF THE INVENTION

A fuel injection system for an internal combustion, aircraft engine generally includes, among other components, a fuel injection servo, a flow divider, and fuel nozzles. Conventional fuel injection servos are shown in FIGS. 1–4. FIGS. 1 and 2 show the RSA-5AD1 and the RSA-5AB1 fuel injection servos, respectively, sold by Precision Airmotive Corporation. FIG. 3 shows the RSA-7AA1 fuel injection servo, which is also sold by Precision Airmotive Corporation.

The major components of a conventional fuel injection servo include the airflow section, the flow metering section, and the fuel regulator section. The RSA-5AB1 servo also includes an automatic mixture control section. Each of these sections cooperates in a known manner to regulate the amount of fuel that is delivered to the engine, which is proportional to the amount of air that flows through the throttle body assembly, i.e., the power produced by the engine. A portion of the internal components of a conventional fuel regulator assembly is shown in FIG. 4, which shows a stack of components that cooperate to separate air and fuel chambers about an air and fuel diaphragm, respectively. The air and fuel diaphragms are also interconnected by the associated components, and each imparts a force on the regulator stem that is connected to the ball, which regulates the position of the ball valve to thereby regulate the metering head across the jetting system (not shown) and thus the amount of fuel delivered to the engine.

A description of the fuel injection systems utilizing the RSA-5AD1 and RSA-5AB1 servos are provided in RSA-5 and RSA-10 Fuel Injection Systems, Operation and Service Manual, by The Bendix Corporation and Training Manual, RSA Fuel Injection System" by Precision Airmotive Corporation, the entirety of each being incorporated into the present application by reference. A description of the fuel injection systems utilizing the RSA-7AA1 servo is provided in RSA-7AA1 Fuel Injection System, Operation and Service Manual, by Precision Airmotive Corporation and Airflow Performance High Performance Fuel Metering Systems, Installation and Service Manual, by Airflow Performance, Inc., the entirety of each being incorporated into the present application by reference.

To insure that a fuel injection system operates properly after assembly, the fuel injection servo must be calibrated. In a conventional fuel control system, the fuel servo must be calibrated as a single unit. That is, for example, in the RSA-5AD1 servo of the prior art, the fuel metering and regulator sections must be attached to the airflow section, and the entire servo must then be calibrated as a single unit. Calibration of the unit entails, for example, the application of a pressure signal to the fuel regulator and properly shimming the servo seat, the center body seal, and adjustment of the regulator stem, fastening bolts, and other components. Likewise, the components of the fuel metering section need to be calibrated, which involves pressure testing. Because the calibration of the conventional fuel injection servo must be performed as a single unit, the unit becomes a single, fixed system that cannot be easily modified.

This cumbersome calibration method is somewhat alleviated in the RSA-7AA1 servo. With this servo, the fuel metering and fuel regulator sections are calibrated together as a unit, separate from the air flow section. After calibration of the fuel metering and fuel regulator sections together, they can be installed onto the air flow section without the need to perform further calibration of the servo unit. However, in the RSA-7AA1 servo, once the fuel metering and fuel regulator sections are calibrated together as a unit, it becomes a fixed unit. Any change in either the fuel metering or regulator sections requires recalibration of the two sections as a unit, even if only one section is changed.

This conventional design approach to fuel injection servos does not lend itself to quick turn around time if changes to the fuel metering section or fuel regulator section are required, either for operational purposes or for maintenance. For example, with a conventional fuel injection servo, such as the RSA-5AD1 and RSA-5AB1, in order to make a modification in either the fuel metering section or the fuel regulator section, the entire fuel injection servo would have to be recalibrated as a single unit. Such an operation is extremely time consuming and expensive. Likewise, with the RSA-7AA1 servo, changes in either the fuel metering section or the fuel regulator section require recalibration of the fuel metering/fuel regulator unit. Additionally, in a fuel injection servo where the airflow section and fuel metering section are an integral casting, such as in the RSA-5AD1 and RSA-5AB1 servos, a modification in the fuel metering section requires replacement of the airflow section as well.

SUMMARY OF THE INVENTION

Therefore, there is a need to provide a fuel injection servo that does not require calibration as a single unit when modifications and/or replacement of the fuel metering section or fuel regulator section is required.

Accordingly, one implementation of the present invention provides a fuel control apparatus (i.e, a fuel injection servo) with a fuel metering section and fuel regulator section that can each be calibrated independently of each other, and independent from the airflow section. The fuel control apparatus of the present invention includes a modular air passage mechanism (i.e., a modular airflow section) and a modular fuel pressure modifying mechanism (i.e., a modular fuel metering section). The modular air passage mechanism has an air intake end and an air outlet end, and is constructed and arranged to accommodate airflow therethrough. The modular fuel pressure modifying mechanism is constructed and arranged to receive fuel from a fuel supply and deliver the fuel at a pressure that is different from the fuel supply to a modular fuel regulator mechanism (i.e., a modular fuel regulator section). The modular fuel regulator mechanism is constructed and arranged to communicate with the airflow in the air passage mechanism and the modular fuel pressure modifying mechanism to regulate an amount of fuel delivered to the engine. Each of the modular fuel pressure modifying mechanism and the modular fuel regulator mechanism are removably mountable to the modular air passage mechanism independently from each other.

BRIEF DESCRIPTION OF THE DRAWINGS

The present invention is further described in the detailed description which follows, by reference to the noted drawings by way of non-limiting exemplary embodiments, in which like reference numerals represent similar parts throughout the several views of the drawings, and wherein.

DETAILED DESCRIPTION

Figure 1:
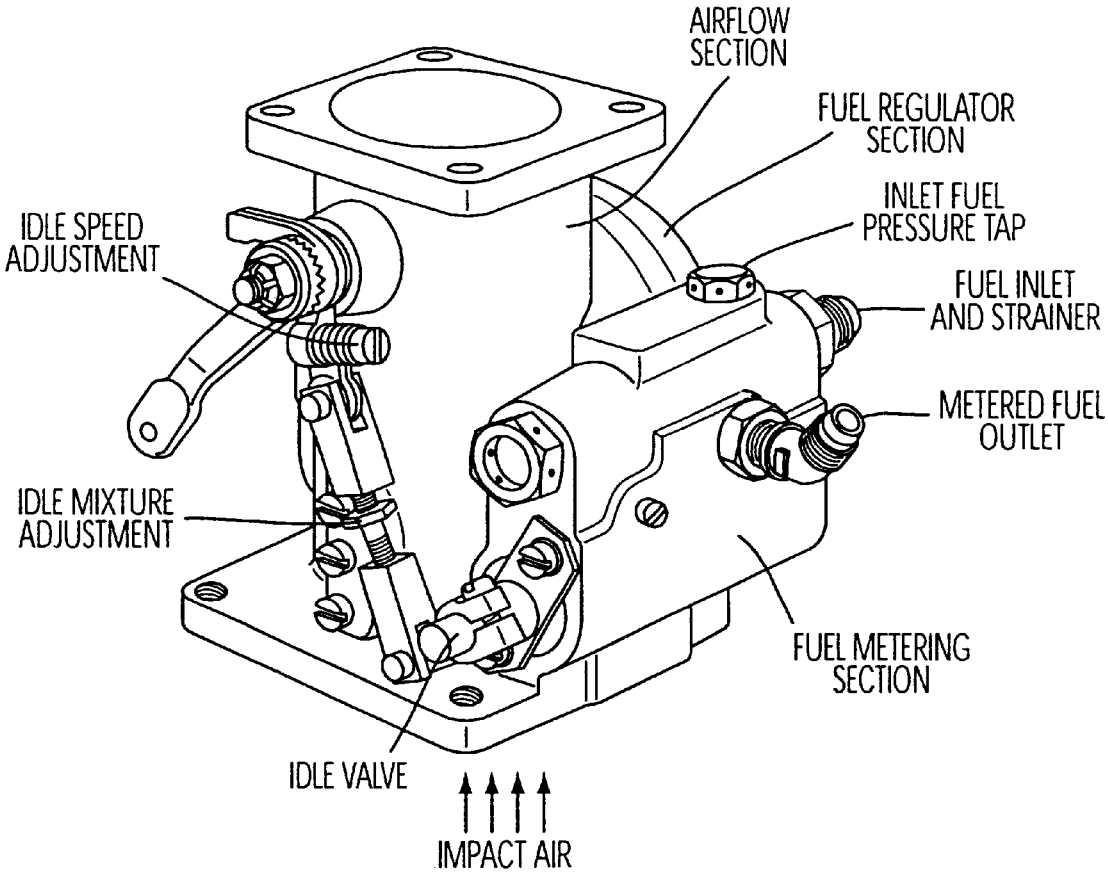
FIG. 1 (PRIOR ART)
FIG. 1 is a perspective view of the RSA-5AD1 fuel injection servo (prior art) sold by Precision Airmotive Corporation.
Figure 2:
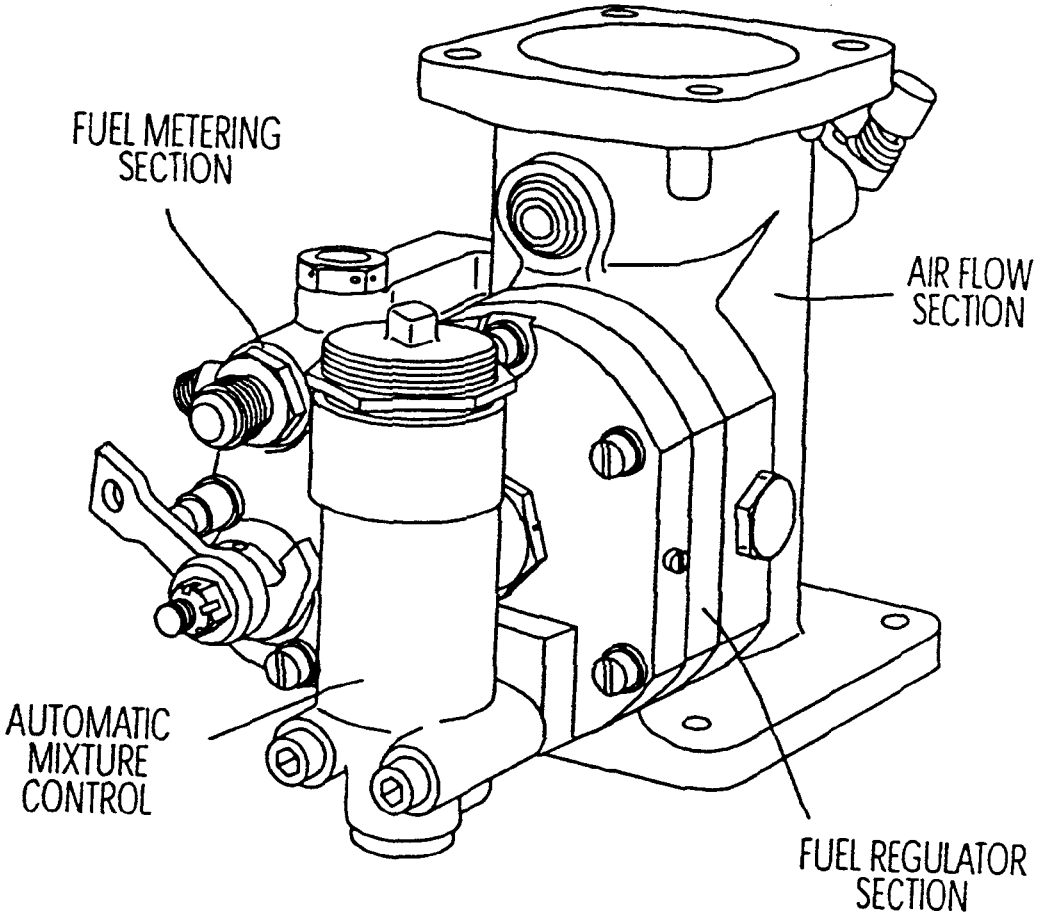
FIG. 2 (PRIOR ART)
FIG. 2 is a perspective view of the RSA-5AB1 fuel injection servo (prior art) sold by Precision Airmotive Corporation.
Figure 3:
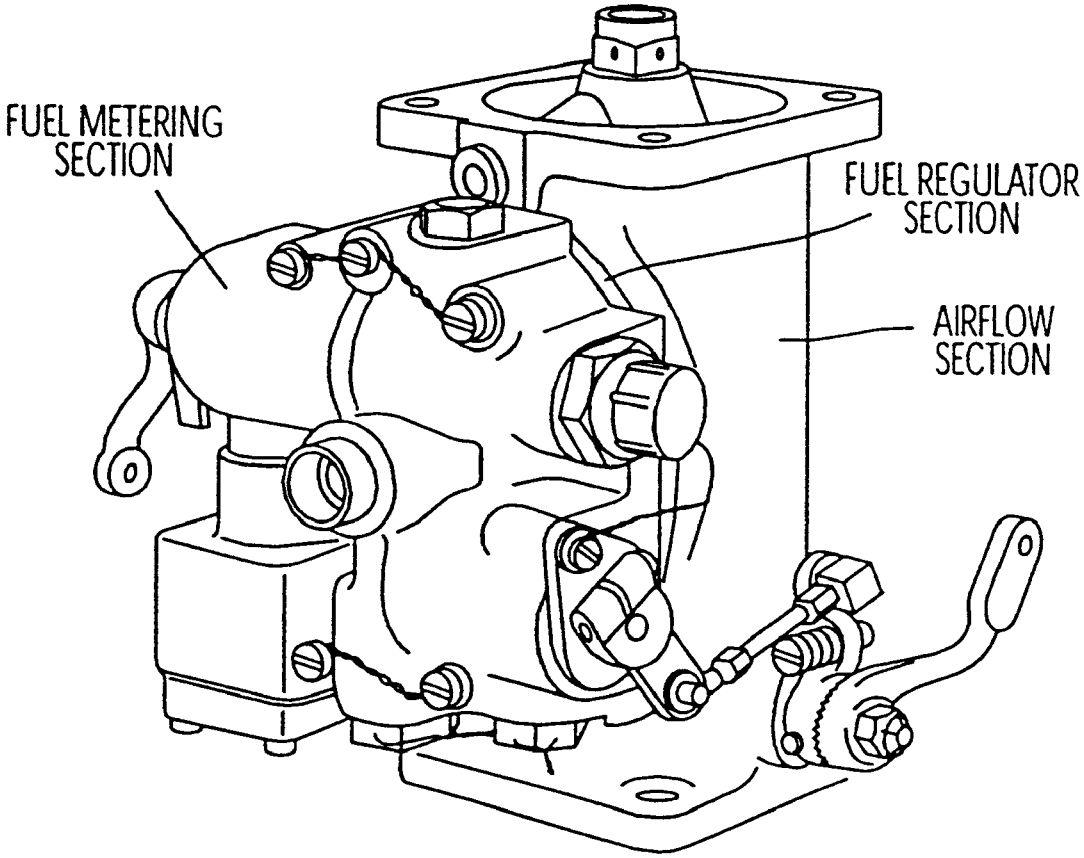
FIG. 3 (PRIOR ART)
FIG. 3 is a perspective view of the RSA-7AA1 fuel injection servo (prior art) sold by Precision Airmotive Corporation.
Figure 4:
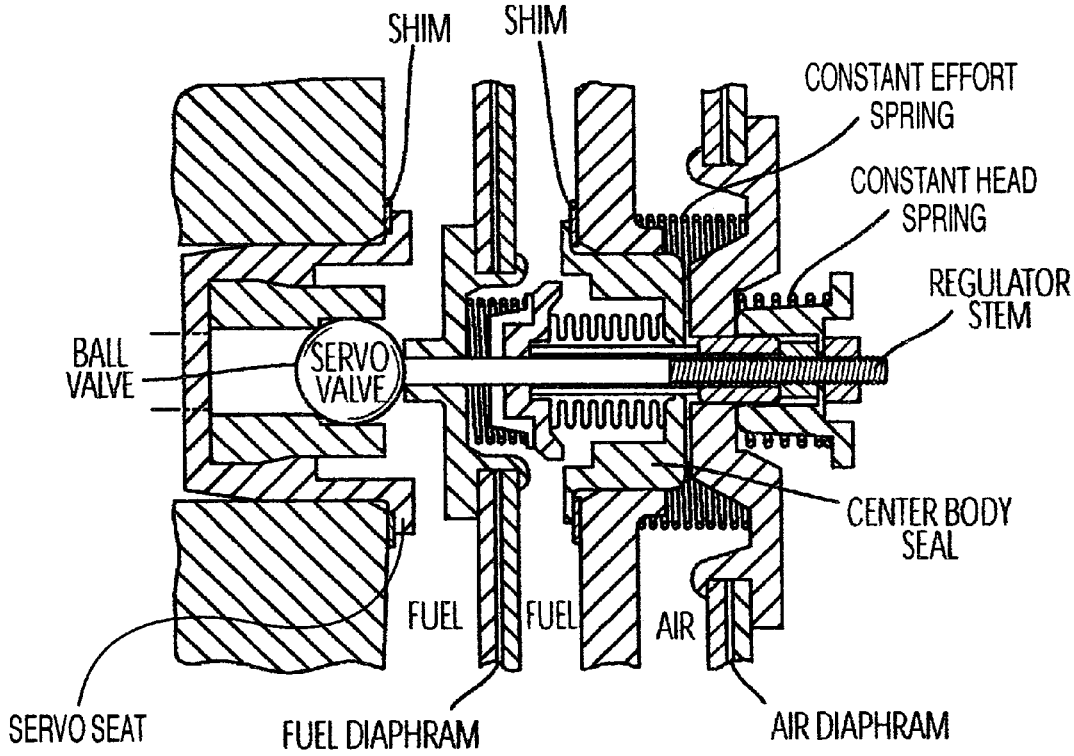
FIG. 4 (PRIOR ART)
FIG. 4 is a schematic of a cross section of the prior art fuel regulator section of FIG. 1.
Figure 5:
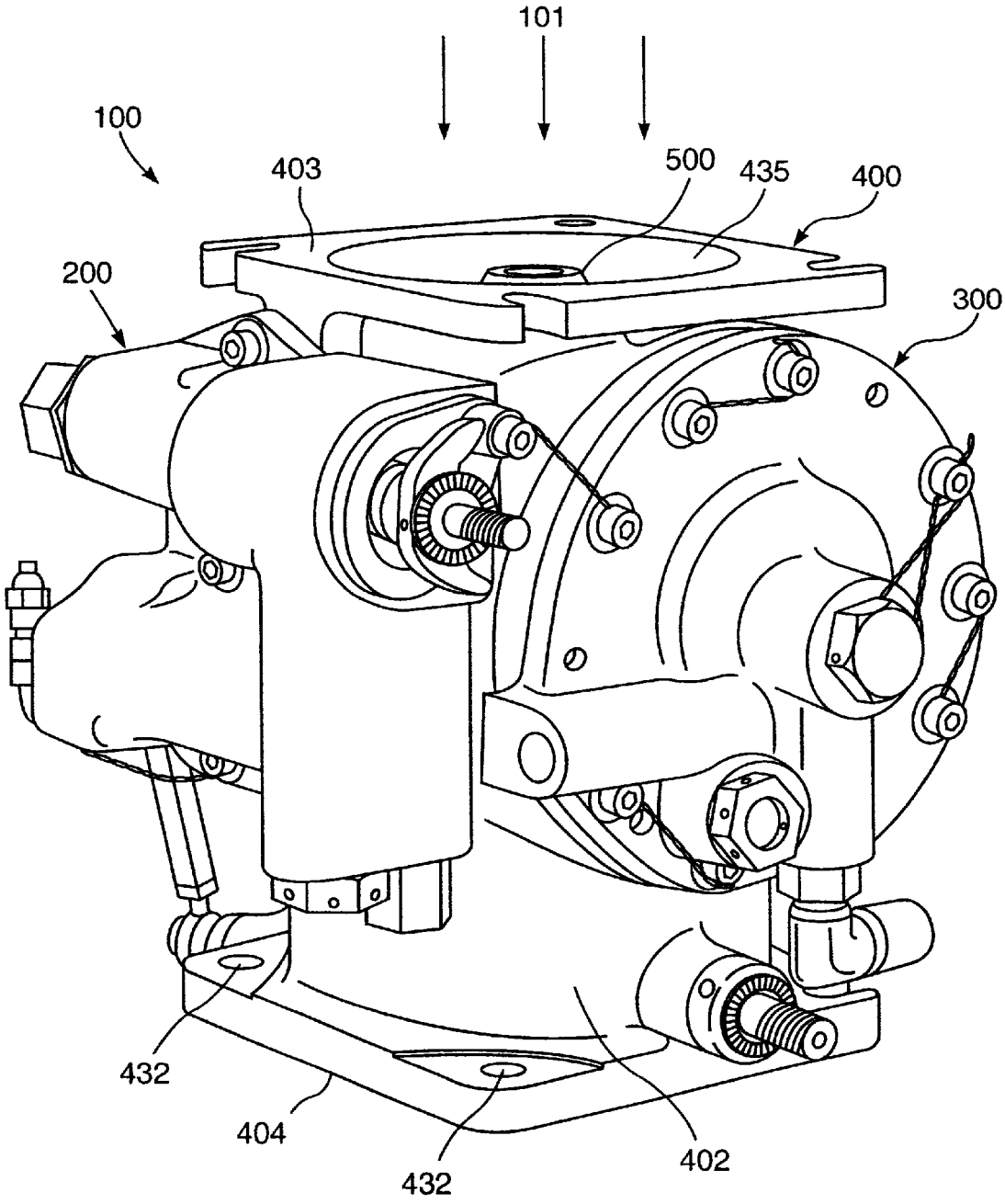
FIG. 5 is a perspective view of the fuel injection servo of an embodiment of the present invention.
Figure 6:
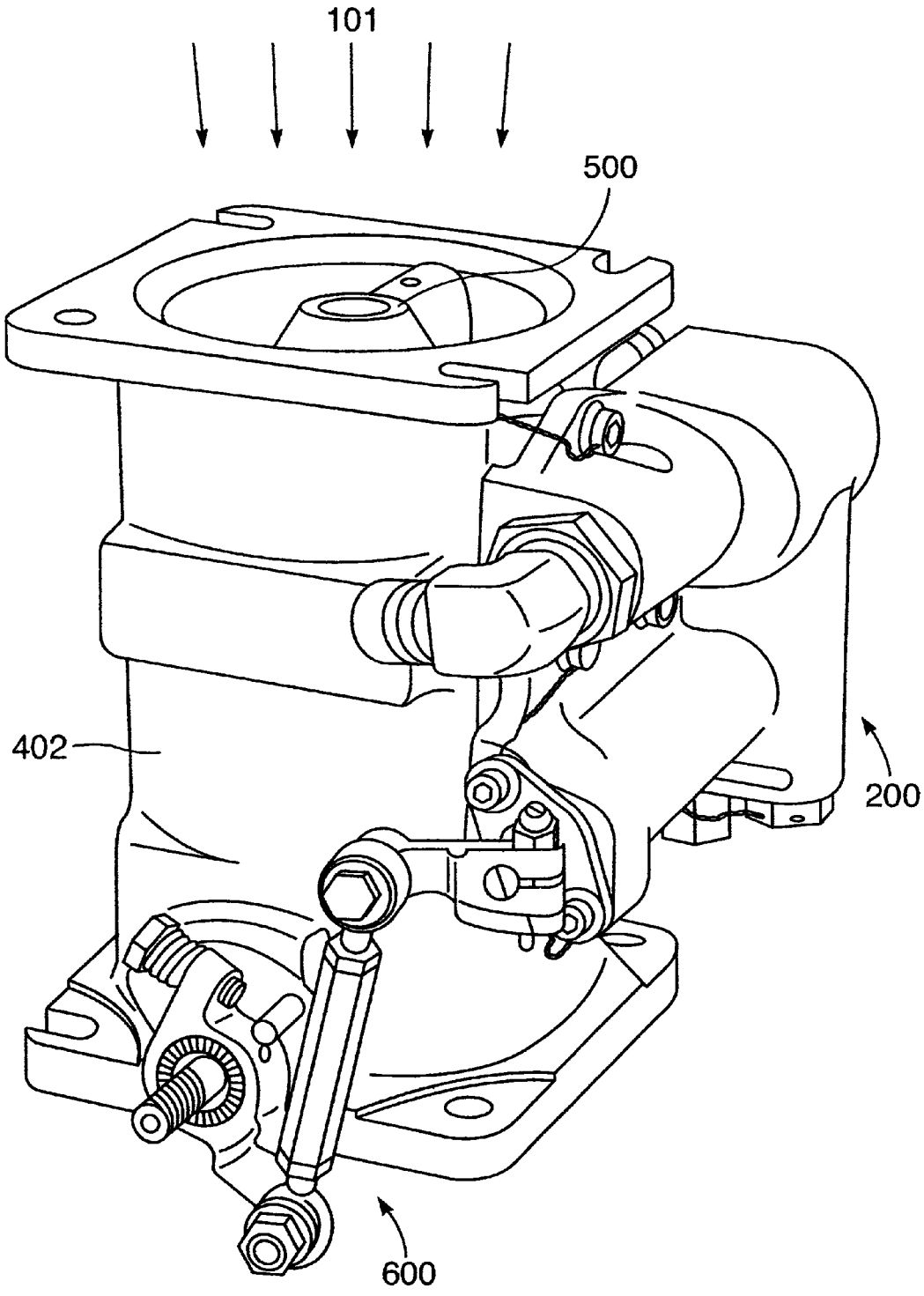
FIG. 6 is another perspective view of the fuel injection servo shown in FIG. 5.
Figure 7:
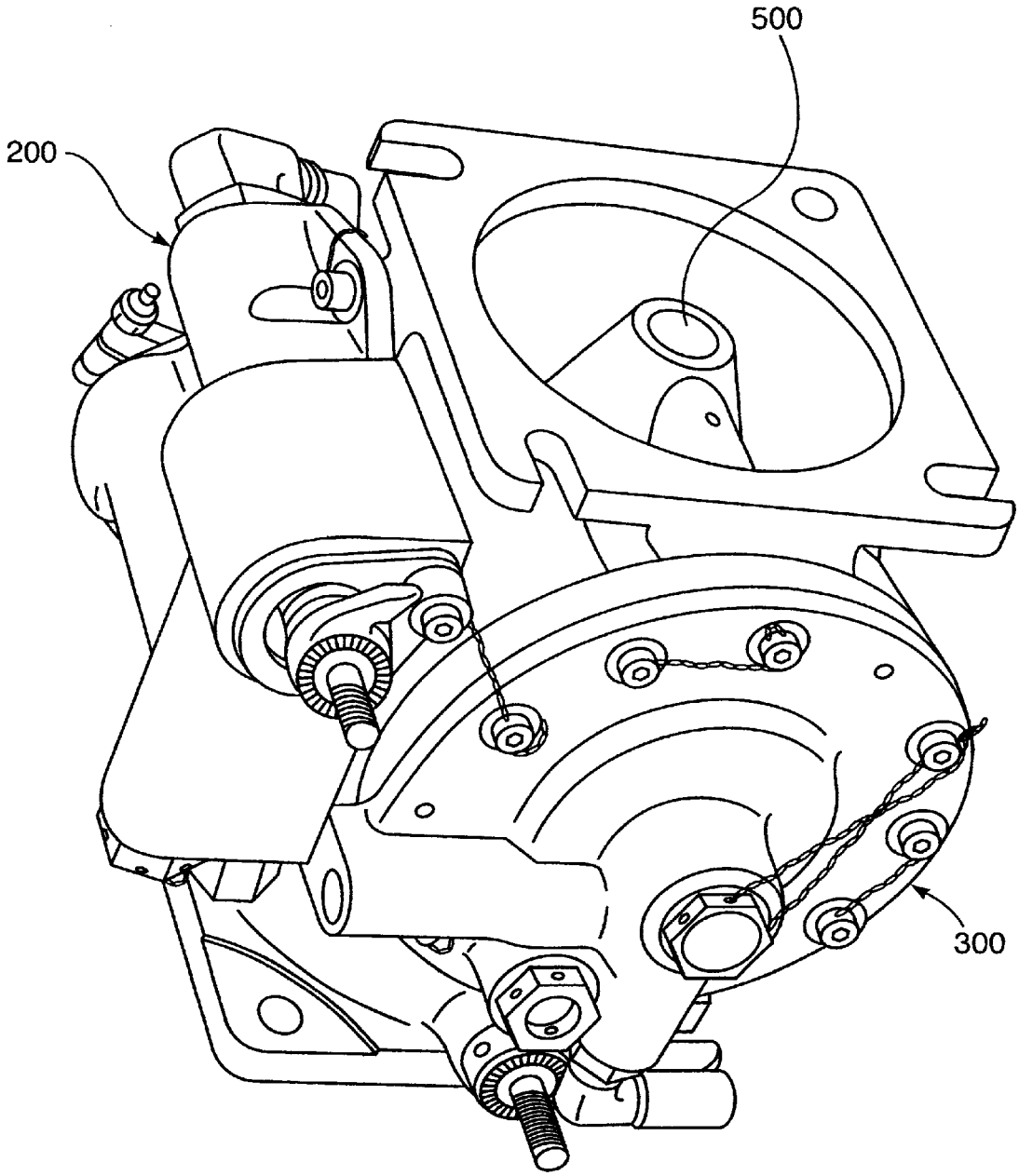
FIG. 7 is another perspective view of the fuel injection servo shown in FIG. 5.
Figure 8:
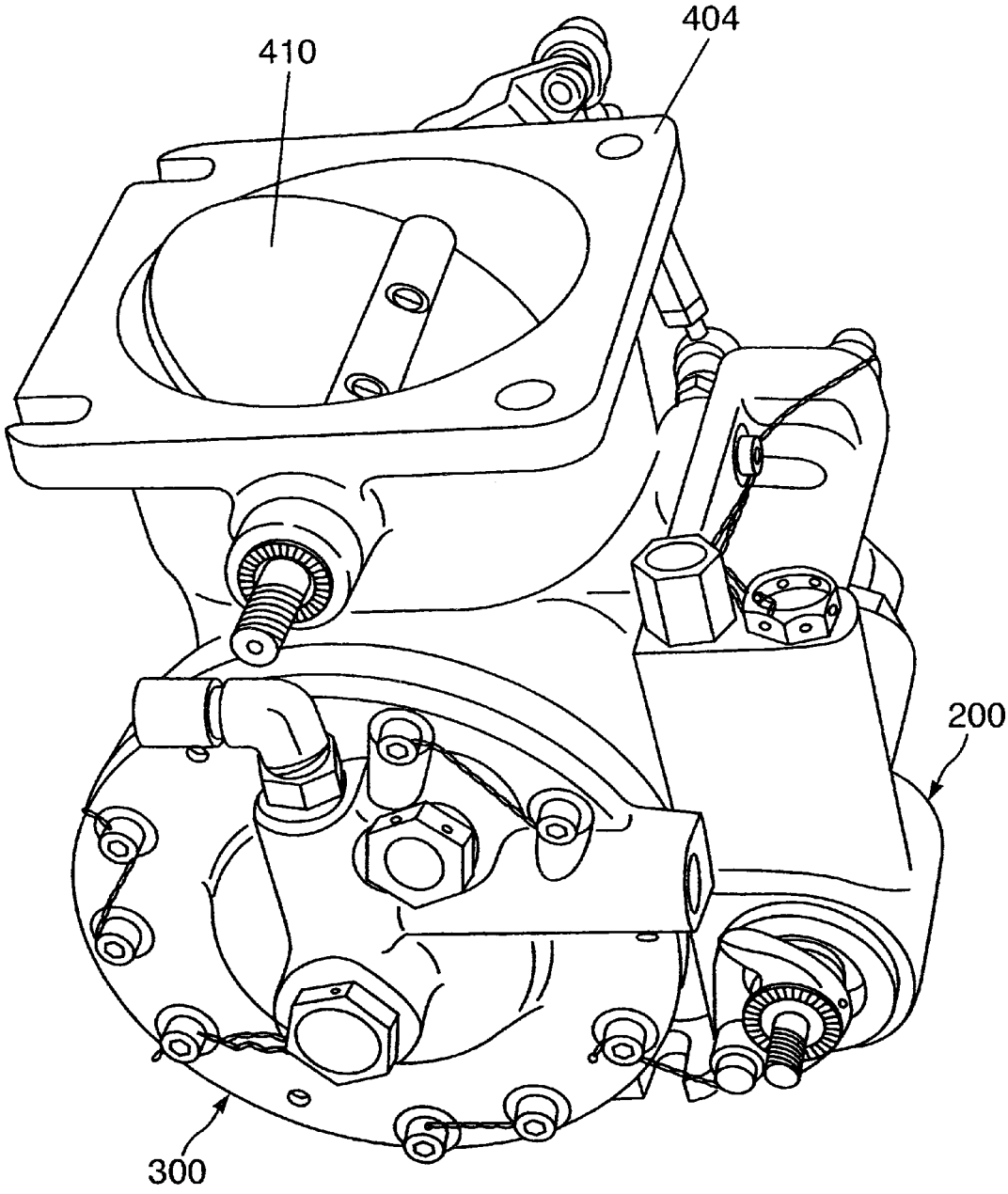
FIG. 8 is another perspective view of the fuel injection servo shown in FIG. 5.

Referring now in detail to the Figures, wherein the same numbers are used where applicable, a fuel control apparatus constructed in accordance with an embodiment of the invention is identified generally by the reference numeral 100, shown in FIG. 5. Although a specific configuration for the fuel control apparatus 100 will be described, it should be readily apparent to those skilled in the art that many facets of the invention are adaptable for use with fuel control apparatuses considerably different than that disclosed. The fuel control apparatus 100 is hereinafter referred to as the fuel injection servo 100.

The fuel injection servo 100 constructed with the principles of the present invention may be generally installed onto an internal combustion engine 900 (FIG. 32) used primarily for aircraft. The internal combustion engine 900 may include any number of combustion cylinders; however, the typical aircraft engine utilizing the fuel injection servo 100 of the embodiment disclosed has either four, six or eight cylinders. It is contemplated that such engines, and thus the fuel injection servo 100, could be installed in boats, land-based vehicles, or other internal combustion driven vehicles and/or equipment. The fuel injector servo 100, when attached to the engine 900 and a flow divider, which distributes the fuel to the combustion chambers of the engine and will be discussed in detail below, becomes part of the aircraft's fuel injection system. The internal combustion engine 900 will be described in more detail below.

The major components of the fuel injection servo 100 include a modular air passage mechanism 400, a modular fuel pressure modifying mechanism 200, and a modular fuel regulator mechanism 300. The modular air passage mechanism 400 is constructed and arranged to allow air to pass therethrough, with the air ultimately being distributed to the combustion chambers of the engine. The modular air passage mechanism 400 is hereinafter referred to as the throttle body assembly 400. The modular fuel pressure modifying mechanism 200 is constructed and arranged to receive fuel from the aircraft's fuel supply and to deliver the fuel at a pressure that is different from the fuel supply to the modular fuel regulator mechanism 300. The modular fuel pressure modifying mechanism 200 is hereinafter referred to as the valve body assembly 200. The modular fuel regulator mechanism 300, hereinafter referred to as the fuel regulator assembly 300, is constructed and arranged to communicate with both the air that flows through the throttle body assembly 400 and the fuel that is delivered to it from the valve body assembly 200 and to regulate the amount of fuel that the engine receives. The amount of fuel delivered to the engine via the fuel regulator assembly 300 is proportional to the amount of air that flows through the throttle body assembly 400. Before a detailed description of each of the above assemblies is given, an overview of the fuel injection servo 100 and its general operation within the fuel injection system will be described.

The throttle body assembly 400 comprises, among other things, a throttle body 402 which is essentially the main body section of the fuel injection servo 100. The valve body assembly 200 and regulator assembly 300 may be removably mounted at adjacent locations to the outer periphery of the throttle body 402. Thus, the valve body assembly 200 and regulator assembly 300 are removably mountable to the throttle body 402 independently from each other. In an exemplary embodiment, the throttle body 402 has an open ended barrel shape, the two ends of which define an air intake side 403 and an air outlet side 404. Although shown having a barrel shape, the throttle body 402 can have various cross-sectional shapes. Air enters the throttle body 402 at the air intake side 403, where the air is represented by number 101 in FIG. 5, and flows through throttle body barrel 435, which defines an airflow channel. The throttle body barrel 435 is hereinafter to referred to as the throttle body airflow channel 435. Mounted within airflow channel 435 is a venturi 500, which the air flows around and through, the details of which are described below. The other end of injection servo 100—air outlet side 404—is connected to the engine via bolts (not shown) that pass through a plurality of holes 432 formed in a flange section at the end of throttle body 402. Air 101, after passing through throttle body airflow channel 435, is distributed to the internal combustion chambers of the engine in a known manner.

Generally, air 101 that flows through throttle body 402 works in combination with venturi 500, regulator assembly 300, and the other components to provide the proper amount of fuel to the combustion chambers with respect to the amount of airflow (i.e., engine power setting), thus providing a fuel injection system that ensures efficient combustion within the engine, which is described in detail below.

One aspect of the present invention is that the throttle body assembly 400, valve body assembly 200, and fuel regulator assembly 300 of the present invention are of a modular construction. Valve body assembly 200 is a separate structure from throttle body 402. That is, valve body assembly 200 is specifically constructed and arranged to be easily replaced with an identical valve body or with a valve body that incorporates additional features without the need to replace throttle body assembly 400 and/or without the need to remove the regulator assembly 300 from the throttle body 402, respectively. Likewise, the fuel regulator assembly 300 is a separate structure from both the throttle body 402 and the valve body assembly 200. That is, the regulator assembly 300 is specifically constructed and arranged to be easily replaced and/or maintained without the need to replace the throttle body assembly 400 and/or without the need to remove the valve body assembly 200 from the throttle body 402. Further, because of this modular construction, the valve body assembly 200 and the regulator assembly 300 can each be preassembled and calibrated separately from the throttle body assembly 400. Thus, the fuel injection servo 100 does not require calibration as a single unit. Further, the modular construction of valve body assembly 200 and fuel regulator assembly 300 simplifies the manufacturing process of the fuel injection system 100. The advantages of the modular construction will be further discussed after a description of an exemplary embodiment.

The basic principles underlying the operation of fuel injector servo 100 will now be described. As is generally known in the art, all reciprocating engines operate most efficiently in a very narrow range of air-to-fuel (or fuel/air) ratios. The fuel injection servo 100 uses the measurement of air volume flow to generate a usable force, which is used to regulate the flow of fuel to the engine in proportion to the amount of air being consumed. This is accomplished by channeling the ambient air impact pressure and venturi suction pressure to opposite sides of an air diaphragm in the regulator assembly 300. The difference between these two pressures becomes a usable force which is equal to the area of the diaphragm times the pressure difference. This force is transmitted through a regulator stem, and is opposed by the force imposed on a fuel diaphragm. The above operation is accomplished within the regulator assembly 300.

Figure 9:
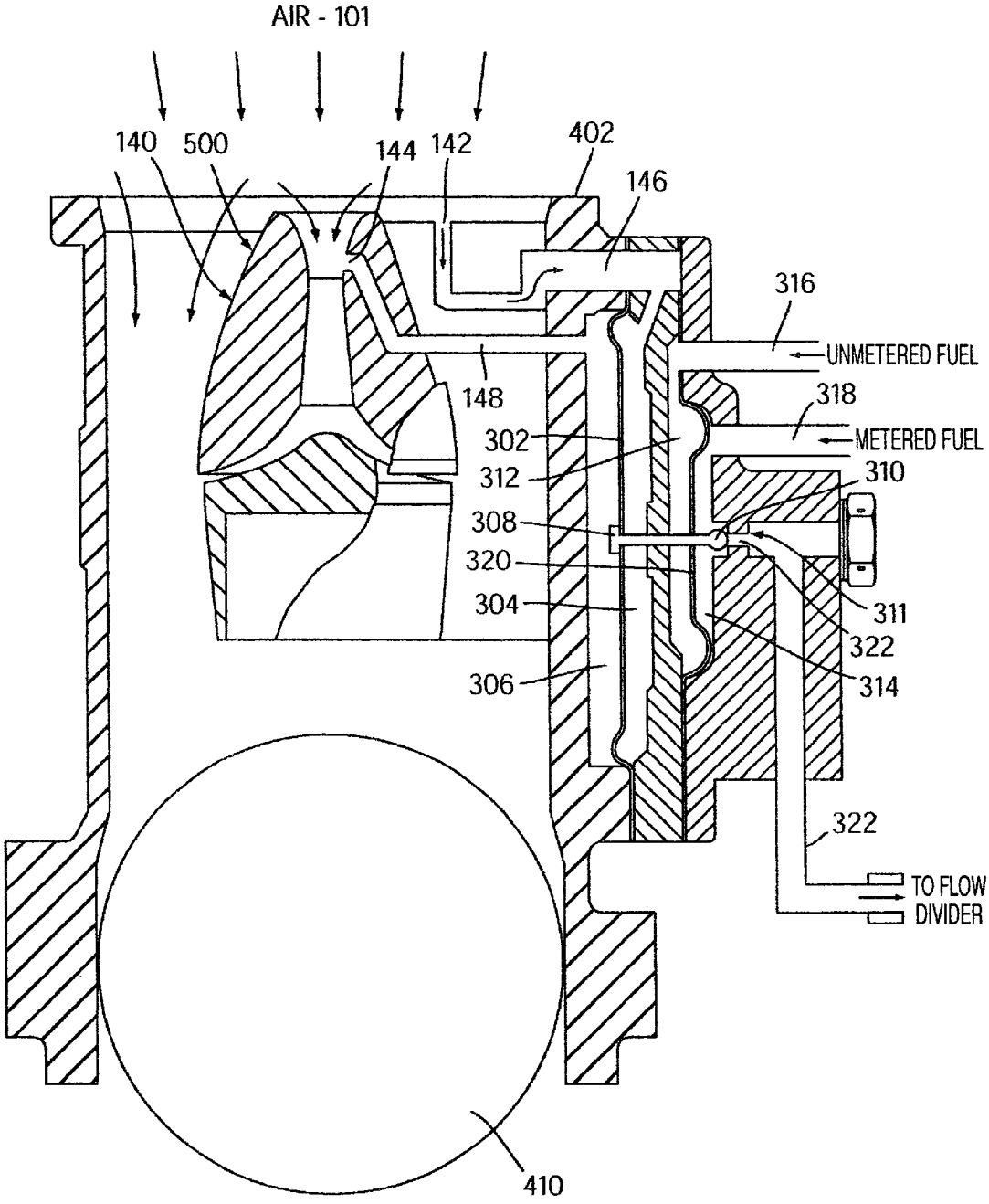
FIG. 9 is a schematic cross-sectional view of the throttle body assembly and regulator assembly of an embodiment of the present invention.

More specifically, referring to FIG. 9, which is a schematic diagram of a cross-section of throttle body assembly 400 and regulator assembly 300, the regulator assembly 300 comprises, among other things, an air diaphragm 302, a fuel diaphragm 320, a regulator stem 308, and a regulator ball 310 located at the end of the regulator stem 308. Air diaphragm 302 communicates with air that flows around and through venturi 500, and fuel diaphragm 320 communicates with a fuel source. Air diaphragm 302 separates and partially defines two air cavities, an ambient air impact side 304 and a venturi suction side 306. Impact air side 304 experiences an air pressure that is equal to the ambient air impact pressure at the entrance of throttle body 402 (i.e., before the air pressure is influenced by venturi 500), which is communicated to it by the impact port 142 and channel 146. Suction side 306 experiences an air pressure, or suction pressure, that is equal to the pressure at the venturi pressure port 144, designated as P(suction), which is communicated to suction side 306 by channel 148. Venturi 500 will be described in detail below. The impact pressure is greater than P(suction), therefore, a net force is exerted on air diaphragm 302 equal to the pressure differential between impact side 304 and suction side 306 multiplied by the area of air diaphragm 302. The resultant force causes deflection of the air diaphragm to the left, thus pulling regulator stem 308 to the left (as seen in FIG. 9). The application of this force to regulator stem 308 allows the regulator ball 310 to be released from its seat (hereinafter the "ball valve" 311), thus allowing fuel to proceed to the engine, as will be discussed below. The fuel diaphragm 320 is used to regulate this flow of fuel.

Fuel diaphragm 320 separates and partially defines two fuel cavities: an unmetered fuel side 312 and a metered fuel side, 314. An engine driven fuel pump (not shown) receives fuel from the aircraft system (including a booster pump (not shown)) and supplies that fuel at a relatively constant pressure to valve body assembly 200, where the fuel is split into two paths: an unmetered path 316 and a metered path 318. Unmetered path 316 and metered path 318 originate in the valve body assembly 200, shown in FIG. 10A. Valve body assembly 200, which is mounted adjacent to fuel regulator assembly 300, communicates with the regulator assembly via unmetered and metered fuel paths 316 and 318, respectively.

Figure 10A:
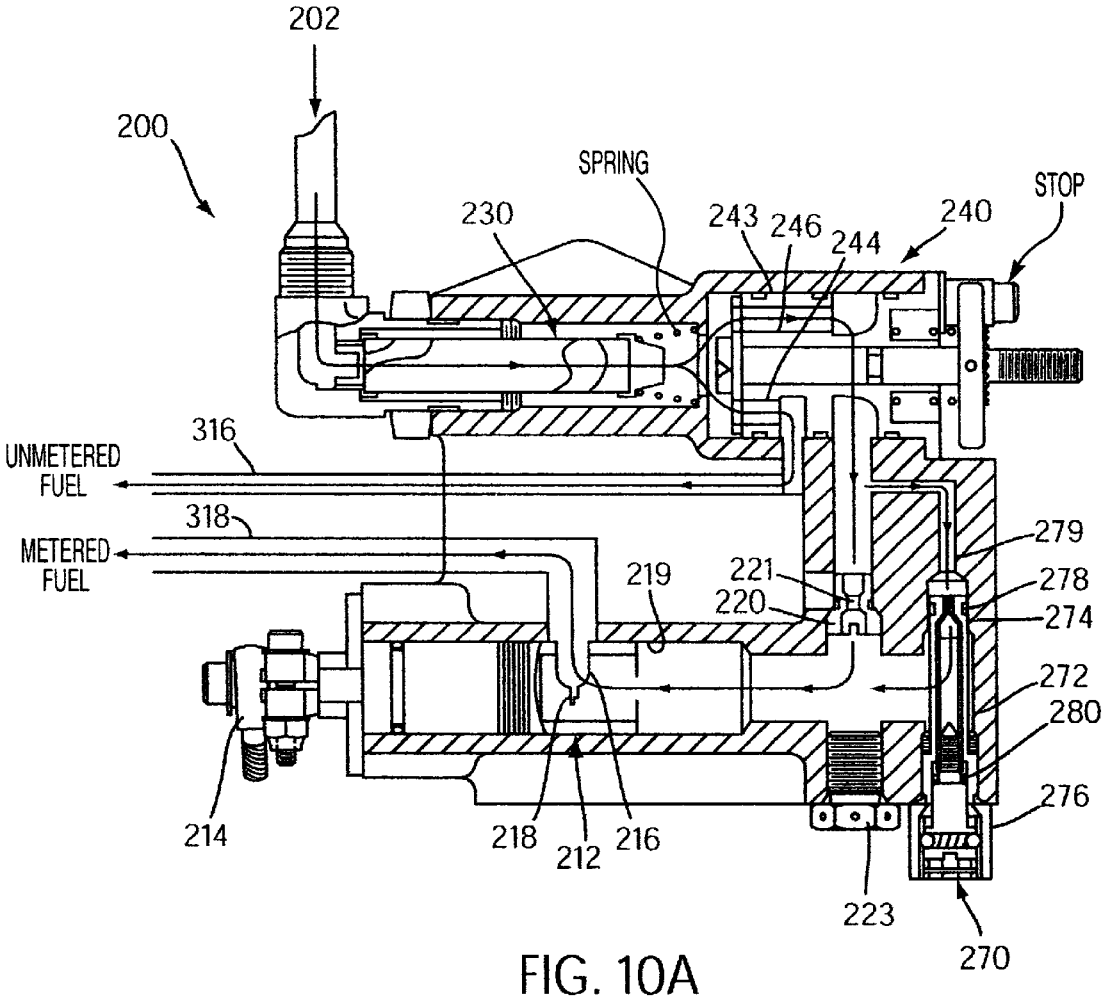
FIG. 10A is a schematic cross-sectional view of the valve body assembly of an embodiment of the present invention.
Figure 10B:
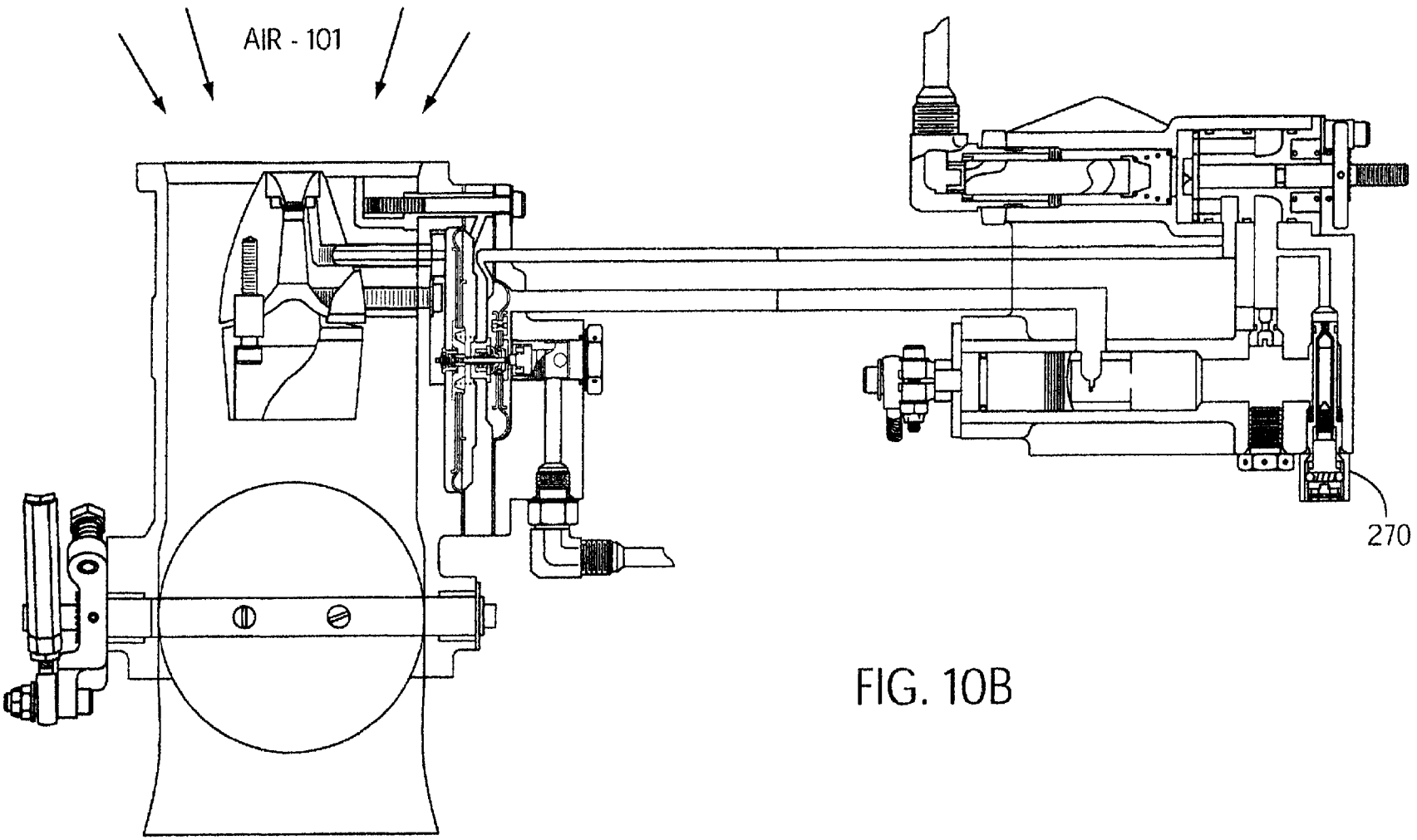
FIG. 10B is a schematic of the throttle body assembly, regulator assembly, and valve body assembly of an embodiment of the present invention.

FIG. 10B is a combination of FIGS. 9 and 10A. Unmetered path 316 directly communicates with unmetered fuel side 312, with the pressure in the unmetered fuel side designated as P(unmetered). Metered fuel side 314 receives fuel from metered path 318, which has passed through a main metering jet 220 and an idle valve 212 (which are shouts in FIG. 10B) in valve body assembly 200, which will be described in more detail below. This fuel has a pressure that is designated as P(metered). The pressure in unmetered fuel side 312. P(unmetered), is greater than the pressure in metered fuel side 314, P(metered), therefore, a net force is exerted on fuel diaphragm 320 that is equal to the pressure differential between the two sides of the diaphragm multiplied by the area of the diaphragm. The resultant force causes deflection of fuel diaphragm 320 to the right, and thus tends to move regulator stem 308 to the right (as shown in FIG. 9). Thus, the forces applied to stem 308 by air diaphragm 302 and fuel diaphragm 320 oppose each other to provide the proper amount of metered fuel through ball valve 311 that controls an orifice opening 322, through which fuel flows to the engine.

Further explanation of the above system is facilitated by describing a power change which requires a fuel flow change. This explanation begins with the engine running at a cruise condition. Here, the air velocity through throttle body barrel 435 is generating a pressure differential between the ambient air impact pressure (P(impact)) and the venturi suction pressure (P(suction)), which, for illustrative purposes only, is at a theoretical value of two. This air pressure differential exerts a force to the left as shown in FIG. 9, which is applied to the regulator stem 308. At the same time, fuel flows to the engine because the ball valve 311 formed by ball 310 and opening 322 has opened. This generates a fuel pressure differential (unmetered fuel pressure minus metered fuel pressure), applied across fuel diaphragm 320, that also creates a force with a theoretical of two. That is, the two forces become equal. Because these two opposing forces (fuel and air differentials) are equal, the regulator ball 310 of valve 311 (which is connected to both diaphragms by regulator stem 308) is held in a fixed position that allows the discharge of just enough metered fuel to maintain the pressure balance.

If the throttle 410 is opened to increase power, air flow immediately increases. This results in an increase in the pressure differential across air diaphragm 302 to a theoretical value of, for example, three. An immediate result of this increase in pressure is that regulator stem 308 moves to the left (as seen in FIG. 9) to further open ball valve 311. This increased ball valve 311 opening causes a decrease in pressure in metered fuel side 314, and since unmetered fuel side 312 pressure remains constant, an increase in fuel pressure differential occurs across the fuel diaphragm. When this increasing fuel differential pressure force reaches a value of three (equaling the air diaphragm force), regulator stem 308 stops moving and the ball valve stabilizes at a position which will maintain the balance of pressure differentials, i.e., air and fuel, each equaling three. Fuel flow to the engine has thus increased, as requested by the pilot (or user), because the ball valve has opened up to a new position. Because the fuel diaphragm force generated by the pressure drop across the main metering jet 220 is equal to the air diaphragm force being generated by venturi 500, the amount of fuel that is flowing to the engine is the precise amount required for the amount of air intake into the combustion chambers, thus providing the proper fuel/air ratio for efficient combustion. The above sequence of operations is true for all regimes of power operation and all power changes. Ball valve 311 responds to changes in effective air differential pressure forces and adjusts the position of ball valve 311 to regulate unmetered to metered fuel pressure differential forces accordingly. Fuel flow through the metering jet 220, and to the engine, is a function of the jet's size and the pressure differential across it. Ball valve 311 does not meter fuel. It only controls the pressure differential across the metering jet 220.

Figure 11:
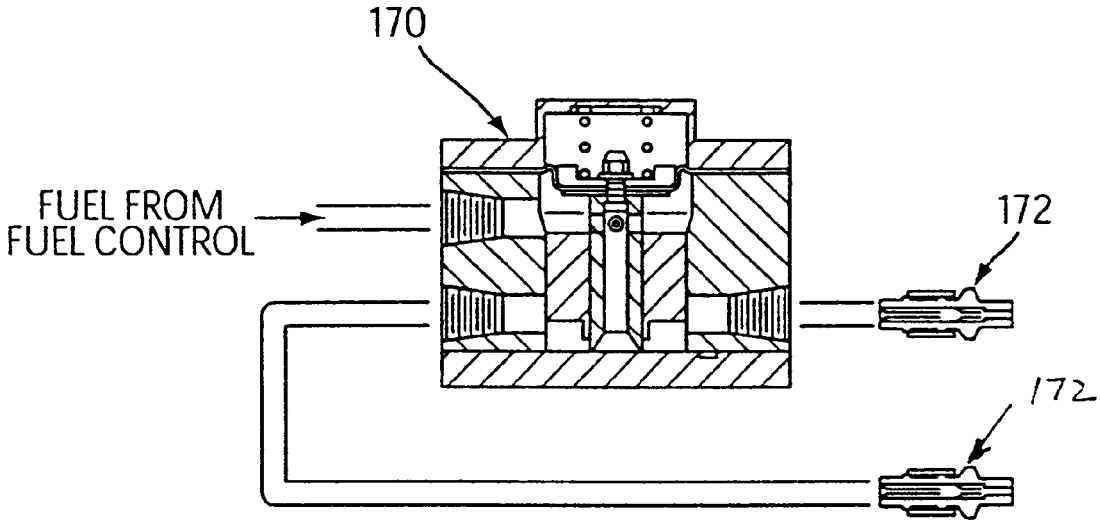
FIG. 11 is a schematic cross-sectional view of the flow divider used in the fuel injection system of an embodiment of the present invention.

The metered fuel exits regulator assembly 300 via tube 322 and is delivered from the regulator assembly of the fuel injection system to the engine through a system which includes a flow divider 170 and a set of discharge nozzles 172 (one nozzle per cylinder). The flow divider 170 is shown schematically in FIG. 11. A flow divider 170, however, is not always required. In those engines that do not use a flow divider, the fuel flow is divided by either a single four-way fitting (not shown), which is used on four-cylinder engines, or a tee (not shown) which divides the fuel flow into two separate paths. Each path incorporates a three-way fitting when used on six-cylinder engines. The flow divider comprises a valve, sleeve, diaphragm and a spring. The valve is spring loaded to the closed position in the sleeve. This effectively closes the path of fuel flow from the fuel regulator assembly 300 to the nozzles and at the same time isolates each nozzle from all the others at engine shut down. The two primary functions of the flow divider are: 1) to assure equal distribution of metered fuel to the nozzles at and just above idle; and 2) to provide isolation of each nozzle from all the others for clean engine shut down. The area of the fuel discharge jet in the fuel nozzles is sized to accommodate the maximum fuel flow required at rated horsepower without exceeding the available inlet fuel pressure to satisfy all the pressure drops in the fuel injection system. The flow divider 170 operates to deliver metered fuel to the cylinders in a conventional manner as is known in the art and therefore will not be described in detail herein.

The regulator assembly 300, the valve body assembly 200, and the throttle body assembly 400 of an embodiment of the present invention will now be described in further detail.

The Fuel Regulator Assembly 300

Further detail of the regulator assembly 300 is shown in FIGS. 12–20, noting that the orientation of these figures is reversed from that shown in FIG. 9. Generally, the regulator assembly (i.e., the modular fuel regulator mechanism) is constructed and arranged to communicate with the airflow in the throttle body assembly 400 (i.e., the air passage mechanism) and a fuel supply to regulate an amount of fuel delivered to the engine. The regulator assembly 300 comprises an air diaphragm assembly 340, a fuel diaphragm assembly 330, a center body assembly 350, a rear regulator cover assembly 370, and a servo seat assembly 380. The center body assembly 350 is mounted between the air and fuel diaphragm assemblies 340, 330, thus separating the air and fuel chambers from each other. Air diaphragm assembly 340, shown separately in FIG. 14, includes air diaphragm 302, air diaphragm retainer 342, and diaphragm washers 344, 346. Retainer 342 and washers 344, 346 are made of metal, but could be made from other material, such as plastic, as long as they are sufficiently strong and rigid. Diaphragm 302 is sandwiched between the two washers 344, 346, which are then mounted to a mounting surface 343 on retainer 342, shown separately in FIG. 14C. Retainer 342 is positioned at the center of air diaphragm assembly 340. Air diaphragm 302 is made of a flexible, impermeable, synthetic rubber material. Washers 344, 346 have a plurality of holes formed therein for weight reduction, which aids in the overall performance of the regulator section. Specifically, the weight reduction reduces the "g" forces experienced by the fuel diaphragm 320, resulting in more consistent fuel flow to the engine during aircraft maneuvers.

Figure 12:
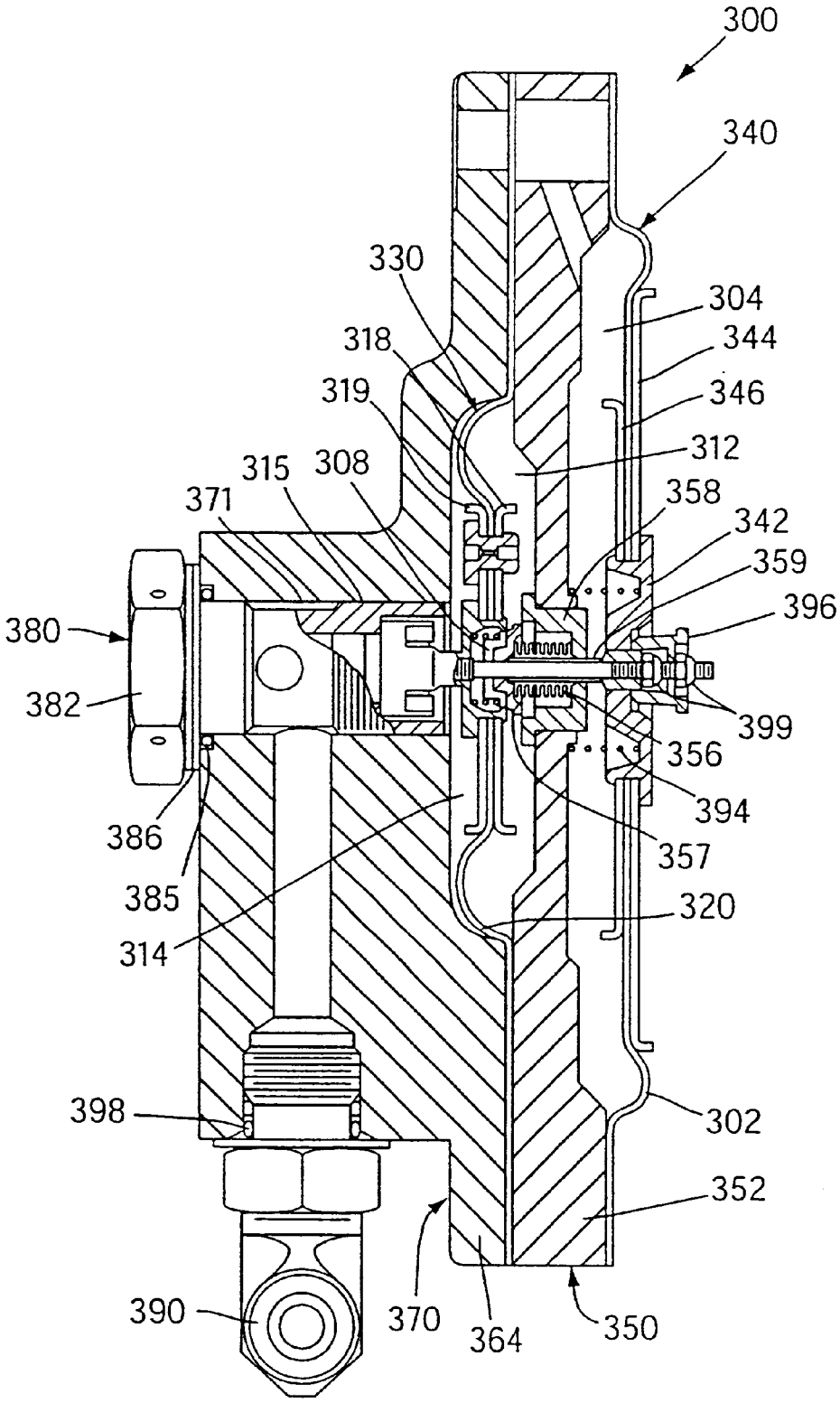
FIG. 12 is a cross-sectional view of the regulator assembly used in the fuel injection servo of an embodiment of the present invention.
Figure 13:
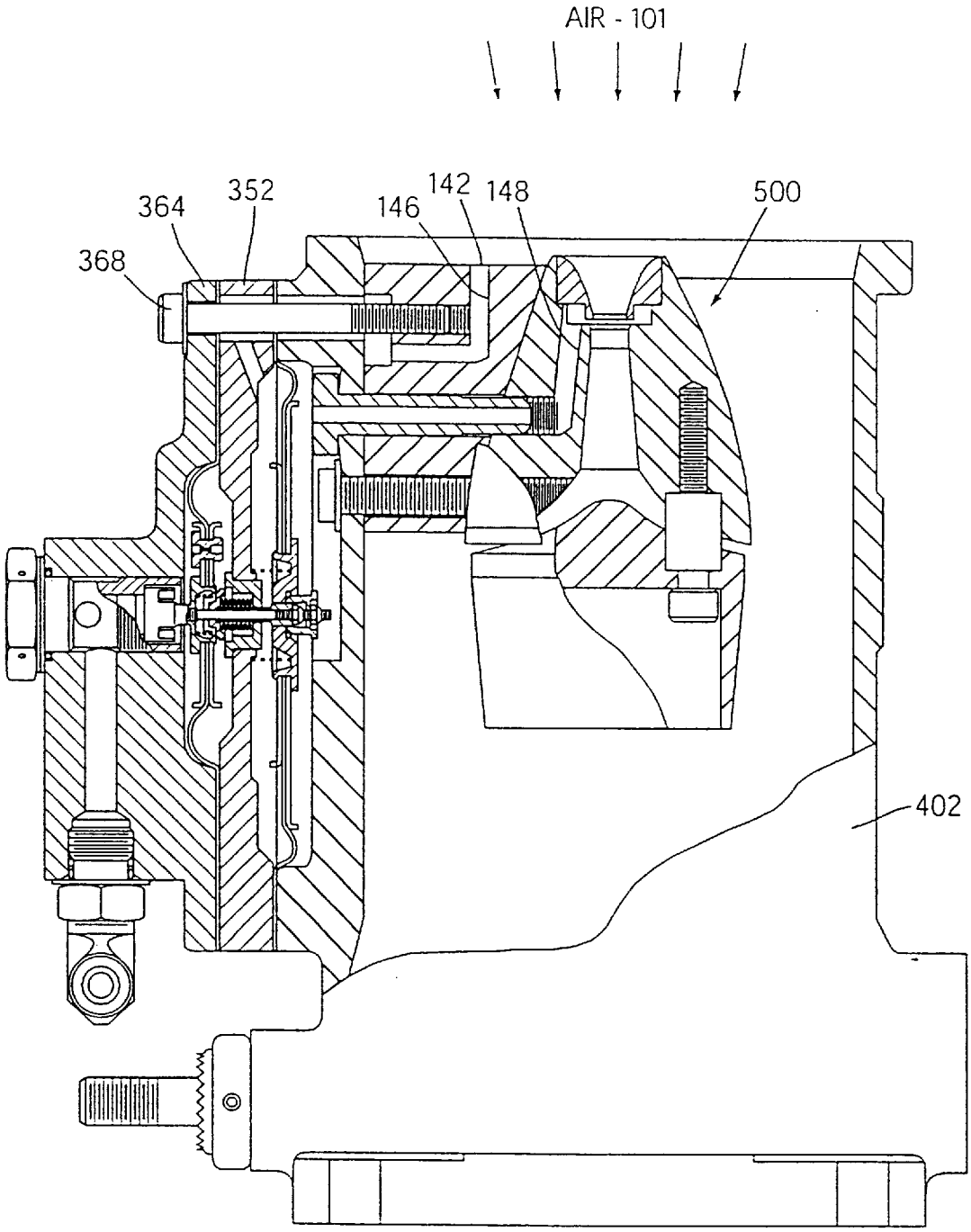
FIG. 13 is a cross-sectional view of the throttle body assembly and the regulator assembly used in the fuel injection servo of an embodiment of the present invention.
Figure 14B:
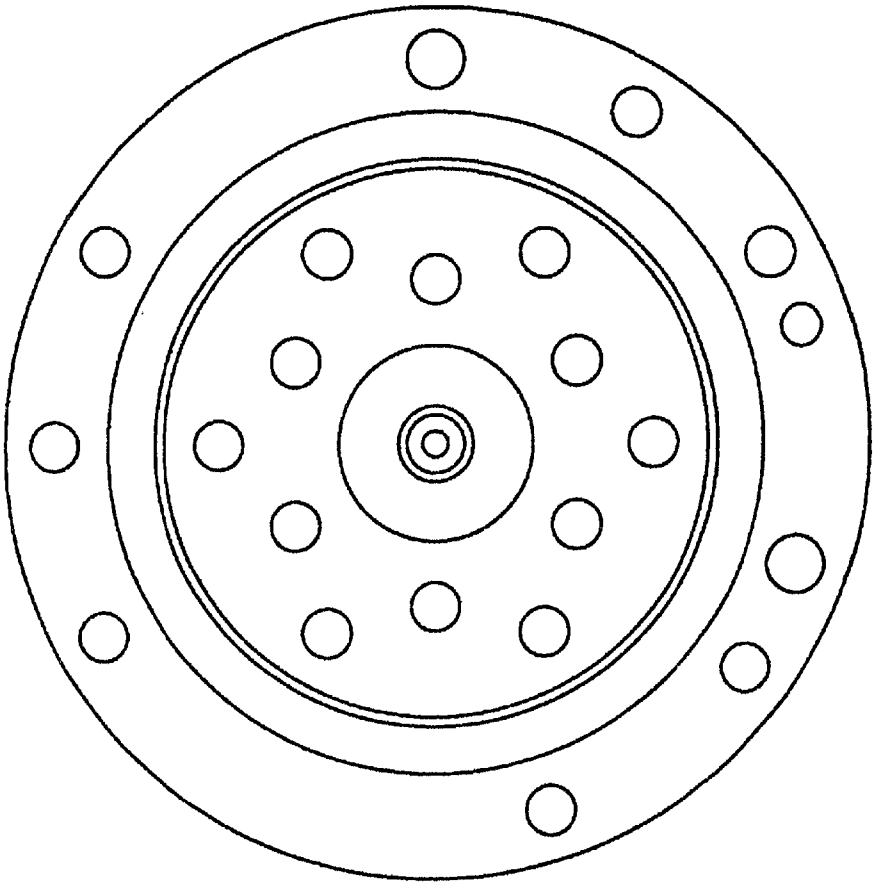
FIG. 14B shows a front view of the air diaphragm assembly used in the fuel injection servo of an embodiment of the present invention.
Figure 14A:
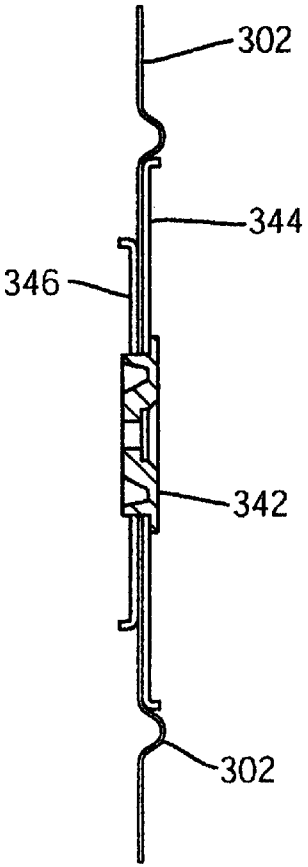
FIG. 14A shows a side view of the air diaphragm assembly used in the fuel injection servo of an embodiment of the present invention.
Figure 14C:
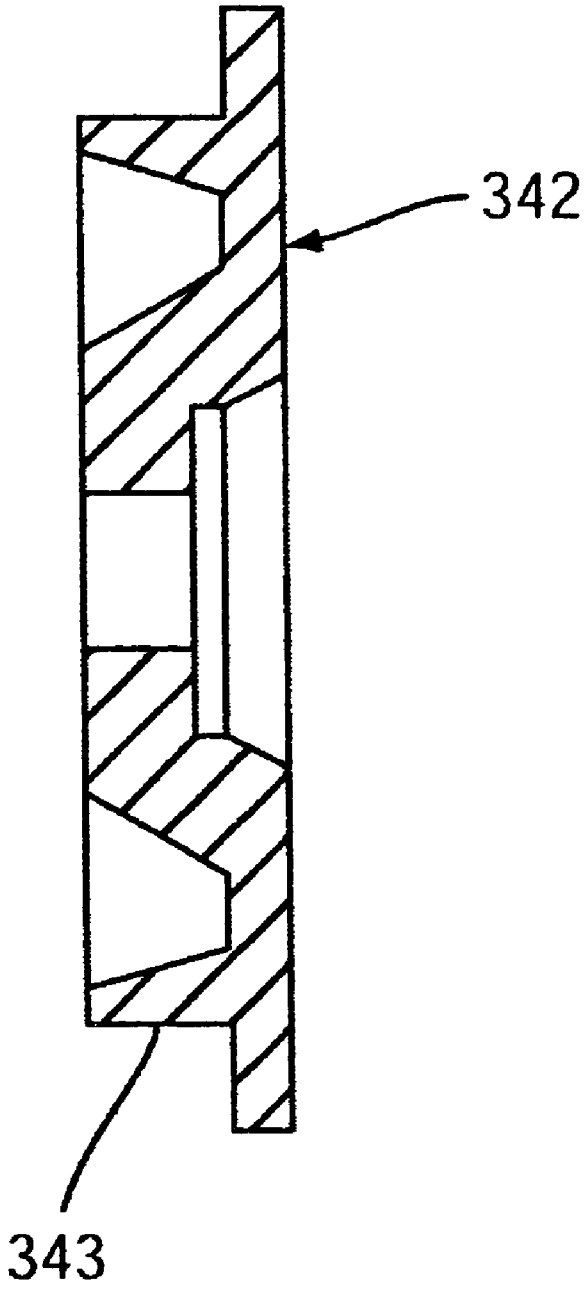
FIG. 14C shows the air diaphragm retainer used in the air diaphragm assembly of FIGS. 14A and 14B.
Figure 15B:
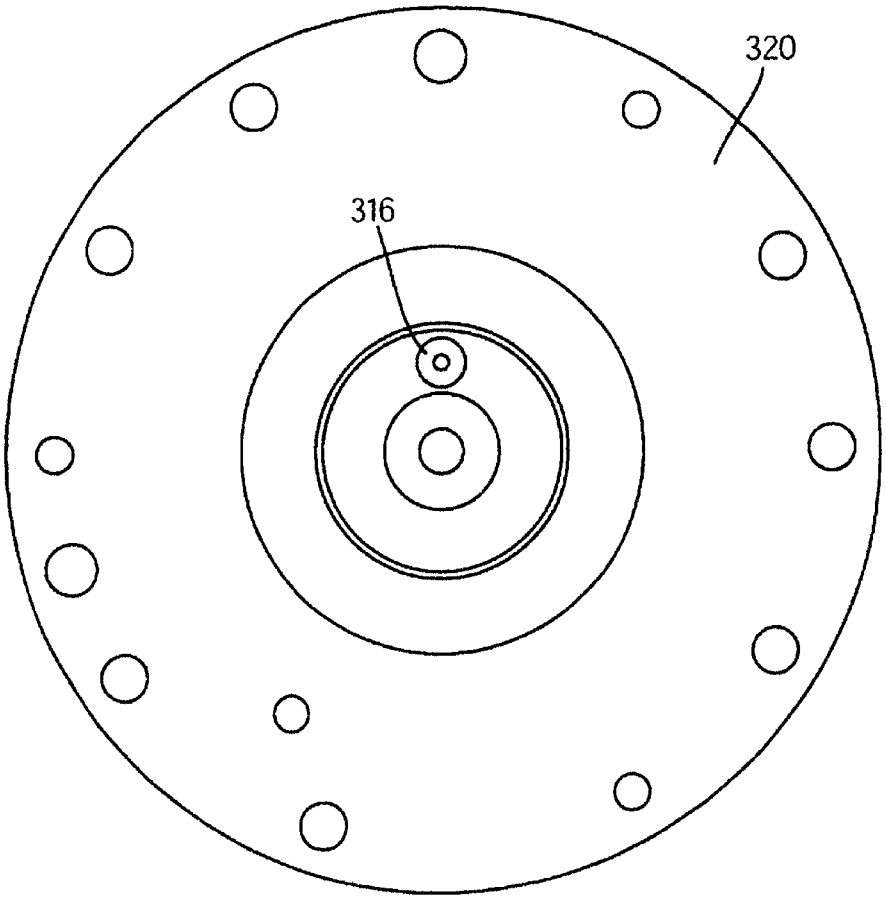
FIG. 15B shows a front view of the fuel diaphragm assembly used in the fuel injection servo of an embodiment of the present invention.
Figure 15A:
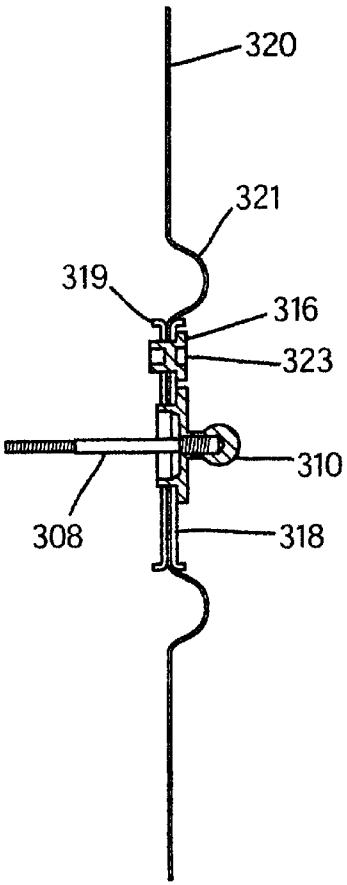
FIG. 15A shows a side view the fuel diaphragm assembly used in the fuel injection servo of an embodiment of the present invention.
Figure 15C:
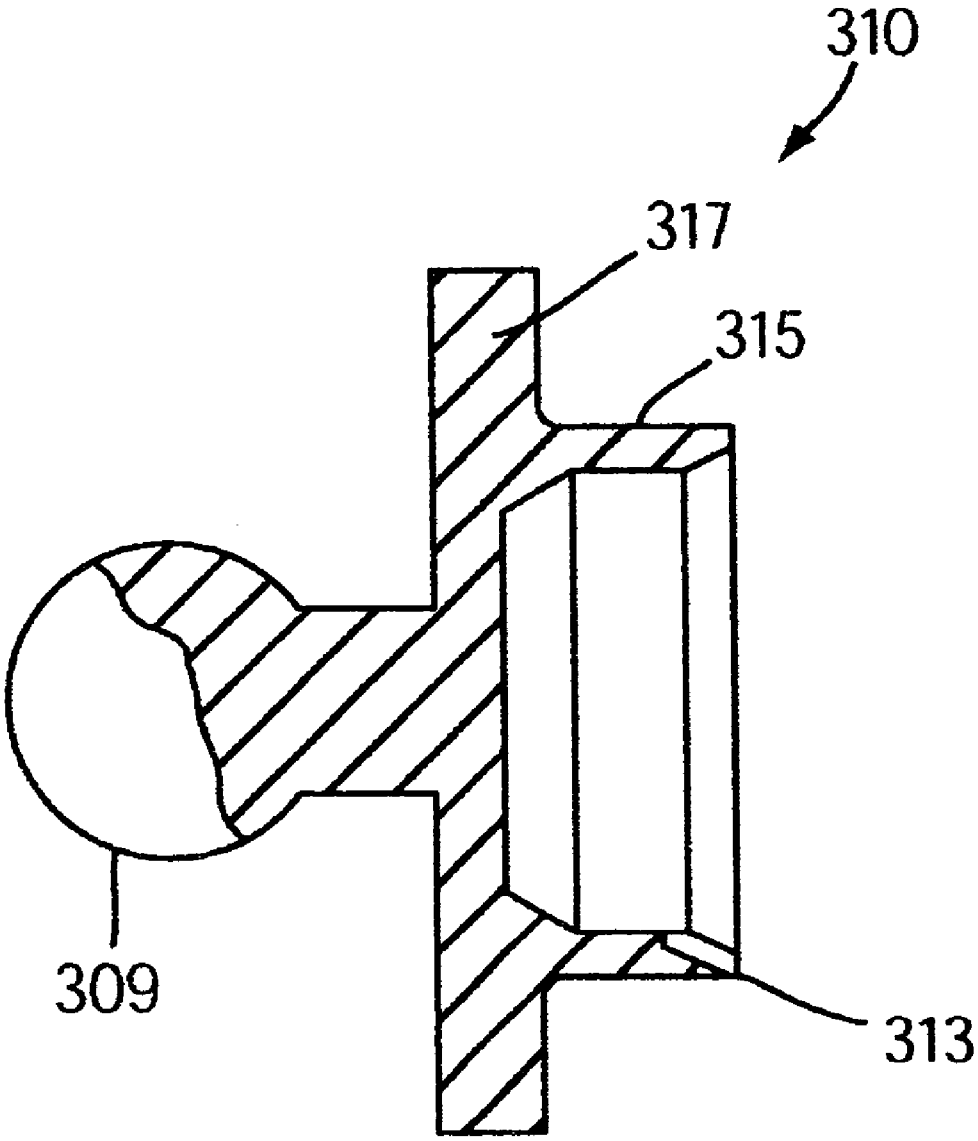
FIG. 15C shows the regulator ball used in the fuel diaphragm assembly of FIGS. 15A and 15B.

Fuel diaphragm assembly 330, shown separately in FIG. 15A, includes the fuel diaphragm 320, regulator ball 310, regulator stem 308, two fuel diaphragm washers 318, 319, and a diaphragm rivet 316. Like air diaphragm 302, the fuel diaphragm 320 is made of a flexible, impermeable, synthetic rubber material, and is sandwiched between the two washers 318, 319, which are in turn mounted at their inner periphery to a mounting surface formed on regulator ball 310. Shown separately in FIG. 15C, regulator ball 310 includes a spherical portion 309 integrally formed on the end of a hollow, cylindrical portion 313, the outside diameter 315 of which has mounted thereon the two washers 318, 319. A flange portion 317 is also formed on the end of the cylindrical portion 313 adjacent the spherical portion 309 for providing a stop for washer 319. Regulator stem 308 is centered within cylindrical portion 313 and is fixedly connected thereto (FIG. 12). Diaphragm rivet 316 is riveted to washers 318, 319 near the outer periphery thereof. Rivet 316 has a hole 323 formed therethrough, which allows air that may become trapped in the unmetered fuel side 312 to be vented to the metered fuel side 314 so that the air can be expelled from the fuel regulator. The fuel diaphragm has an annular undulation 321 located radially adjacent to the outside diameter of washers 318, 319.

Figure 16:
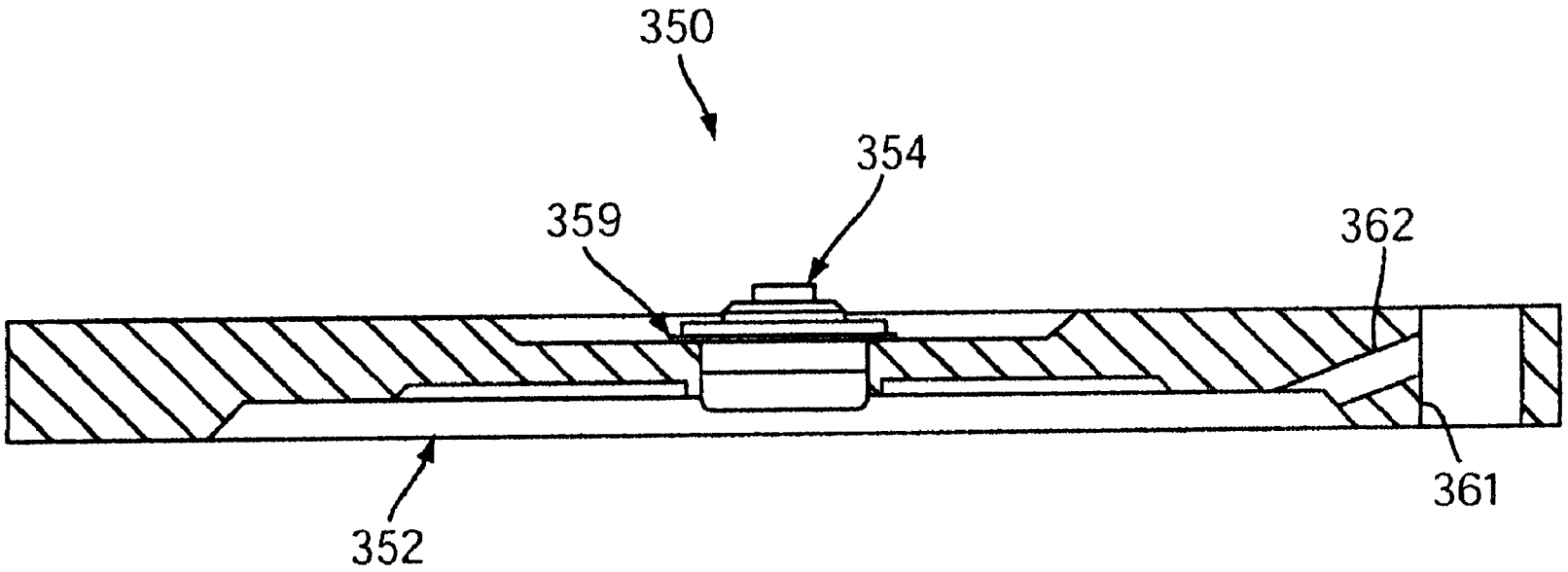
FIG. 16 shows the center body assembly of the regulator assembly used in the fuel injection servo of an embodiment of the present invention.
Figure 17:
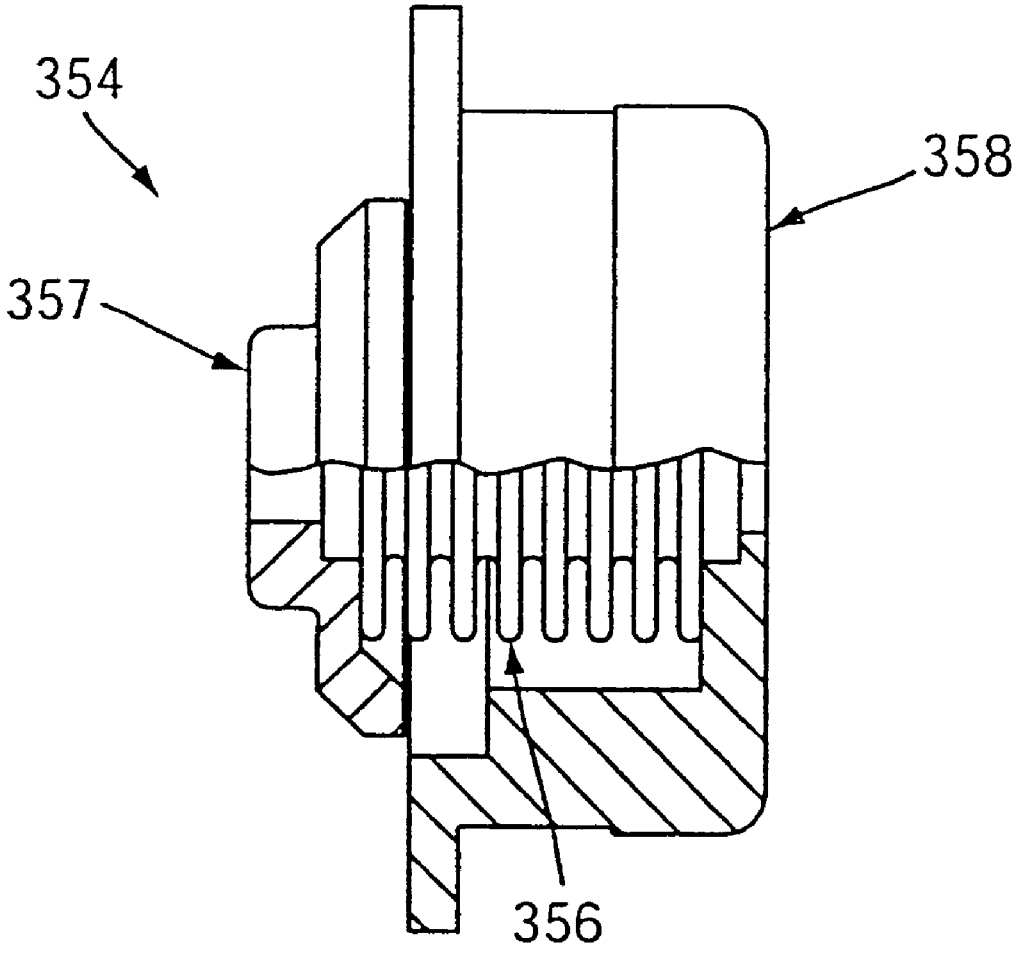
FIG. 17 shows the bellows assembly of the regulator assembly used in the fuel injection servo of an embodiment of the present invention.
Figure 18:
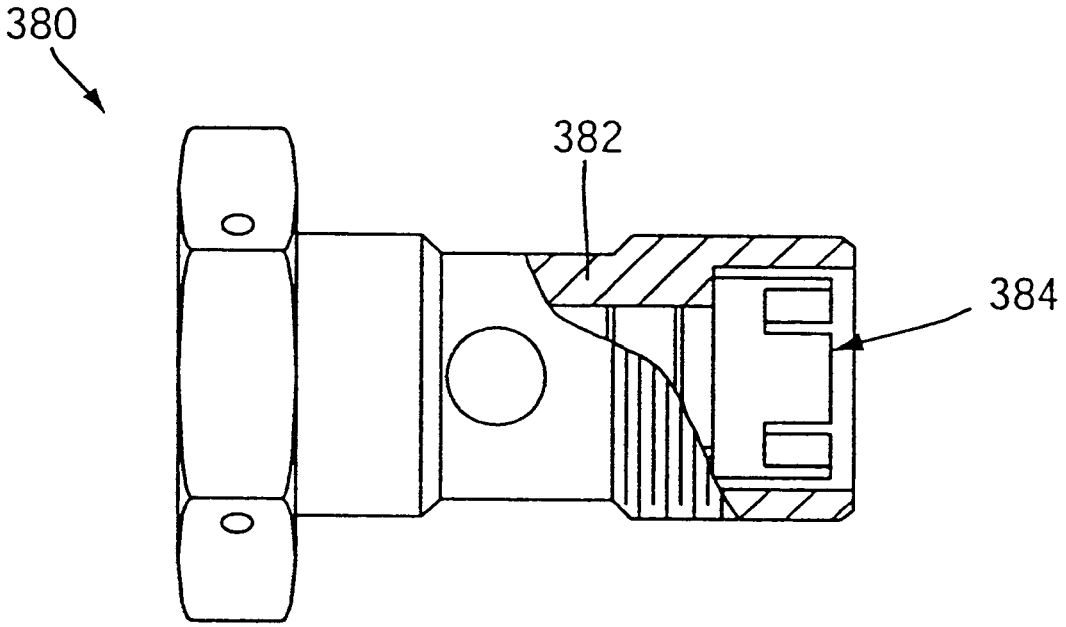
FIG. 18 shows the servo seat assembly of the regulator assembly used in the fuel injection servo of an embodiment of the present invention.
Figure 19A:
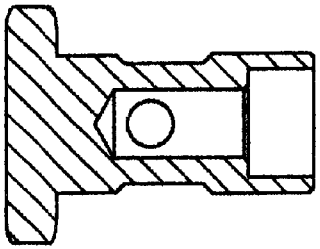
FIG. 19A shows a side cross sectional view of the servo seat fitting used in the servo seat assembly of FIG. 18.
Figure 19C:
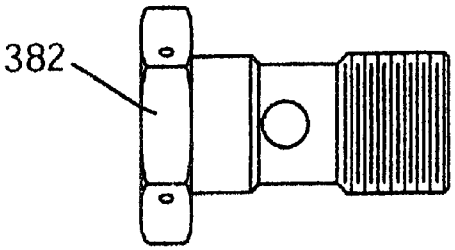
FIG. 19C shows a side view of the servo seat fitting used in the servo seat assembly of FIG. 18.
Figure 19D:
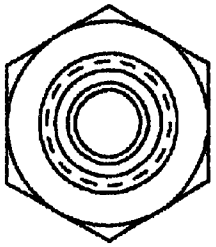
FIG. 19D shows an end cross sectional view of the servo seat fitting used in the servo seat assembly of FIG. 18.
Figure 19B:
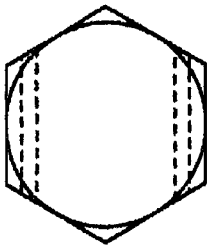
FIG. 19B shows an end view of the servo seat fitting used in the servo seat assembly of FIG. 18.
Figure 20C:
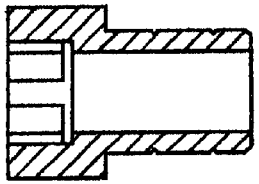
FIG. 20C shows a cross sectional side view of the servo seat used in the servo seat assembly of FIG. 18.
Figure 20B:
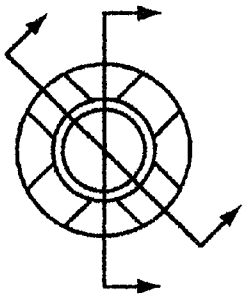
FIG. 20B shows an end view of the servo seat used in the servo seat assembly of FIG. 18.
Figure 20D:
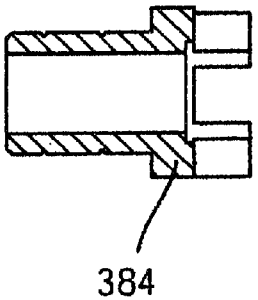
FIG. 20D shows a cross sectional side view of the servo seat used in the servo seat assembly of FIG. 18.
Figure 20A:
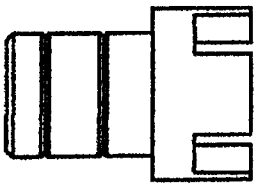
FIG. 20A shows a side view of the servo seat used in the servo seat assembly of FIG. 18.

Center body assembly 350, shown separately in FIG. 16, includes center body 352, a bellows assembly 354, and a shim 359. Bellows assembly 354, shown separately in FIG. 17, includes a cup-shaped bellows cage 358, a bellows 356 located within cage 358, and a bellows hat 357 for retaining bellows 356 within cage 358. Bellows assembly 354 is located at the center of center body 352 and press fitted therein at the outer periphery of bellows cage 358, as shown in FIG. 12. A through hole 361 is formed near the outer periphery of center body 352, which is used as both a bolt hole for mounting the regulator assembly 300 to throttle body 402 using bolt 368, shown in FIG. 13 and, because the outer diameter of the hole is larger than the bolt, the hole also is a portion of channel 146. Channel 146 communicates the ambient air impact pressure of the venturi 500 with the impact pressure side of the air diaphragm 302. Channel 146 further includes a hole 362 formed in center body 252 that extends from the surface of hole 361 at an intermediate portion thereof to the impact pressure side of the center body. The shim 359 is used to take up any clearances that may exist after assembly of the above components.

The outer periphery of the air and fuel diaphragms have a plurality of through holes that correspond to through holes in center body 352 and rear regulator cover 364. Thus, the regulator assembly 300 is bolted to throttle body 402 at corresponding holes therein by a corresponding plurality of bolts, one of which includes bolt 368, the bolt hole of which is also used as a portion of air channel 146, as described above. When bolted to throttle body 402, the synthetic rubber air and fuel diaphragms form a tight seal along the outer periphery of the regulator assembly 300.

Air diaphragm assembly 340 and fuel diaphragm assembly 330 communicate with each other via regulator stem 308, which is fixedly interconnected to air diaphragm 302 at one end, and fixedly interconnected to fuel diaphragm 320 at an intermediate portion thereof, adjacent regulator ball 310. Regulator stem 308 passes through the center of bellows assembly 354. The bellows assembly and the regulator stem are constructed and arranged such that the regulator stem can freely translate relative to center body 352 during movement of the regulator stem caused by forces generated by the pressure differentials between the two sides of the air and fuel diaphragms. A locating bushing 359 is fitted around the regulator stem, the bushing being in sliding contact with the bellows. One end of the bushing has an increased outer diameter that is slip-fitted into the center of the air diaphragm retainer 342, thus establishing a self-centering connection between regulator stem 308 and air diaphragm assembly 340.

Regulator ball 310 sits pressed against the servo seat of servo seat assembly 380 to form ball valve 311 through which metered fuel flows from metered side 314 of fuel diaphragm 320. Servo seat assembly 380, shown separately in FIG. 18, includes a servo seat fitting 382 (shown separately in FIGS. 19A-D) and a servo seat 384 (shown separately in FIGS. 20A-D), which are fitted together, with the servo seat placed inside a cavity formed in the servo seat fitting. Servo seat assembly 380 is connected to the regulator assembly 300 by the outside threads formed in servo seat fitting 382 which engage corresponding inner threads 375 formed in bore 371 of rear regulator cover 364, seen in FIG. 12. Servo seat 384 is fixed to servo seat fitting 382. A plurality of shims 386, seen in FIG. 12, are positioned between the hex head of servo seat fitting 382 and the rear surface of regulator cover 364. These shims 386 are used to make final adjustments during set-up of regulator assembly 300 and during calibration of the regulator assembly, which will be discussed below.

Servo seat assembly 380 also includes a constant effort spring 394, an O-ring 385, an outlet fitting 390, an outlet fitting o-ring 398, a spring holder 396, and two regulator stem lock nuts 399. Constant effort spring 394 supplements the transition from idle to regulator controlled fuel flow, which is discussed in more detail below. Constant effort spring 394 also assists the air diaphragm to move smoothly from the low air flow idle range to the higher power range of operation. It is also furnished in a selection of strengths to be utilized for proper calibration of the unit.

This servo seat design permits the removal of servo seat assembly 380 without the need to remove regulator assembly 300. This feature reduces the time required to calibrate the regulator servo valve seat because the ball valve seat is not located in the interior of the regulator. To remove the servo seat assembly, the servo fitting is unscrewed from rear regulator cover 364, thus removing the shims 386, the servo seat fitting 382, and the servo seat 381.

The Valve Body Assembly 200

Figure 21A:
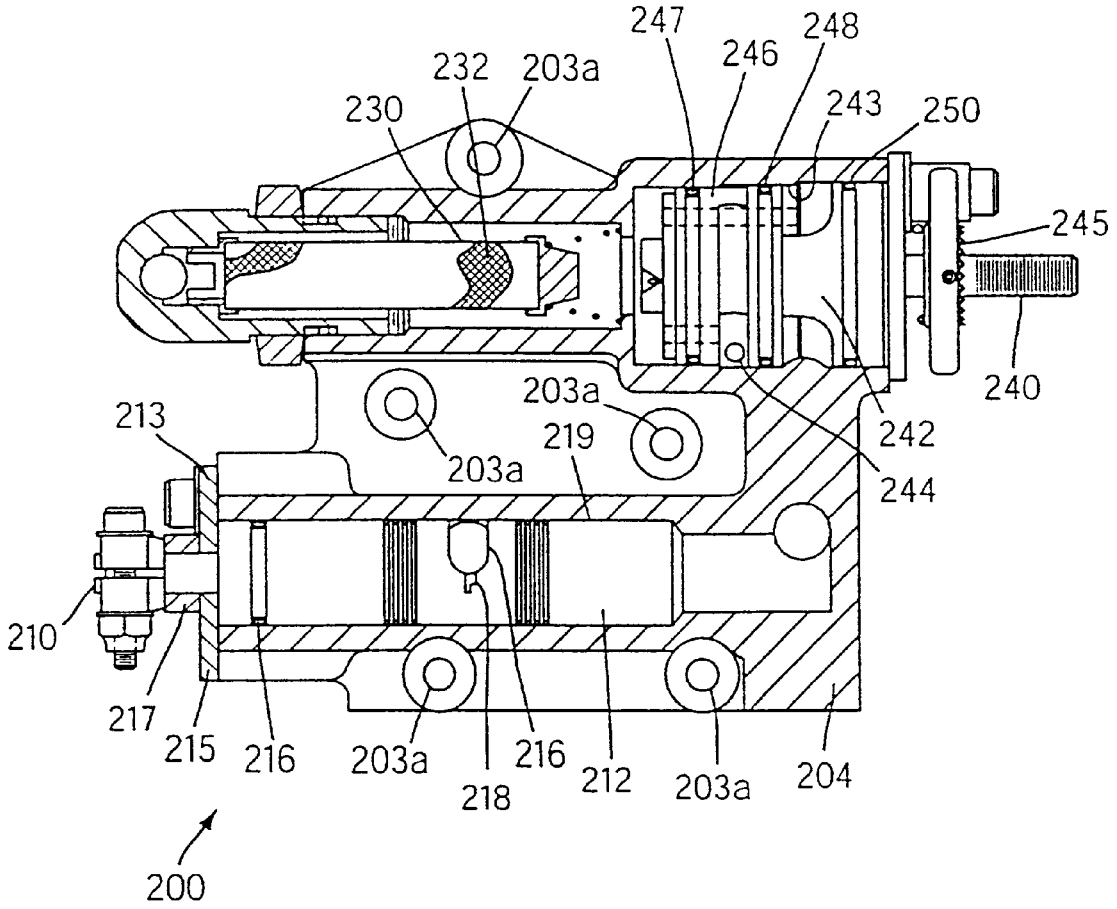
FIG. 21A shows the valve body assembly used in the fuel injection servo of an embodiment of the present invention.
Figure 21D:
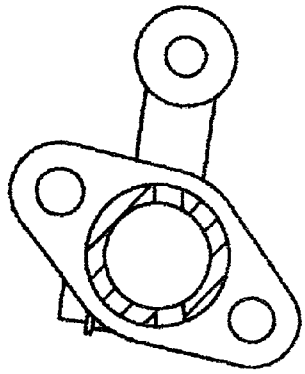
FIG. 21D shows an end view of the idle valve assembly used in the valve body assembly of FIG. 21A.
Figure 21C:
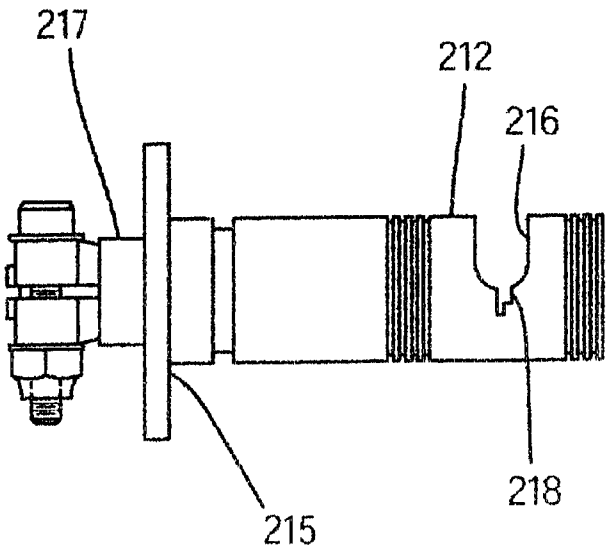
FIG. 21C shows a side view of the idle valve assembly used in the valve body assembly of FIG. 21A.
Figure 21B:
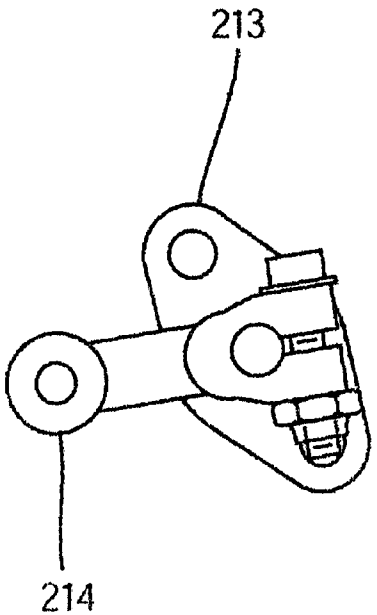
FIG. 21B shows an end view of the idle valve assembly used in the valve body assembly of FIG. 21A.
Figure 22:
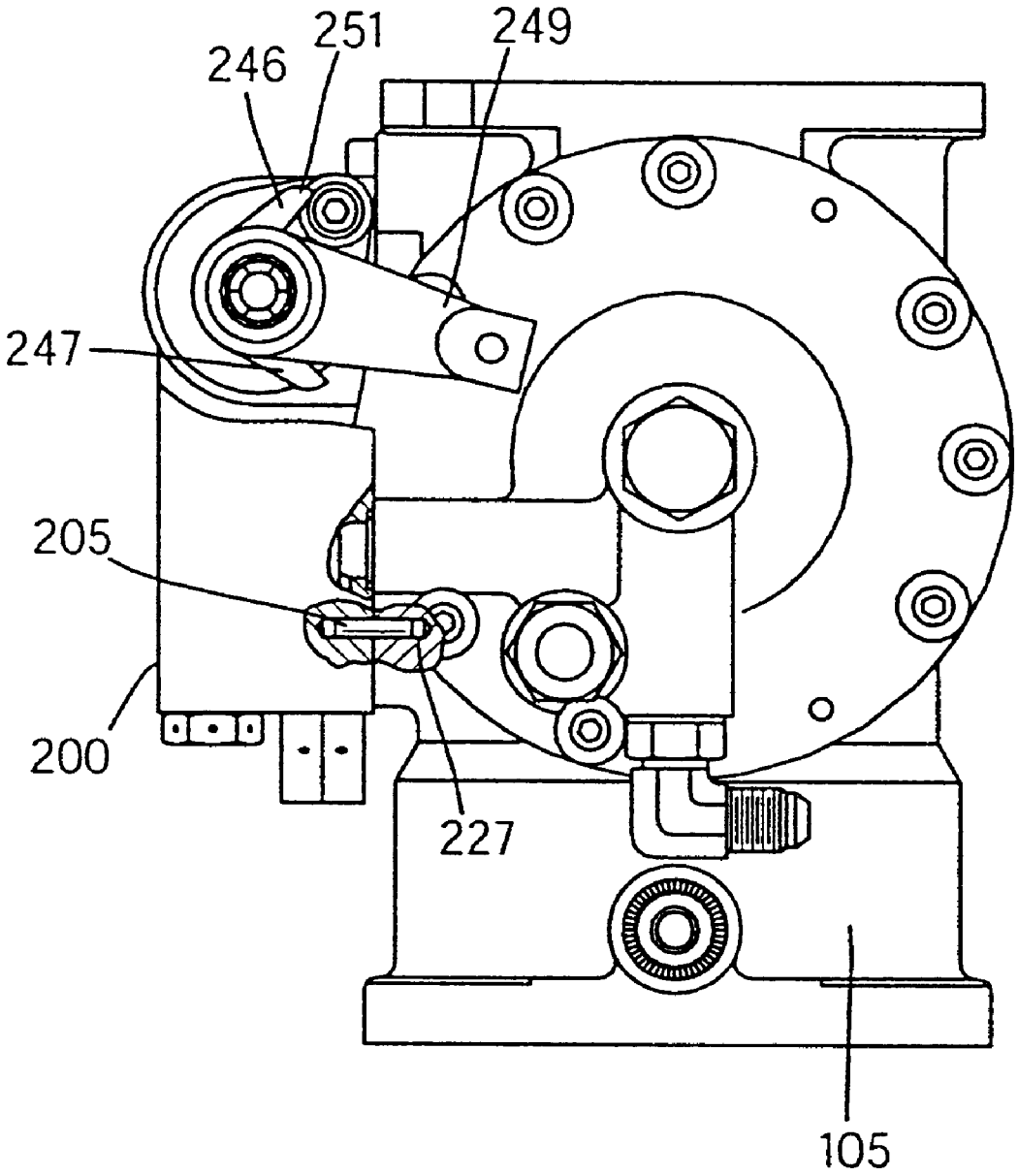
FIG. 22 is a side view of the fuel injection servo of an embodiment of the present invention.
Figure 23:
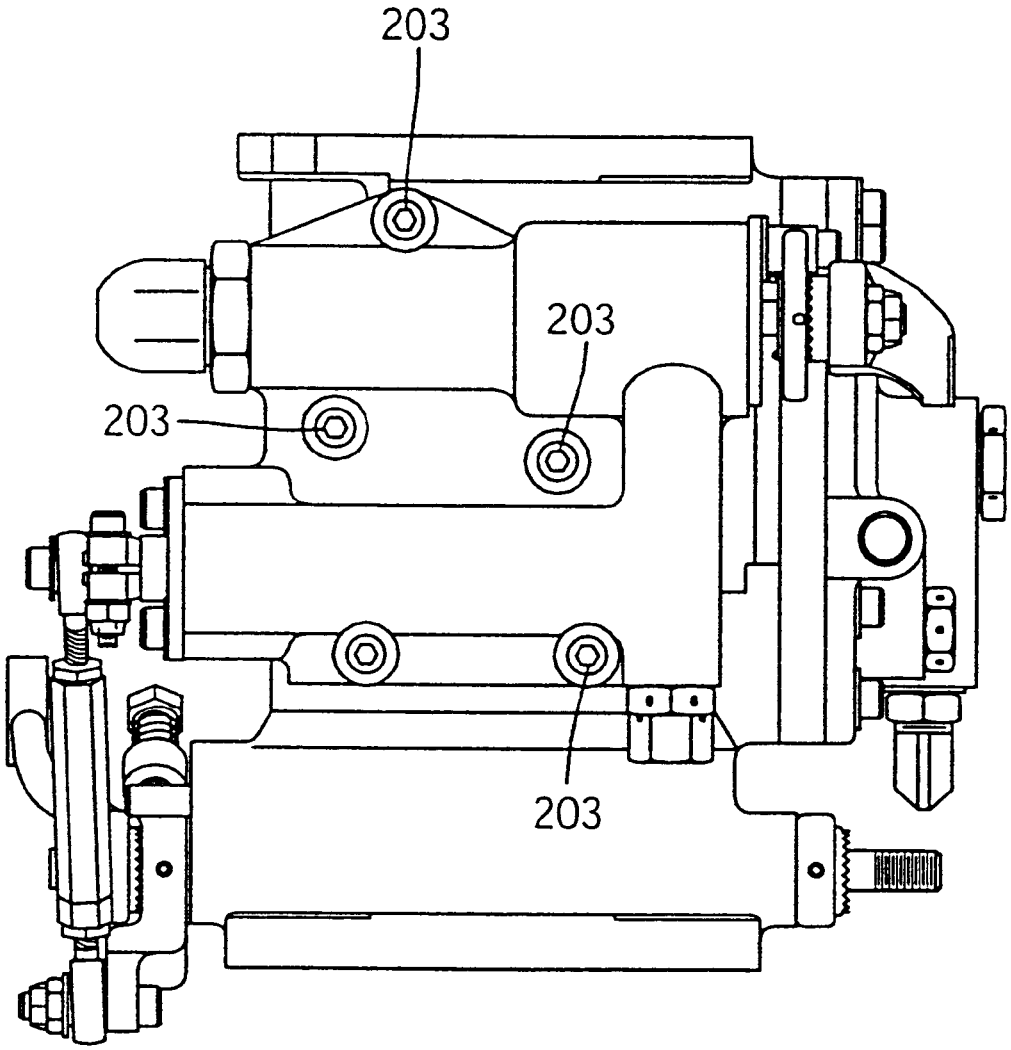
FIG. 23 is a view facing the valve body assembly of the fuel injection servo of an embodiment of the present invention.
Figure 24:
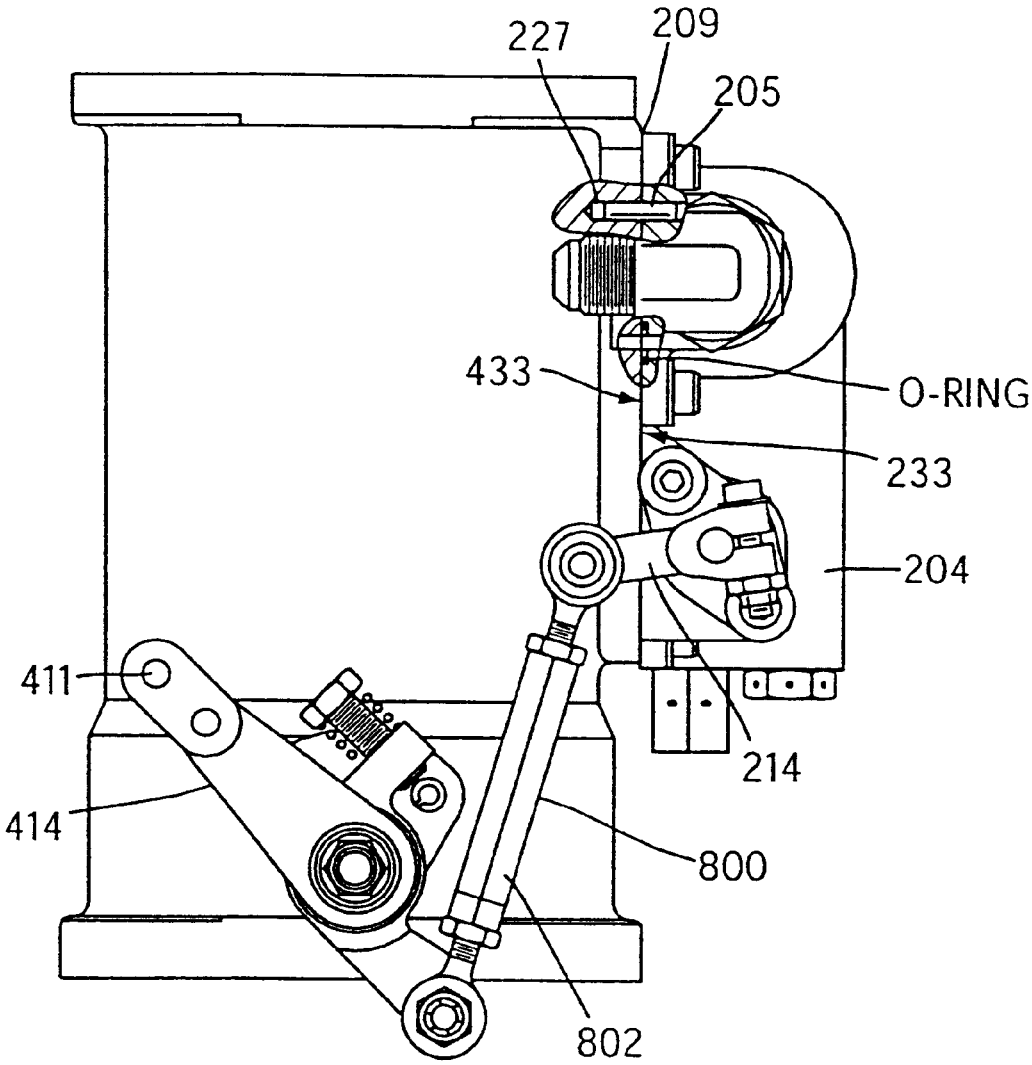
FIG. 24 is a view facing the idle link assembly of the fuel injection servo of an embodiment of the present invention.

A schematic of the valve body assembly 200 is shown in FIG. 10A, which shows the internal fuel passages thereof. Valve body assembly 200 is shown separately in FIGS. 21A and 21B, and its assemblage with the fuel injection apparatus 100 is shown in FIGS. 22–24. Generally, the valve body assembly 200 (i.e., the modular fuel pressure modifying mechanism) is constructed and arranged to receive fuel from the fuel supply and deliver the fuel at a pressure that is different from the fuel supply to the fuel regulator assembly 300 (i.e., the modular fuel regulator mechanism). The major components of valve body section 200 include an idle valve assembly 210 and a manual mixture control valve assembly 240. Idle valve assembly 210, which is shown separately in FIGS. 21B-D, includes an idle valve 212, which is interconnected to the throttle linkage via an idle valve lever 214. Idle valve 212 is of a barrel design, i.e. it has a hollow, cylindrical shape, and sits, in a rotationally sliding relation, within a bore 219 formed in valve body 204. Valve 212 has an opening 216 at an intermediate portion thereof. This opening 216 is essentially a notch cut approximately half way into the side of valve 212. Opening 216 communicates with channel 318 of regulator assembly 300 for delivering metered fuel to the regulator. At one end of opening 216 is a stepped slot 218. Idle valve 212 effectively reduces the area of main metering jet 220 for accurate metering of the fuel in the engine idle range, as will be described below. Idle valve assembly 210 also includes an idle valve cover 213, a thrust washer 215, an idle lever spacer 217, and an o-ring 216, shown in FIGS. 21A-D.

Shown in FIG. 10A, the fuel path (i.e., the fuel circuit) from fuel inlet 202 to regulator assembly 300 is as follows. Unmetered fuel from the engine fuel pump enters the valve body at fuel inlet 202 and passes through an inlet screen tube 232 of an inlet filter assembly 230. The fuel is then vented to an unmetered fuel side, which proceeds to the unmetered side 312 of fuel diaphragm 320 via channel 316, and a metered fuel side, which passes through the main metering jet 220. The main metering jet 220 is essentially an externally threaded nut formed with a through channel having a constricted throat section 221. Main metering jet 220 is a screw in part and is easy to access, via the removal of hexhead bolt 223, and can be removed and replaced very efficiently. Thread section 221 of jet 220 is fabricated utilizing standard drill sizes which provide a wide range of fuel flow in incremental steps. Thus, main metering jet 220 is easy to manufacture while maintaining precise control of fuel flow limits. Passage of the fuel from one side of metering jet 220 to the other side through the constricted throat section 221 causes a pressure drop in the fuel. This lower pressure fuel, i.e. metered fuel, flows through idle valve 212 and its opening 216 and into the metered fuel chamber 314 via channel 318.

At low engine speed, i.e., the pilot has set the throttle to be very low, idle lever 214 rotates idle valve 212 so that opening 216, which created a flow path into channel 318, faces an interior wall of bore 219. This action permits fuel flow through only stepped slot 218, which remains in line with channel 318. At higher engine speeds, i.e., the pilot opens the throttle, idle lever 214 causes rotation of idle valve 212 such that opening 216 again faces channel 318, and thus the metered fuel regulation automatically switches back to regulator assembly 300. This manual control of the idle mixture is necessary because with very low air flow through the venturi in the idle range, the air metering force is not sufficient to accurately control fuel flow.

An advantage of the barrel-shaped idle valve 212 is that it is easy to manufacture. For instance, the idle valve and the idle valve bore are easily machined with tight tolerances. Thus, matching of each is not required. That is, for example, the idle valve diameter does not have to be machined to a specific diameter determined by the idle valve bore, or vise versa. Rather, each is machined according to predetermined specifications accurately. Thus, the idle valve can be machined and assembled into any valve body assembly 200. Also, the barrel shaped design is less susceptible to scoring which can lead to unpredictable idle and off-idle engine performance.

The fuel circuit of the valve body assembly 200 of the embodiment shown in FIG. 10A also includes an adjustable jet assembly 270 that is constructed and arranged in parallel with main metering jet 220. Adjustable jet assembly 270 comprises an adjustable jet body 272, an adjustable jet valve 274, a snap ring 276, a detent spring 278, and a ball bearing 280. Adjustable jet assembly 270 operates in parallel with main metering jet 220, or circuit, and provides adjustment of the fuel mixture at high power settings. That is, when adjustable jet valve 274 is opened, some fuel is diverted to channel 279 in parallel with main metering jet 220, passes through the adjustable jet valve, and is reunited with the fuel that passes through the main metering jet—the metered fuel—via a hole (not shown) in adjustable jet body 272 that allows the fuel to pass into idle valve 212. Adjustable jet valve 274 thus allows for "tweaking" of top end fuel flow on the aircraft. Although shown with an adjustable jet flow path, the adjustable jet flow path and thus the adjustable jet assembly are optional.

The other main component of valve body assembly 200 is the manual mixture control assembly, generally designated as reference numeral 240. The manual mixture control assembly includes a manual mixture valve 242, which sits within bore 243 formed within the valve body. Manual mixture valve 242 has formed therein channels 244, 246 which allows, when orientated as such, fuel to pass from inlet filter assembly 230 and into the unmetered and metered flow paths, respectively. A series of O-rings 247, 248, 250 prevents seepage of fuel around the manual mixture valve to properly direct the fuel into channel 244. Channel 244 first runs longitudinally of manual mixture valve 242 delivering fuel to an annular portion. This annual portion directs fuel into channel 316, thus delivering unmetered fuel to the regulator assembly. Channel 246, positioned 180 degrees from channel 244, first runs longitudinally, delivering unmetered fuel from inlet filter assembly 230 to a second annular portion of manual mixture control valve 242, which in turn directs the fuel to main metering jet 220.

When the aircraft is at high altitudes such that the density of the air is appreciably reduced, the fuel regulator may supply too much fuel for a given power setting because, although the regulator causes to the ball valve to open up to according to a differential pressure drop created by the venturi, the air density at such altitudes is decreased, thus, the engine cylinder will be supplied with too much fuel. That is, it will run rich. In this situation, the pilot may use manual mixture control valve 240 to manually reduce fuel flow.

As seen in FIG. 22, the manual mixture control valve 242 is operated by a mixture lever 249, which is mounted to a jagged-toothed surface 245 of a boomerang-shaped stop bracket 251. Two wings 246, 947 of bracket 251 are limiting points of rotation, so that manual mixture control valve 242 produces a full rich condition when mixture lever 249 is against wing 246, i.e., the rich stop position, and a progressively leaner mixture as lever 249 is moved toward wing 247, i.e., the idle cutoff position. Mixture lever 249 is caused to rotate by a cable (not shown) that is connected to the free end of the lever. The cable runs to the cockpit of the airplane and is connected to a pilot control mechanism (not shown), as is known in the art. By rotating manual mixture valve 242 to cut off, the size of the metering jet is effectively reduced. This allows the pilot the option to manually lean the mixture for the best cruise power or the best specific fuel consumption. It also provides the means to shut off fuel flow to the engine at engine shut down.

Valve body 204 is fixedly connected to throttle body 402 with a plurality of bolts 203 and corresponding through holes 203a. The throttle body assembly 400 comprises a first surface portion 433 formed on the outer surface of the throttle body 403 (i.e., the main body of the throttle body assembly) and the valve body 204 comprises a second surface portion 233 formed thereon (FIG. 24). The second surface portion 233 is adapted to interface with the first surface portion 433 when the valve body assembly is removably mounted onto the throttle body assembly 400. In an exemplary embodiment, the first and second surface portions 433, 233 are mating planar surfaces. To accurately position valve body assembly 200 onto throttle body 402, a plurality of dowel pins 205 are rigidly fixed into corresponding dowel pin holes 227 formed in the throttle body, shown in FIGS. 22 and 24. The contact, mating surfaces on the throttle body and the valve body are machined with a low surface roughness and a high degree of flatness to ensure maximum contact between the two surfaces at the interface 209. Although shown to be in direct contact, a spacer or gasket device may be sandwiched between the first surface portion 433 and second surface portion 233.

Figure 10C:
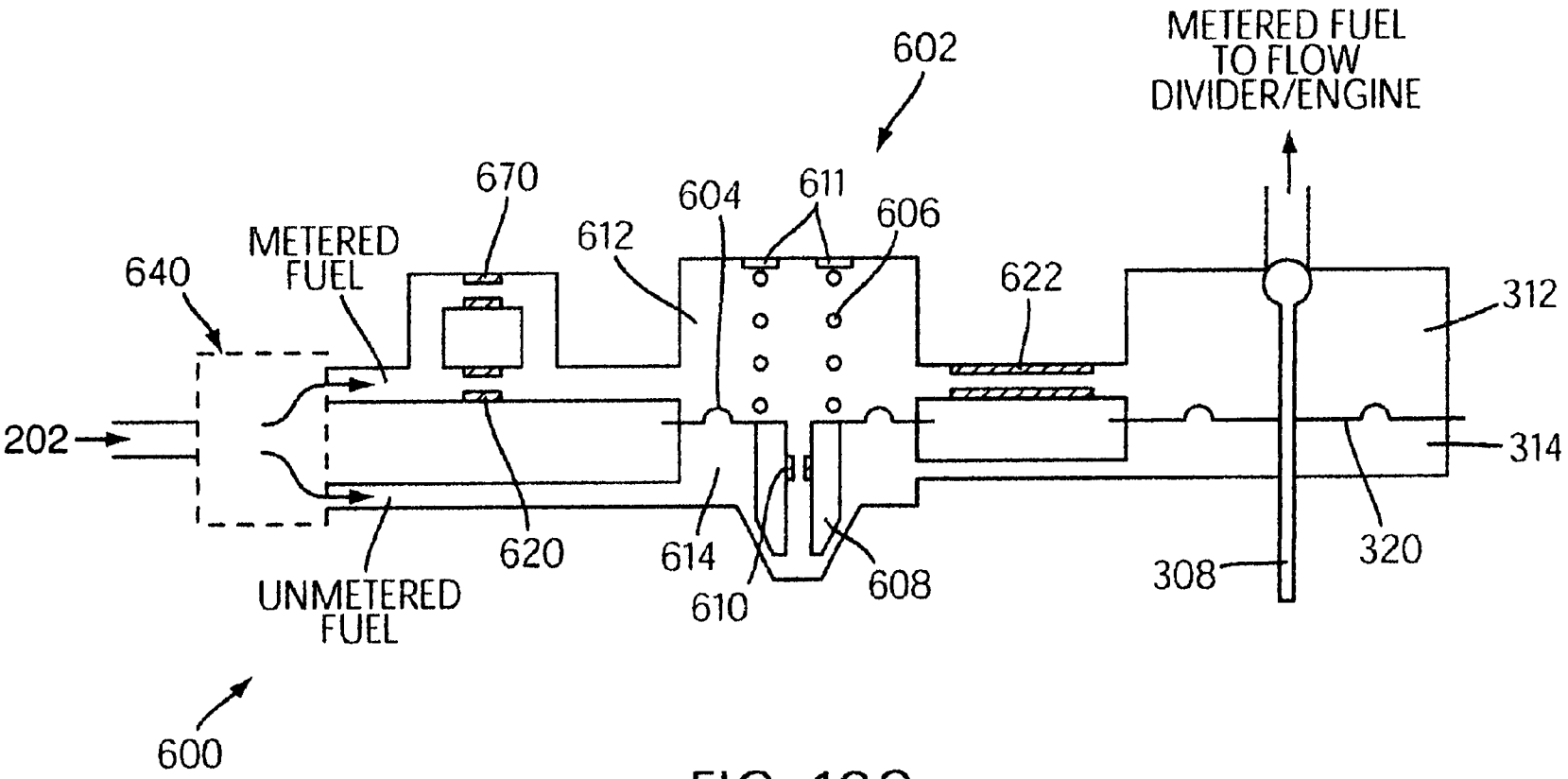
FIG. 10C is a schematic diagram of a second embodiment of a valve body assembly, where the valve body includes an enrichment circuit.

A second embodiment of a valve body assembly 600 is shown schematically in FIG. 10C, which includes an enrichment system 602 in the fuel flow path. Enrichment system 602 includes an enrichment valve diaphragm 604, a spring 606, an enrichment valve jet 610, and an enrichment valve 608. In this embodiment of valve body assembly 600, the fuel path is as follows. After the inlet fuel 202 passes through an optional inlet filter assembly (not shown)(which includes an inlet screen tube), the fuel is split into an unmetered and metered path by a manual mixture control assembly 640 (as described earlier in FIG. 10A). The metered path includes, as before, a main jet 620 and an adjustable jet assembly 670 in parallel with main jet 620. Main jet 620 and adjustable jet 670 operate as described with respect to the embodiment shown in FIG. 10A. Although shown with an adjustable jet flow path, the adjustable jet flow path, and thus the adjustable jet assembly, are optional. The metered fuel and unmetered fuel then enter opposite sides of an enrichment valve diaphragm 604 of enrichment system 602. The enrichment valve 608 is operated by diaphragm 604 that is vented to the unmetered fuel by enrichment valve jet 610. When the pressure differential applied across the diaphragm creates a force greater than the enrichment valve spring force, the valve opens to allow unmetered fuel to pass through enrichment valve jet 610 and through diaphragm 604. Allowing the fuel to flow through chamber 612 and chamber 614 eliminates static chambers, which trap air or require bleed circuits to eliminate the air in the fuel chambers 612, 614 around enrichment valve 608 and enrichment valve diaphragm 604, respectively. The opening point of the valve can be adjusted to a predetermined point by increasing or decreasing the tension on the enrichment valve spring by removing and adding shims 611. Enrichment valve jet 610, which can vary in size, controls the amount of fuel enrichment when the valve is open. The metered fuel then passes through a barrel, idle valve 622 and is delivered to metered fuel side 312 of the fuel regulator, and the unmetered fuel is delivered to unmetered fuel side 314. The enrichment system 602 increases the fuel/air mixture strength to provide for "fuel cooling" of the engine in the high power range. Although this increases fuel consumption, it also increases engine life. The enrichment system 602 can also be used to compensate for fuel/air ratio changes due to chances in air density.

Figure 10D:
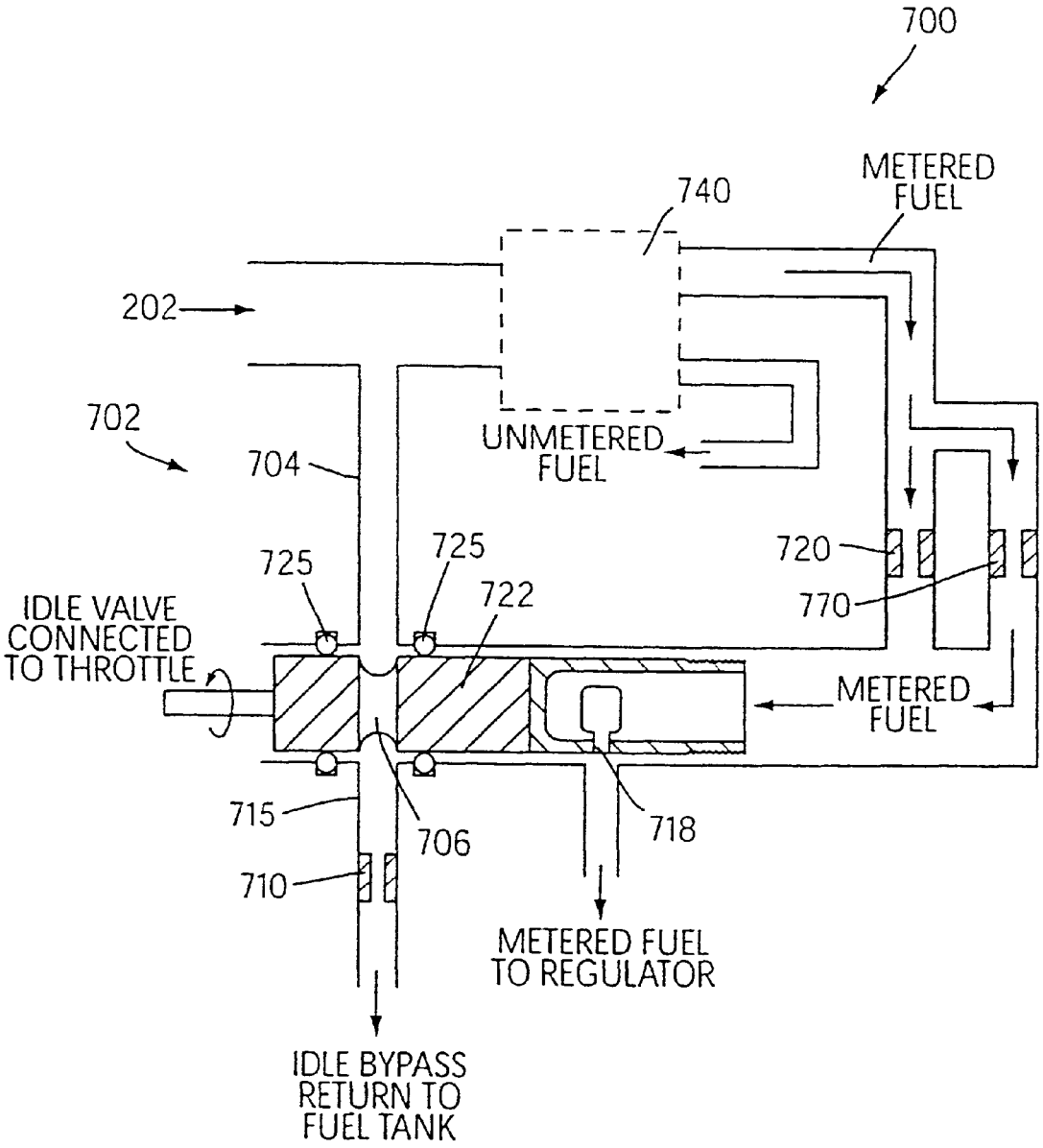
FIG. 10D is a schematic diagram of a third embodiment of a valve body assembly, where the valve body includes a bypass circuit.

A third embodiment of a valve body assembly 700 is shown schematically in FIG. 10D, which includes a bypass circuit 702 in the fuel flow path. A main function of bypass circuit 702 is to reduce the propensity of vapor formation in the fuel pump and fuel system, which in turn reduces the likelihood of vapor locking. As is known in the art, vapor lock is where fuel in the fuel lines evaporates to vapor instead of maintaining a liquid form, and which is aggravated by elevated fuel temperatures or low inlet fuel pressure to the engine driven pump. If the vapor forms faster that the pump can draw it from the fuel line, because vapor is difficult to pump, the flow of fuel to the fuel injector servo, and thus the engine, is effectively stopped and the engine stalls or is prevented from being started. Also, before locking, the vapor will be passed on into the fuel regulator assembly 300, which causes the fuel injection servo 100 to meter flow incorrectly. With a given fuel (i.e., Reid vapor pressure number), vapor formation can be minimized by reducing heat in the fuel system, increasing fuel-system pressure, and eliminating sudden changes in cross section or direction of fuel lines. Idle bypass circuit 702 helps prevent vapor locking by enabling more fuel to flow than otherwise would at engine-idle speeds and prior to engine start, thus cooling the fuel injection system components (i.e., the fuel injection servo, flow divider, etc.) and reducing the fuel temperature, and purging the system of vapor.

Referring to FIG. 10D, idle bypass circuit 702 comprises an idle bypass port 706 incorporated into an idle valve 722, an idle bypass jet 710, and an idle bypass channel 704. In this embodiment of the valve body assembly, the fuel path is as follows. After the inlet fuel 202 passes through an optional inlet filter assembly (not shown)(which includes an inlet screen tube), the fuel is split into an unmetered and metered path by a manual mixture control assembly 740 (as described in FIG. 10A). The metered path includes, as with the prior valve body embodiments, a main jet 720 and an adjustable jet assembly 770 in parallel with the main jet. The metered fuel then passes through a barrel-shaped idle valve 722 and is delivered to metered fuel side 312 of the fuel regulator assembly 200, and the unmetered fuel is delivered to unmetered fuel side 314 (both seen in FIG. 9). Although shown with an adjustable jet flow path, the adjustable jet flow path and thus the adjustable jet assembly 770 are optional.

The idle bypass circuit 702 comes into operation at engine idle speeds. When idle valve 722 is closed (at idle) the idle bypass port 706 communicates with idle bypass channel 704, and thus some of the unmetered fuel from fuel inlet 202 bypasses the remainder of the fuel circuit (i.e., the manual mixture control assembly, the main jet and the adjustable jet) and is directed back to the fuel supply, such as the fuel tank. An idle bypass jet 710 in a return channel 715 controls the amount of fuel return when the idle valve is in the idle position. Although shown within return channel 715, the idle bypass jet 710 can also be positioned within bypass channel 704 between the fuel inlet 202 and the idle valve 722. Idle bypass jet 710 is sized for a specific application, i.e., a fuel pump size. A set of o-ring, seals 725 are positioned on opposite sides of idle bypass port 706 to prevent the bypassed fuel from seeping into the metered fuel path and from exiting the valve body assembly. At idle speeds, where the fuel flow is low, idle bypass circuit 702 increases the fuel flow from the engine driven pump. This increased fuel flow purges and cools the fuel pump and other fuel system components (i.e., the fuel injection servo and associated hardware and fuel system components upstream of the fuel pump), thus reducing the propensity for vapor formation in the fuel pump and the fuel system. Additionally, before the engine starts, the fuel pump is activated and fuel flows through idle bypass circuit 702. Thus, the fuel system and associated hardware, including the fuel injection servo, are cooled and purged before the engine starts. This property greatly reduces hot start problems, because hot fuel and vapor are purged from the fuel injection system prior to engine start. When the throttle is opened, idle valve 722 rotates and closes idle bypass port 706. At high engine speeds, the higher fuel flow requirements reduce the propensity for vapor formation, and thus fuel flow through the idle bypass circuit is not needed. This also keeps the engine driven fuel pump capacity requirements at high output to a minimum.

The Throttle Body Assembly 400

Figure 25:
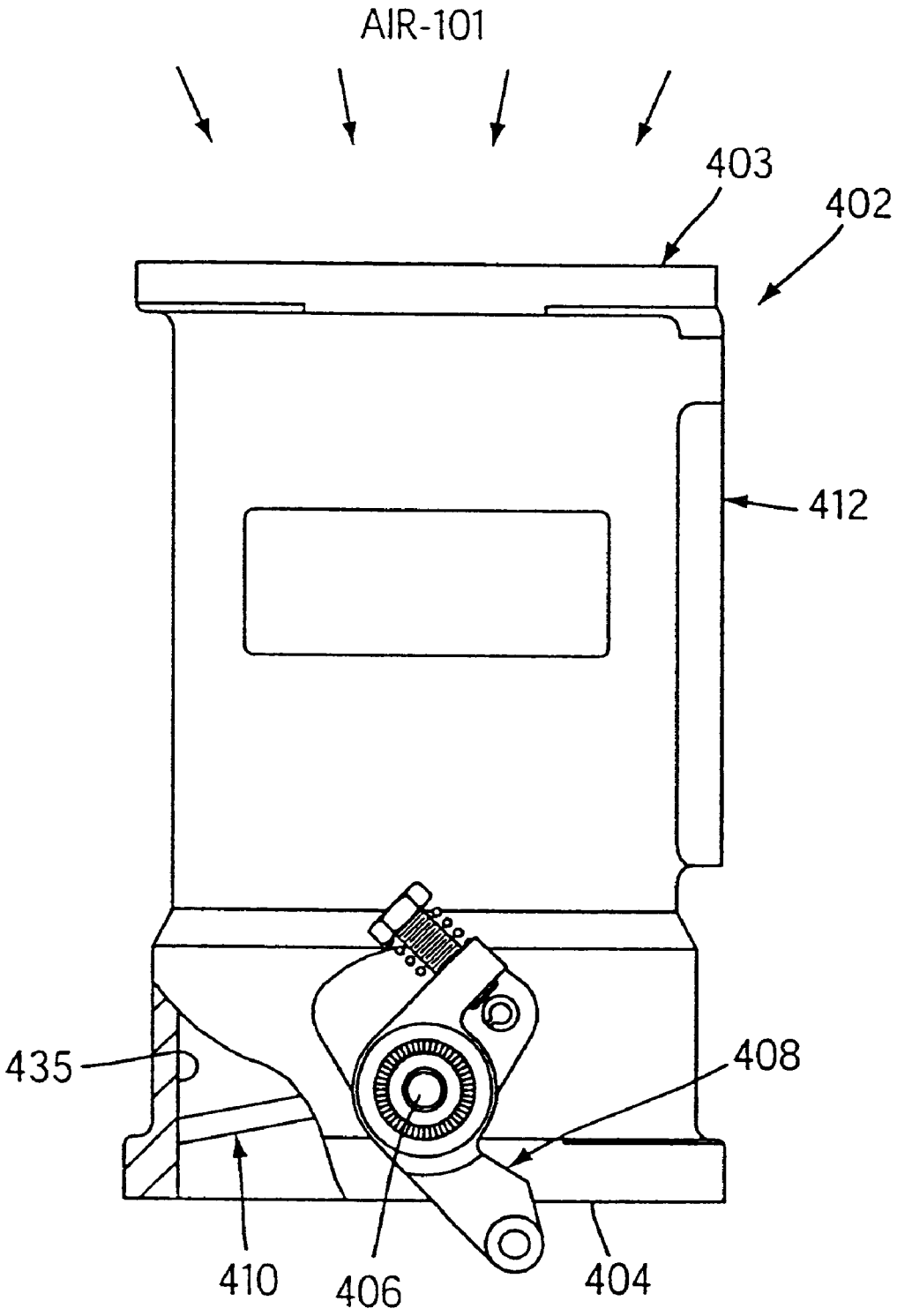
FIG. 25 is a view facing the idle link assembly of the throttle body assembly of an embodiment of the present invention, without the valve body or regulator assembly attached thereto.
Figure 26:
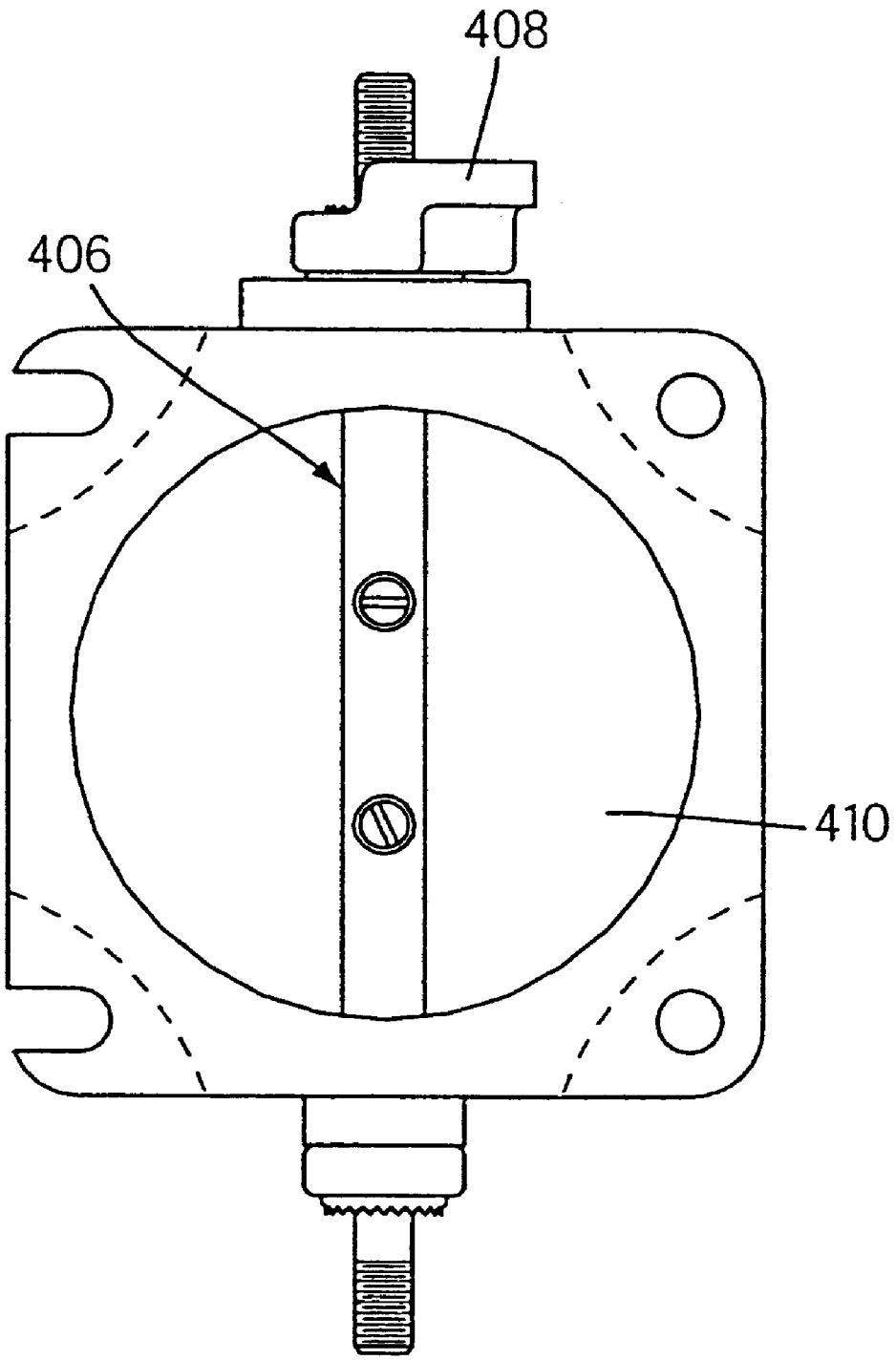
FIG. 26 is a bottom view of the throttle body assembly of an embodiment of the present invention.
Figure 27:
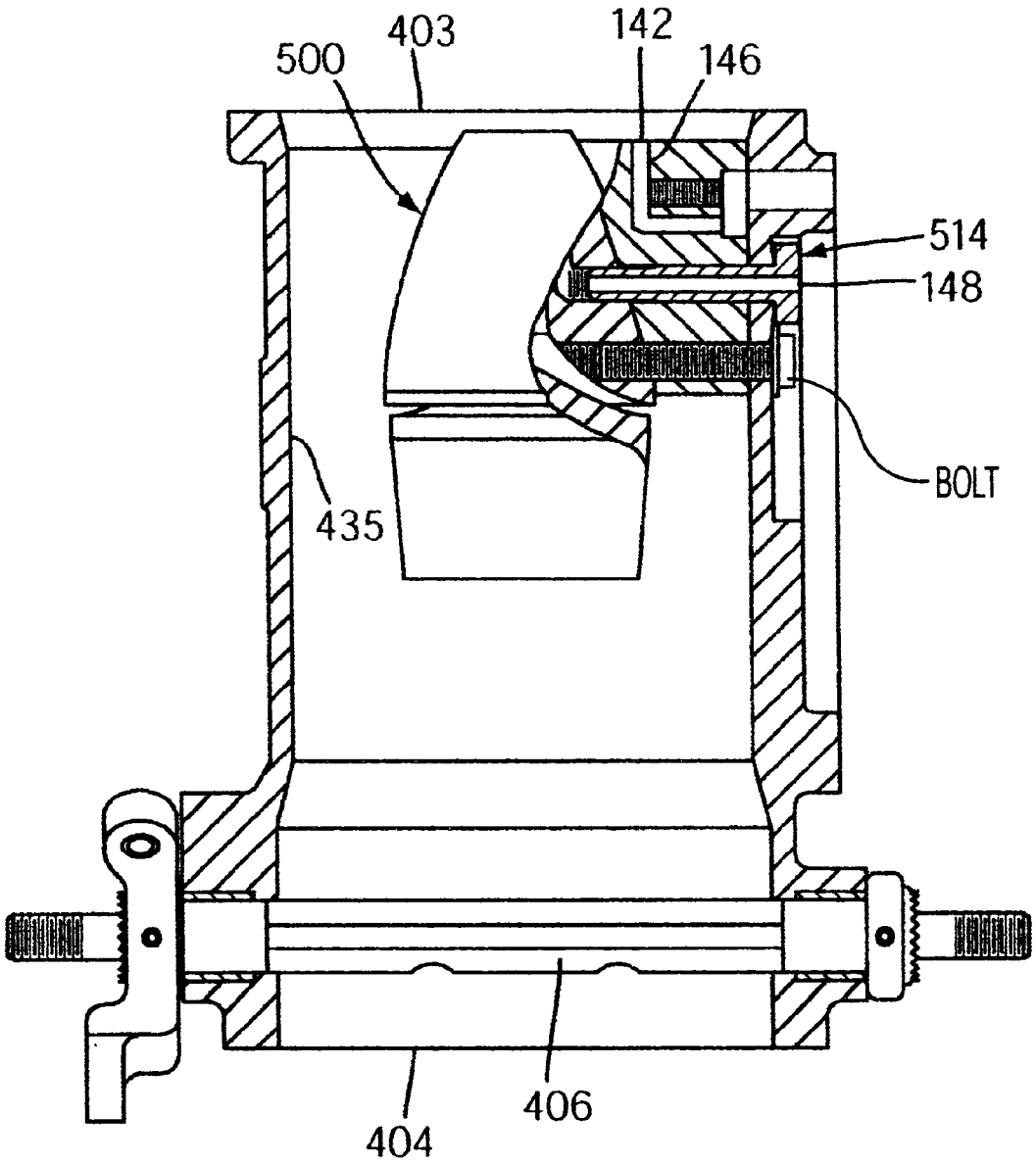
FIG. 27 is a cross-sectional view of the throttle body and the venturi assembly used in the fuel injection servo of an embodiment of the present invention.

Throttle body assembly 400 is shown in FIGS. 25–27. As briefly mentioned earlier, the throttle body assembly comprises, among other things, throttle body 402, throttle plate 410, a throttle stop lever 408, and venturi assembly 500. Throttle body 402 is essentially the main body section of the fuel injection servo, the outer surface of which has attached thereto valve body assembly 200 and fuel regulator assembly 300. To facilitate the attachment of valve body assembly 200, a first surface 412 is machined at an outside portion of the throttle body. This first surface 412 interfaces with the corresponding mating surface on modular valve body assembly 200, and the two surfaces are machined to have a surface finish and flatness that maximizes surface contact of the two mating surfaces. Throttle body 402 has an open-ended, barrel shape, the two ends of which define air intake opening 403 and air outlet end 404. During operation, air 101 enters throttle body 402 at air intake opening 403 and flows through throttle body barrel 435.

The pilot (or automated power control user) controls the amount of air that flows through the throttle body barrel by actuation of throttle lever 414, shown in FIG. 24, which is mounted on a throttle shaft 406 and which is interconnected to a throttle control (not shown) that the pilot operates from within the cockpit. Throttle shaft 406 extends through throttle body 402, and throttle plate 410 is fixedly mounted thereto within throttle body barrel 435. Throttle lever 414 is actuated by a cable (not shown) attached to the free end 411 thereof. When more power is desired, i.e., more fuel, the pilot opens the throttle causing rotation of throttle lever 414, which in turn rotates throttle plate 410. Throttle plate 410 determines, by its rotated position with respect to throttle body barrel 435, the amount of airflow that passes through the barrel.

A throttle stop lever 408 (FIG. 25) is interconnected to idle lever 214 via an idle link assembly 800, as shown in FIG. 24. When throttle lever 414 is actuated by the pilot, which causes rotation of throttle shaft 406, idle link assembly 800 causes idle lever 214 to rotate, which in turn rotates idle valve 212 in valve body assembly 200. The idle link assembly comprises an adjustable length linkage 802 that is used to adjust the idle fuel mixture. When the linkage is adjusted to be lengthened, a richer idle mixture is provided. When adjusted to be shortened, a leaner idle mixture is provided.

Figure 28:
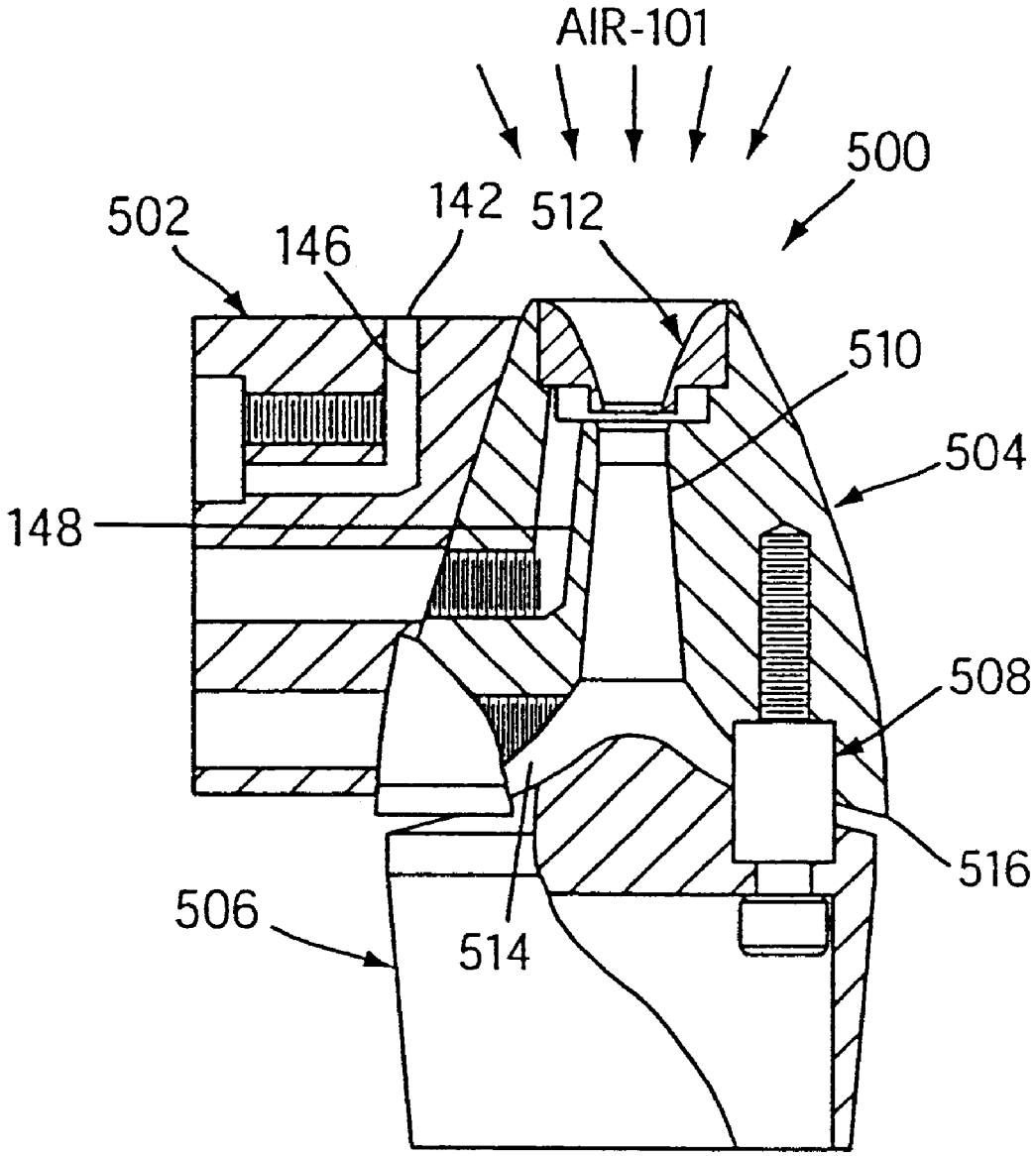
FIG. 28 is a cross-sectional view of the venturi assembly used in the fuel injection system of an embodiment of the present invention.

Changes in the airflow, as directed by the pilot, are communicated to fuel regulator assembly 300, as described earlier, which regulates the amount of metered fuel that is delivered to the engine. The amount of airflow is communicated to the regulator assembly by way of a pressure differential created as the air flows around and through the venturi 500, which is mounted within barrel 435, shown in FIG. 27 and schematically in FIG. 9. Venturi 500 is shown separately in FIG. 28. As briefly mentioned earlier, venturi 500 of the exemplary embodiment disclosed is a compound venturi. That is, air flows both around and through the venturi, and the air that flows around the venturi influences the pressure of the air that flows through the venturi, as is known in the art. Specifically, as shown in FIG. 28, venturi 500 comprises of an approach section 504 and a recovery section 506 that are separated by three spacers 508. The venturi is connected to throttle body barrel 435 using a narrow, streamlined strut 502. Approach section 504 includes a through channel 510 constructed and arranged for air to flow through. The inlet of channel 510 is nozzle shaped, thus, as air enters the venturi, its velocity increases causing a drop in the air pressure. Thus, the inlet of channel 510 is referred to as a boost venturi 512. The air flowing through the venturi exits via the annular space 514 between the approach and recovery sections. The air that flows over the approach section causes a pressure drop at the end 516 of the approach section 504. This pressure drop is communicated to boost venturi 512 via channel 510, which in turn increases the pressure drop created by boost venturi 512. The pressure created by boost venturi 512, designated P(suction), is communicated to venturi suction side 306 of regulator assembly 300 via channel 148. Channel 148 runs from boost venturi 512, through approach section 504, and through the center of a bolt 518 used to attach venturi 500 to throttle body 402. Bolt 518 passes through strut 502 and screws into threads formed in approach section 504, as shown in FIG. 27. Ambient air impact pressure, i.e., air that has not been influenced by the venturi, is communicated to impact air side 304 of regulator assembly 300 via channel 146 formed within strut 502. Impact air enters this channel 146 at an air impact port 142.

Venturi 500 of the embodiment disclosed is a bullet-type venturi. All components of the venturi are machined from billet material, which produces a venturi with consistent dimensional and surface finish characteristics which in turn results in very consistent venturi performance. This consistent venturi performance, which is characterized below, provides consistent throttle body performance, which in turn enables modularity of the entire fuel injection apparatus because neither the valve body assembly 200 nor the fuel regulator assembly 300 need to be customized (i.e., calibrated) for a particular throttle body. Additionally, the features of venturi 500, such as boost venturi 512, strut 502 configuration, approach section 504 and recovery section 506, constructed according to the exemplary embodiment described above combine to provide a large pressure signal to regulator assembly 300. That is, for a given amount of airflow, venturi 500 provides a larger signal to the fuel regulator assembly 300 without decreasing or restricting airflow to the engine. A larger pressure signal from the venturi provides more force in the fuel regulator assembly 300 which improves the overall fuel metering resolution.

Figure 29:
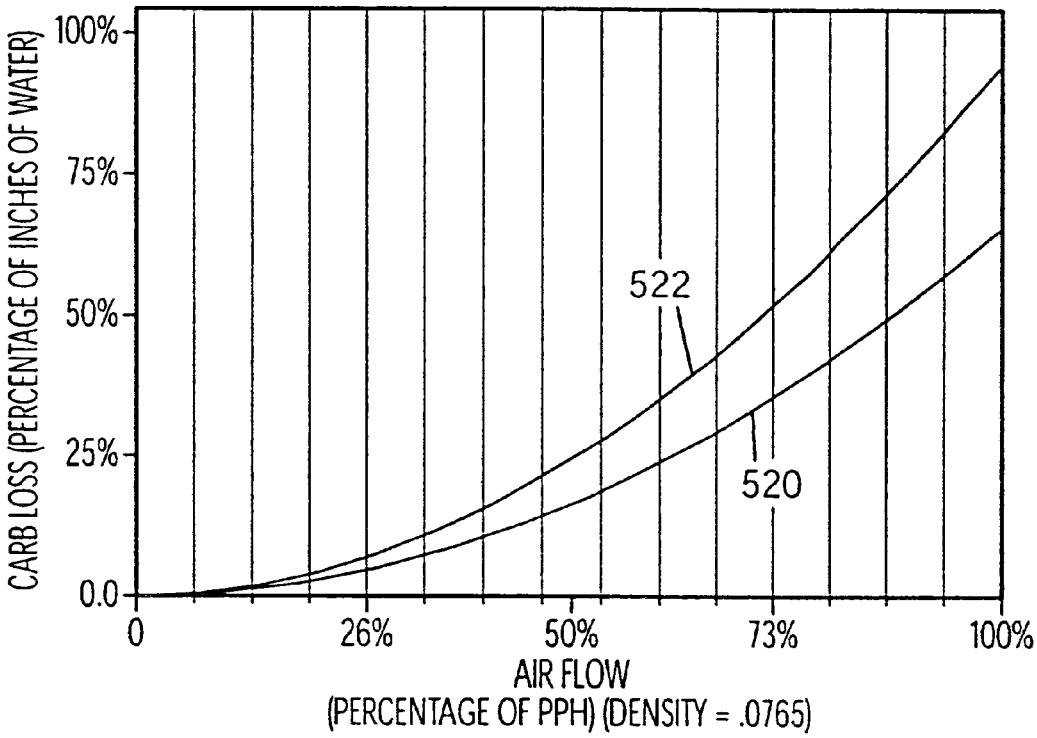
FIG. 29 is a graph of carb loss vs. air flow produced by the venturi assembly used in the fuel injection servo of an embodiment of the present invention and of the prior art.
Figure 30:
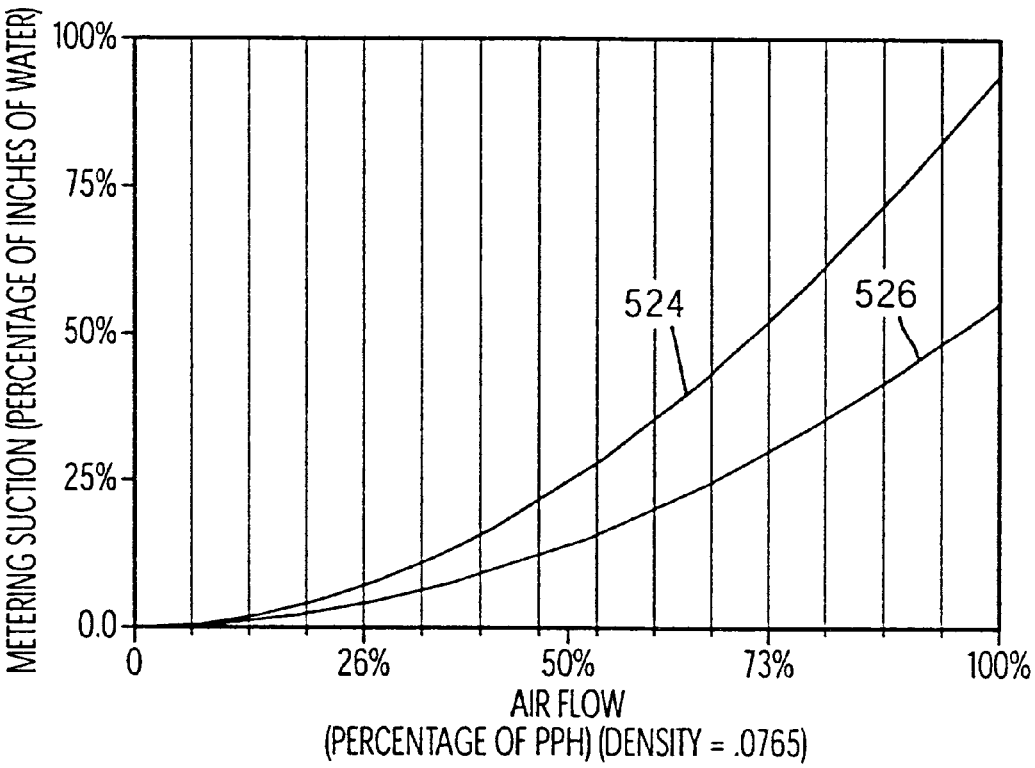
FIG. 30 is a graph of metering suction vs. air flow produced by the venturi assembly used in the fuel injection servo of an embodiment of the present invention and of the prior art.
Figure 31:
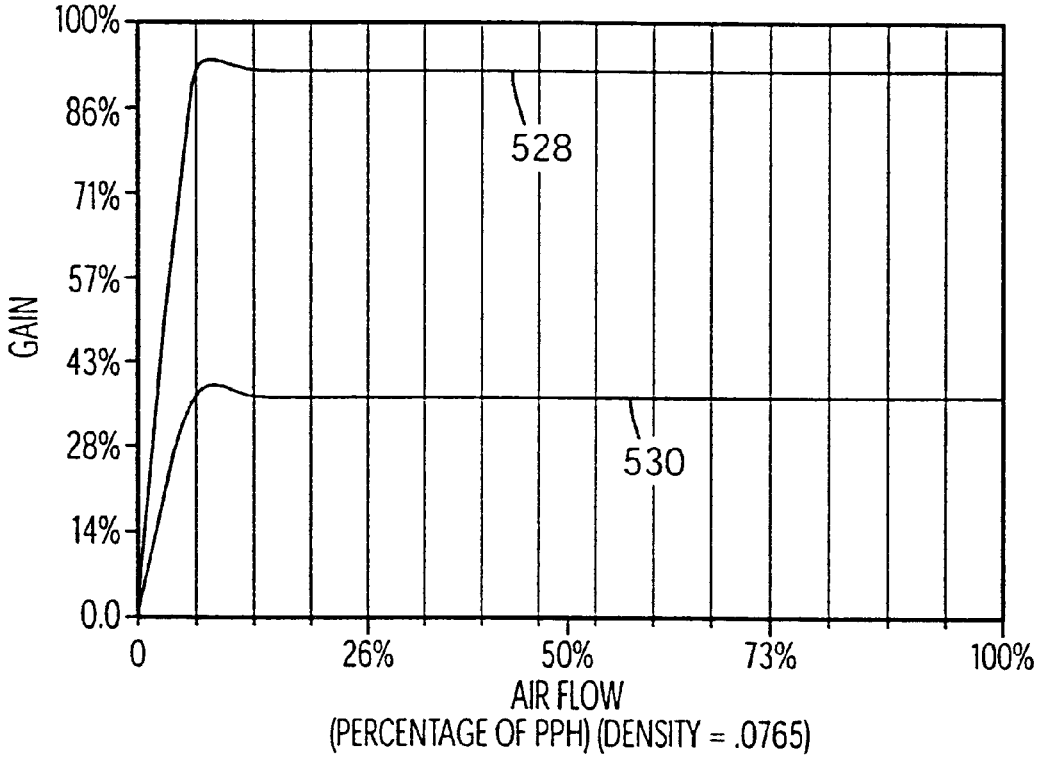
FIG. 31 is a graph of gain vs. air flow produced by the venturi assembly used in the fuel injection servo of an embodiment of the present invention and of the prior art.

These improved characteristics of venturi assembly 500 are shown graphically in FIGS. 29–31. FIG. 29 compares the amount of "carb loss" versus the amount of air flow for venturi 500, designated as numeral 520, of the embodiment disclosed and that of a conventional venturi, designated as number 522. The carb loss is shown graphically as a normalized percentage of inches of water, and the air flow in FIG. 29–31 is shown graphically as a normalized percentage of PPH, and the density of the air is 0.0765 lb/cu-ft. As the engine speed of the aircraft increases, the air flow increases. The "carb loss" is the pressure loss between inlet opening 403 and outlet discharge 404 of the throttle body, and a higher carb loss indicates a greater restriction in the airflow path to the engine. As seen if FIG. 29, venturi 500 of the embodiment disclosed has a lower carb loss for a given air flow as compared to a conventional venturi.

FIG. 30 compares the metering suction pressure generated versus the amount of air flow for venturi 500, designated by numeral 524, to that of a conventional venturi, designated as numeral 526. The metering suction, shown graphically as a normalized percentage of inches of water, is the pressure created by boost venturi 512. The metering suction differential, i.e., the difference between the metering suction pressure and the ambient air impact pressure, is the signal generated by the venturi that is communicated to the air diaphragm inside regulator assembly 300. As seen in FIG. 30, venturi 500 of the disclosed embodiment produces a larger metering suction pressure for a given air flow. This translates into a larger "gain" that is communicated to regulator assembly 300.

FIG. 31 is a comparison of "gain" versus air flow for venturi 500, designated by numeral 528, and that of a conventional venturi, designated as numeral 530. The "gain," shown graphically as a normalized percentage, is the signal generated by the venturi (i.e., the metering suction differential) and communicated to the regulator assembly 300 divided by the pressure drop across the throttle body as the air flows therethrough, as indicated by curve 520 in FIG. 29. As seen in FIG. 31, venturi 500 of the embodiment disclosed produces a gain that is approximately 2.5 times greater than that of a conventional venturi.

These above venturi performance characteristics combine to provide more force acting on both the air and fuel diaphragms in regulator assembly 300. These increased forces in turn produce a fuel injection servo 100 that is less sensitive to fluctuations in fuel supply pressure, especially near engine idle speeds. For example, when the engine is running near idle speed, the fuel supply pressure is lower than at higher engine speeds. In a conventional fuel injection servo, the force on the air diaphragm is also relatively low because the venturi gain, or signal, is also relatively low. Likewise, since the air diaphragm force is balanced by the fuel diaphragm force, as described earlier, the forces on the air and fuel diaphragms are relatively low at engine idle speed. For illustrative purposes only, this force is designated as 2 lbs. Under normal conditions, the fuel supply pressure will also fluctuate slightly at engine idle speed. For illustrative purposes only, the fluctuation in fuel supply pressure is designated to produce a force of 1 lb. on the fuel diaphragm. This fluctuation in the fuel supply cause the fuel diaphragm to pulsate as well, and since the magnitude of the force generated by the fluctuation in the fuel supply is, for example, significant relative to the forces on the air and fuel diaphragms at engine idle speed, the fluctuation causes pulsation in the metered fuel that is delivered to the engine. Thus, at low engine speeds, the engine is susceptible to running rough.

With the improved venturi performance of the present embodiment, the forces imposed upon the air and fuel diaphragms at engine idle speed are greater than that in the conventional fuel injection system. For illustrative purposes only, the force on the air and fuel diaphragms at engine idle speed is designated to be 5 lbs. Thus, the fuel supply pressure fluctuations, which remain the same at 1 lb (as above), become a smaller percentage of the air and fuel diaphragm force and, therefore, the fuel supplied to the engine contains less pulsation at engine idle speed. As a result, the fuel injection system of the embodiment disclosed is less sensitive to fuel supply pressure fluctuations at engine idle speed and, consequently, the engine runs more smoothly, even at engine idle.

The numeric forces used in the above explanation and elsewhere throughout the disclosure are for illustrative purposes only and are not intended to be limiting or an accurate value experienced by the fuel injection servo 100. Rather, the numerical values were chosen only to illustrate that the forces imposed on the air and fuel diaphragms of the embodiment disclosed are relatively higher than those imposed on the diaphragms of a conventional fuel injection servo.

An aspect of the present invention is that throttle body assembly 400, valve body assembly 200 (or valve body assemblies 600, 700 of the second and third embodiments, respectively), and fuel regulator assembly 300 are of modular construction. That is, each is a separate structure that can be separately assembled and tested. Also, the valve body assembly 200 and the fuel regulator assembly 300 can be calibrated separately from the throttle body assembly 400. With this modular design, assembly of the entire unit (i.e., the fuel injection servo 100) is as follows. Fuel regulator assembly 300 is individually calibrated on a flow stand for a given engine requirement, i.e., a throttle body size. (A single throttle body will support a horse power range, which corresponds to a range of engine sizes). Calibration of regulator assembly 300 comprises inputting a pressure signal to the regulator to simulate a venturi pressure signal and properly shimming the servo seat, the center body, and bellows cage, adjusting the regulator stem position, and adjusting other various components within the assembly to ensure that the assembly operates as expected for a given pressure signal. Valve body assembly 200 (or valve body assemblies 600, 700 of the second and third embodiments, respectively) is also calibrated as a separate unit, which comprises pressure checking the idle and manual mixture control valves and an idle cutoff leakage check. From this point forward, further calibration is not required. After the fuel regulator and valve body assemblies are separately calibrated, they are assembled onto throttle body 402 and the fuel injection servo unit 100 is placed inside an air box for further testing.

This modular design enables interchangeability between throttle body assemblies, valve body assemblies, and regulator assemblies without having to recalibrate the entire fuel injection servo 100 as a unit, or without having to recalibrate an unaffected assembly. Each assembly can be preassembled and precalibrated for an anticipated throttle body size without being assembled as a single fuel injection unit, and each assembly shelved for later use. Thus, when an order for a fuel injection servo is placed, the unit can then be assembled without the need for recalibration, thus shortening the turn around time for an order and effectively eliminating the customization of each valve body assembly 200 and fuel regulator assembly 300 for a specific fuel injection servo unit 100. Additionally, any single valve body assembly or regulator assembly could be used on a variety of throttle bodies having different sizes by simply calibrating valve body assembly 200 and fuel regulator assembly 300 for the throttle body size desired. Additionally, because all of the components of the venturi are machined from billet material, the venturi has consistent dimensional and surface finish characteristics which in turn results in consistent venturi performance. This consistent venturi performance within the throttle body assembly thus enables modularity of the fuel regulator and valve body assemblies because neither need to be customized (i.e., calibrated) for a particular throttle body assembly. Therefore, a single valve body assembly 200 (or valve body assemblies 600, 700 of the second and third embodiments, respectively) or regulator assembly 300 could be used on any throttle body assembly because of the repeatable, consistent venturi performance characteristics.

The above modularity also creates versatility of the fuel injection system of the embodiment disclosed. For example, to make a modification to the valve body, only the casting need be replaced with a modified one, rather than having to replace the entire throttle body. Also, when a modified valve body is installed, regulator assembly 300 does not have to be recalibrated, and vise versa. Thus, if an enrichment circuit (or any other modification within the valve body assembly) were to be added to valve body 204, which entails more fuel channels and jets within the valve body, it is not necessary to replace the whole throttle body 402, as would be necessary with conventional, integral systems, nor is it necessary to recalibrate regulator assembly 300. Rather, only the new valve body assembly with the modifications desired need be replaced. Thus, the valve body assemblies of FIG. 10C (second embodiment) or FIG. 10D (third embodiment), which include an enrichment system and a bypass circuit, respectively, can simply replace the existing valve body assembly installed on the throttle body assembly without having to recalibrate the fuel regulator assembly. This, of course, saves cost and time. Similarly, if valve body assembly malfunctioned and required replacement in the field, only the valve body assembly would need to be replaced, and regulator assembly 300 would not require recalibration. Likewise, if regulator assembly 300 malfunctioned in the field, it could be replaced without the need to change throttle body assembly 400 and without the need to recalibrate the existing valve body assembly because the valve body assembly and regulator assembly are each mounted to the throttle body 405 at separate locations and each are individually removable. A new regulator assembly 300, which is already preassembled and precalibrated, could simply be taken from the shelf and installed on the existing fuel injection servo 100 unit.

Furthermore, the modular design reduces the manufacturing costs associated with producing a throttle body 402. First, because valve body 204 is separate from the throttle body, the intricate fuel channels associated with the valve body are no longer part of the throttle body casting. Thus, the throttle body casting is more cost effective to produce. Secondly, the amount of scrap generated due to manufacturing defects is reduced. In a conventional, integral throttle body, when a manufacturing defect was found in an integrated valve body/throttle body casting, the entire casting had to be discarded, even if the defect occurred in only one portion of the casting. With the modular design, the amount of scrap is reduced, because if a defect is found in a throttle body or a valve body casting, only that particular defective component need be discarded.

Figure 32:
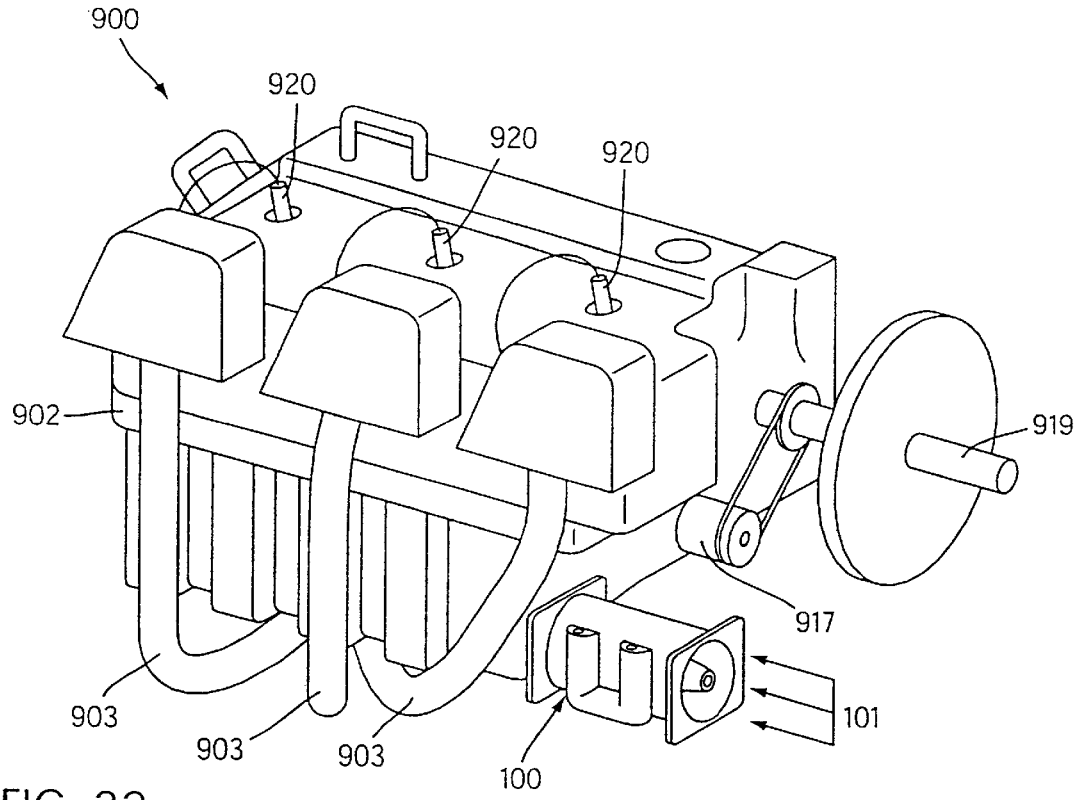
FIG. 32 is a perspective view of an internal combustion engine having with the fuel injection servo of the present invention mounted thereto.

As mentioned earlier, the fuel injection servo 100 constructed with the principles of the present invention may be generally installed onto an internal combustion engine, generally indicated as reference numeral 900, used primarily for aircraft, as shown in FIG. 32. The engine 900 is shown having the fuel injection servo 100 mounted generally at the forward end of the engine such that air 101 enters the airflow channel 435 of the throttle body assembly 400. The fuel injection servo 100, however, may be mounted at any location on or proximate the engine. Also seen in FIG. 32 are exhaust manifold pipes 903 and a conventional alternator device 917 that is driven from the engine's main output shaft 919, as is known in the art. A propeller (not shown), or other thrust generation device depending on the vehicle or craft to be driven, is typically mounted to output shaft 919.

Figure 33:
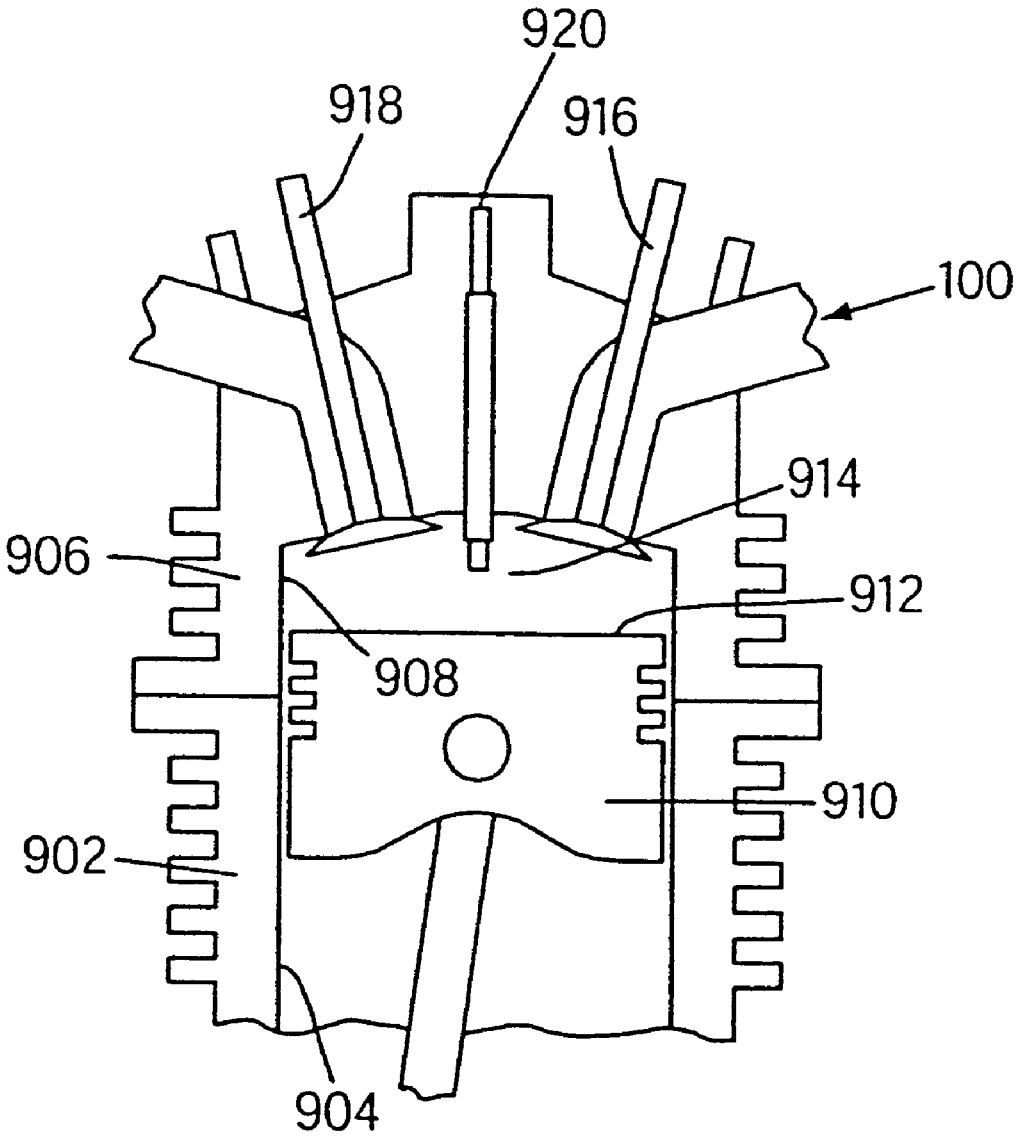
FIG. 33 is a cross-sectional view of an internal combustion cylinder of the internal combustion engine of FIG. 32.

Referring to FIGS. 32 and 33, the internal combustion engine, as generally known in the art, includes a cylinder block 902 having at least one cylinder bore 904 therein, a head 906 having an inner wall 908 mounted on the cylinder block, at least one piston 910 reciprocally movable in the at least one cylinder bore, at least one piston having a top face 912, at least one combustion chamber 914 defined by the inner wall 908 of the cylinder head and the top face 912 of the at least one piston 910, at least one intake valve 916 movably mounted on the cylinder head 906 in communication with the at least one combustion chamber 914, and an exhaust valve 918 movably mounted on the cylinder head in fluid communication with the at least one combustion chamber 914. The engine 900 also includes at least one ignition device, such as a spark plug 920, to ignite the fuel mixture within the combustion chamber 914. The remaining components of an internal combustion engine are generally known in the art and are therefore not described in detail.

While the invention has been described in connection with what is presently considered to be the most practical and preferred embodiments, it is to be understood that the invention is not to be limited to the disclosed embodiments and elements, but, to the contrary, is intended to cover various modifications, combinations of features, equivalent arrangements, and equivalent elements included within the spirit and scope of the appended claims. Furthermore, the dimensions of features of various components that may appear on the drawings are not meant to be limiting, and the size of the fuel injection servo and components therein can vary from the size that may be portrayed in the figures herein.

What is claimed is:

1. A fuel control apparatus for an internal combustion engine, said fuel control apparatus comprising:

a modular air passage mechanism having an air intake end and an air outlet end, said modular air passage mechanism being constructed and arranged to accommodate airflow therethrough;

a modular fuel regulator mechanism constructed and arranged to communicate with the airflow in the air passage mechanism and a fuel supply to regulate an amount of fuel delivered to the engine; and a modular fuel pressure modifying mechanism constructed and arranged to receive fuel from the fuel supply and deliver the fuel at a pressure that is different from the fuel supply to the modular fuel regulator mechanism;

wherein each of the modular fuel pressure modifying mechanism and the modular fuel regulator mechanism are removably mountable to the modular air passage mechanism independently from each other.

2. The fuel control apparatus of claim 1, wherein the modular air passage mechanism comprises a main body defining an airflow channel having a central axis, the main body having an outer surface.

3. The fuel control apparatus of claim 2, wherein the modular air passage mechanism further comprises a first surface portion formed on the outer surface of the main body and the modular fuel pressure modifying mechanism further comprises a second surface portion formed thereon, and wherein the second surface portion is adapted to interface with the first surface portion when the modular fuel pressure modifying mechanism is removably mounted onto the modular air passage mechanism.

4. The fuel control apparatus of claim 3, wherein the first and second surface portions are mating planar surfaces.

5. The fuel control apparatus of claim 2, wherein the modular air passage mechanism further comprises:

an airflow inhibiting device pivotally mounted within the airflow channel, said airflow inhibiting mechanism constructed and arranged to be actuated by a user, wherein actuation of the airflow inhibiting device varies its orientation within the channel to regulate the amount of air that flows therethrough to the engine.

6. The fuel control apparatus of claim 2, wherein the air passage mechanism further comprises:

a venturi being mounted within the airflow channel of the main body, the venturi constructed and arranged to cause a pressure differential in the air flowing through the air passage mechanism, the pressure differential being the difference between air pressure generated by the venturi and air pressure generated by the impact of ambient air onto the modular air passage mechanism, said ambient air being substantially unaffected by the venturi, the pressure differential to be communicated to the fuel regulator mechanism.

7. The fuel control apparatus of claim 6, wherein the venturi is formed in the shape of a bullet, the venturi being constructed and arranged to cause a drop in the air pressure as the air flows over the venturi.

8. The fuel control apparatus of claim 7, wherein the venturi has a central axis, a forward end and a rearward end, and further comprises:

an internal airflow path formed substantially along the axis of the venturi, the internal airflow path comprising a nozzle shaped inlet and an annular outlet connected by an internal duct, the annular outlet positioned intermediate said forward and rearward ends, the venturi being constructed and arranged such that air flowing over an outer surface of the venturi causes a drop in air pressure, the drop in air pressure to be communicated to the nozzle shaped inlet via the annular outlet and internal duct which in turn increases a pressure drop generated by the nozzle shaped inlet.

9. The fuel control apparatus of claim 8, wherein the pressure generated at said nozzle shaped inlet and said impact air pressure is to be communicated to the modular fuel regulator mechanism.

10. The fuel control apparatus of claim 9, wherein when the venturi is mounted within the main body of the modular air passage mechanism the axis of the venturi is substantially aligned with the axis of the main body.

11. The fuel control apparatus of claim 5, wherein said modular fuel regulator mechanism further comprises:

an air diaphragm separating a first air diaphragm chamber and a second air diaphragm chamber, the air pressure generated by the venturi to communicate with the first air diaphragm chamber and the impact air pressure to communicate with the second air diaphragm chamber.

12. The fuel control apparatus of claim 11, wherein said modular fuel regulator mechanism further comprises:

a fuel diaphragm separating a metered fuel diaphragm chamber and an unmetered fuel diaphragm chamber.

13. The fuel control apparatus of claim 12, wherein said modular fuel regulator mechanism further comprises:

a regulator stem having a first end and a second end, said first end being connected to the air diaphragm, the second end constructed and arranged to operate as a portion of a fuel valve, the regulator stem being connected at an intermediate portion thereof to the fuel diaphragm.

14. The fuel control apparatus of claim 13, wherein said modular fuel regulator mechanism further comprises a center body separating the air chambers from the fuel chambers.

15. The fuel control apparatus of claim 14, wherein said modular fuel regulator mechanism further comprises:

a bellows cage mounted centrally of the center body, the bellows cage housing a bellows.

16. The fuel control apparatus of claim 15, wherein said modular fuel regulator mechanism further comprises:

a fuel valve seat constructed and arranged to be engaged by the second end of the regulator stem, the fuel valve seat and said second end comprising the fuel valve.

17. The fuel control apparatus of claim 16, wherein said modular fuel regulator mechanism further comprises:

a fuel valve seat fitting to house the fuel valve, the fitting being constructed and arranged to enable proper positioning of the fuel valve seat with respect to the air diaphragm, fuel diaphragm, and regulator stem.

18. The fuel control apparatus of claim 11, wherein the modular pressure modifying mechanism further comprises:

a fuel inlet port for receiving fuel from the fuel supply.

19. The fuel control apparatus of claim 18, wherein the modular pressure modifying mechanism further comprises:

a control valve that is constructed and arranged to split the flow of fuel into a first path and a second path, said first path being a path from unmetered fuel in direct communication with the modular fuel regulator mechanism.

20. The fuel control apparatus of claim 19, wherein the control valve is constructed and arranged to be actuated by the user.

21. The fuel control apparatus of claim 20, wherein the second path is constructed and arranged to direct fuel to at least one metering jet, the at least one metering jet having an orifice therethrough to reduce fuel pressure in the second path as fuel flows through the orifice.

22. The fuel control apparatus of claim 20, wherein the second path is a path for metered fuel and is to be communicated with the fuel regulator mechanism.

23. The fuel control apparatus of claim 22, the modular pressure modifying mechanism further comprises:

a metered fuel valve actuated by the user, the metered fuel valve being constructed and arranged such that actuation thereof regulates the amount of fuel that flows from the second path to the engine, the metered fuel valve also being constructed and arranged to vary the engine speed from an idle power to a full power, the metered fuel valve at idle power being in an idle speed position and at full power being in a full power position.

24. The fuel control apparatus of claim 23, wherein the modular pressure modifying mechanism further comprises an enrichment circuit assembly, the enrichment circuit assembly comprising:

a diaphragm separating a metered enrichment chamber and an unmetered enrichment chamber, the metered enrichment chamber being in communication with the second path and the unmetered enrichment chamber being in communication with the first path.

25. The fuel control apparatus of claim 24, wherein the enrichment circuit assembly further comprises:

an enrichment valve resiliently biased by a spring interconnected to the diaphragm, the enrichment valve being constructed and arranged to allow fuel in the unmetered enrichment chamber to pass into the metered enrichment chamber when the enrichment valve is open, the valve being caused to be open when a pressure differential across the diaphragm creates a force greater than that required to compress the spring.

26. The fuel control apparatus of claim 25, wherein the enrichment circuit assembly further comprises an enrichment valve jet mounted within the enrichment valve to control the amount of fuel that passes through the enrichment valve when the valve is open.

27. The fuel control apparatus of claim 26, wherein fuel in the metered enrichment chamber is communicated to the modular fuel regulator mechanism and the fuel in the unmetered enrichment chamber also is communicated to the modular fuel regulator mechanism, the enrichment circuit assembly increasing the fuel/air mixture ratio to provide cooling of the engine.

28. The fuel control apparatus of claim 23, wherein the modular pressure modifying mechanism further comprises:

a bypass channel constructed and arranged to divert fuel from the control valve and deliver the diverted fuel to the fuel supply when the engine is at low power, to thereby increase the fuel flow from the fuel supply at low engine power.

29. The fuel control apparatus of claim 28, wherein the metered fuel valve further comprises a bypass valve, the bypass valve restricting fuel flow through the bypass channel when the metered fuel valve is actuated to a position other than idle speed position.

30. The fuel control apparatus of claim 1, wherein said engine is used to power an aircraft.

31. The fuel control apparatus of claim 1, wherein said engine comprises at least one combustion cylinder.

32. An internal combustion engine including a cylinder block having at least one cylinder bore therein, a head having an inner wall mounted on said cylinder block, at least one piston reciprocally movable in the at least one cylinder bore, the at least one piston having a top face, at least one combustion chamber defined by the inner wall of the cylinder head and the top face of the at least one piston, at least one intake valve movably mounted on the cylinder head in communication with the at least one combustion chamber, an exhaust valve movably mounted on the cylinder head in fluid communication with the at least one combustion chamber, the combination comprising:

a modular air passage mechanism having an air intake end and an air outlet end, said modular air passage mechanism being constructed and arranged to accommodate airflow therethrough, the airflow to be delivered to the at least one combustion chamber after passing through the air passage mechanism;

a modular fuel regulator mechanism constructed and arranged to communicate with the airflow in the air passage mechanism and a fuel supply to regulate an amount of fuel delivered to the at least one combustion cylinder; and a modular fuel pressure modifying mechanism constructed and arranged to receive fuel from the fuel supply and deliver the fuel at a pressure that is different from the fuel supply to the modular fuel regulator mechanism;

wherein each of the modular fuel pressure modifying mechanism and the modular fuel regulator mechanism are removably mountable to the modular air passage mechanism independently from each other.

33. The internal combustion engine of claim 32, wherein the modular air passage mechanism comprises a main body defining an airflow channel having a central axis, the main body having an outer surface.

34. The internal combustion engine of claim 33, wherein the modular air passage mechanism further comprises a first surface portion formed on the outer surface of the main body and the modular fuel pressure modifying mechanism further comprises a second surface portion formed thereon, and wherein the second surface portion is adapted to interface with the first surface portion when the modular fuel pressure modifying mechanism is removably mounted onto the modular air passage mechanism.

35. The internal combustion engine of claim 34, wherein the first and second surface portions are mating planar surfaces.

36. The internal combustion engine of claim 33, wherein the air passage mechanism further comprises:

a venturi being mounted within the airflow channel of the main body, the venturi constructed and arranged to cause a pressure differential in the air flowing through the air passage mechanism, the pressure differential being the difference between air pressure generated by the venturi and air pressure generated by the impact of ambient air onto the modular air passage mechanism, said ambient air being substantially unaffected by the venturi, the pressure differential to be communicated to the modular fuel regulator mechanism.

37. The internal combustion engine of claim 33, wherein said modular fuel regulator mechanism further comprises:

an air diaphragm separating a first air diaphragm chamber and a second air diaphragm chamber, the air pressure generated by the venturi to communicate with the first air diaphragm chamber and the impact air pressure to communicate with the second air diaphragm chamber.

38. The internal combustion engine of claim 33, wherein the modular pressure modifying mechanism further comprises:

a control valve that is constructed and arranged to split the flow of fuel into a first path and a second path, said first path being a path from unmetered fuel in direct communication with the modular fuel regulator mechanism.

39. The internal combustion engine of claim 38, the modular pressure modifying mechanism further comprises:

a metered fuel valve actuated by the user, the metered fuel valve being constructed and arranged such that actuation thereof regulates the amount of fuel that flows from the second path to the engine, the metered fuel valve also being constructed and arranged to vary the engine speed from an idle power to a full power, the metered fuel valve at idle power being in an idle speed position and at full power being in a full power position.

40. The internal combustion engine of claim 39, wherein the second path is constructed and arranged to direct fuel to at least one metering jet, the at least one metering jet having an orifice therethrough to reduce fuel pressure in the second path as fuel flows through the orifice.

41. The internal combustion engine of claim 40, wherein the second path is a path for metered fuel and is to be communicated with the fuel regulator mechanism.

42. The internal combustion engine of claim 41, wherein the modular pressure modifying mechanism further comprises an enrichment circuit assembly, the enrichment circuit assembly comprising:

a diaphragm separating a metered enrichment chamber and an unmetered enrichment chamber, the metered enrichment chamber being in communication with the second path and the unmetered enrichment chamber being in communication with the first path.

43. The internal combustion engine of claim 42, wherein the enrichment circuit assembly further comprises:

an enrichment valve resiliently biased by a spring interconnected to the diaphragm, the enrichment valve being constructed and arranged to allow fuel in the unmetered enrichment chamber to pass into the metered enrichment chamber when the enrichment valve is open, the valve being caused to be open when a pressure differential across the diaphragm creates a force greater than that required to compress the spring.

44. The internal combustion engine of claim 41, wherein the modular pressure modifying mechanism further comprises:

a bypass channel constructed and arranged to divert fuel from the control valve and deliver the diverted fuel to the fuel supply when the engine is at low power, to thereby increase the fuel flow from the fuel supply at low engine power.

45. The internal combustion engine of claim 44, wherein the metered fuel valve further comprises a bypass valve, the bypass valve restricting fuel flow through the bypass channel when the metered fuel valve is actuated to a position other than idle speed position.

46. A fuel control apparatus for an internal combustion engine, the fuel control apparatus comprising a fuel pressure modifying mechanism, the fuel pressure modifying mechanism comprising:

a fuel inlet port for receiving fuel from a fuel supply;

a control valve that is constructed and arranged to split the flow of fuel received from the inlet port into a first path and a second path, and a bypass channel constructed and arranged to divert fuel from the control valve and deliver the diverted fuel to the fuel supply when the engine is at low power, to thereby increase the fuel flow from the fuel supply at low engine power.

47. The fuel control apparatus of claim 46, wherein the fuel pressure modifying mechanism further comprises a metered fuel valve that is actuated by a user, wherein actuation of the metered fuel valve regulates the amount of fuel that flows from the second path to the engine, the metered fuel valve being constructed and arranged to vary the engine speed from idle power to full power, the metered fuel valve at idle power being in an idle speed position and at full power being in a full power position.

48. The fuel control apparatus of claim 47, wherein the metered fuel valve further comprises a bypass valve, the bypass valve restricting fuel flow through the bypass channel when the metered fuel valve is actuated to a position other than idle speed position.

49. The fuel control apparatus of claim 47, wherein the first path is constructed and arranged to be in communication with a fuel regulator mechanism.

50. The fuel control apparatus of claim 49, wherein the control valve is constructed and arranged to be actuated by the user.

51. The fuel control apparatus of claim 49, wherein the second path is constructed and arranged to direct fuel to an at least one metering jet, the at least one metering jet having an orifice therethrough to reduce fuel pressure in the second path as fuel flows through the orifice.

52. The fuel control apparatus of claim 23, wherein the second path is a path for metered fuel and communicates with the fuel regulator mechanism.

53. The fuel control apparatus of claim 52, further comprising:

an air passage mechanism having an air intake end and an air outlet end, said air passage mechanism being constructed and arranged to accommodate airflow therethrough.

54. The fuel control apparatus of claim 53, the air passage mechanism further comprising:

a venturi being mounted within the airflow channel of the main body, the venturi constructed and arranged to cause a pressure differential in the air flowing through the air passage mechanism, the pressure differential being the difference between air pressure generated by the venturi and air pressure generated by the impact of ambient air onto the modular air passage mechanism, said ambient air being substantially unaffected by the venturi, the pressure differential to be communicated to the fuel regulator mechanism.

55. The fuel control apparatus of claim 54, wherein the venturi is formed in the shape of a bullet, the venturi being constructed and arranged to cause a drop in the air pressure as the air flows over the venturi.

56. The fuel control apparatus of claim 55, wherein the venturi has a central axis, a forward end and a rearward end, and further comprises:

an internal airflow path formed substantially along the axis of the venturi, the internal airflow path comprising a nozzle shaped inlet and an annular outlet connected by an internal duct, the annular outlet positioned intermediate said forward and rearward ends, the venturi being constructed and arranged such that air flowing over an outer surface of the venturi causes a drop in air pressure, the drop in air pressure to be communicated to the nozzle shaped inlet via the annular outlet and internal duct which in turn increases a pressure drop generated by the nozzle shaped inlet.

57. The fuel control apparatus of claim 56, wherein the pressure generated at said nozzle shaped inlet and said impact air pressure is to be communicated to the modular fuel regulator mechanism.

58. The fuel control apparatus of claim 57, wherein when the venturi is mounted within the main body of the air passage mechanism the axis of the venturi is substantially aligned with the axis of the main body.

59. The fuel control apparatus of claim 58, wherein the fuel regulator mechanism comprises:

an air diaphragm separating a first air diaphragm chamber and a second air diaphragm chamber, the air pressure generated by the venturi to communicate with the first air diaphragm chamber and the impact air pressure to communicate with the second air diaphragm chamber.

60. The fuel control apparatus of claim 59, said fuel regulator mechanism further comprising:

a fuel diaphragm separating a metered fuel diaphragm chamber and an unmetered fuel diaphragm chamber.

61. The fuel control apparatus of claim 60, the unmetered and metered fuel diaphragm chambers being in communication with the first path and second path, respectively, of the fuel modifying mechanism.

62. The fuel control apparatus of claim 61, wherein the fuel regulator mechanism further comprises:

a regulator stem having a first end and a second end, said first end being connected to the air diaphragm, the second end constructed and arranged to operate as a portion of a fuel valve, the regulator stem being connected at an intermediate portion thereof to the fuel diaphragm.

63. The fuel control apparatus of claim 62, the fuel regulator mechanism further comprising a center body separating one of the first and second air diaphragm chambers and one of the metered and unmetered fuel diaphragm chambers.

64. The fuel control apparatus of claim 63, wherein said fuel regulator mechanism further comprises:

a bellows cage mounted centrally of the center body, the bellows cage housing a bellows.

65. The fuel control apparatus of claim 64, wherein said fuel regulator mechanism further comprises:

a fuel valve seat constructed and arranged to be engaged by the second end of the regulator stem, the fuel valve seat and said second end comprising the fuel valve.

66. The fuel control apparatus of claim 65, wherein said fuel regulator mechanism further comprises:

a fuel valve seat fitting to house the fuel valve, the fitting being constructed and arranged to enable proper positioning of the fuel valve seat.

67. The fuel control apparatus of claim 66, wherein each of the fuel pressure modifying mechanism and the fuel regulator mechanism are removably mountable to the air passage mechanism independently from each other.

68. The fuel control apparatus of claim 67, wherein the air passage mechanism comprises a main body defining an airflow channel having a central axis, the main body having an outer surface.

69. The fuel control apparatus of claim 66, wherein the air passage mechanism further comprises a first surface portion formed on the outer surface of the main body and the fuel pressure modifying mechanism further comprises a second surface portion formed thereon, and wherein the second surface portion is adapted to interface with the first surface portion when the fuel pressure modifying mechanism is removably mounted onto the air passage mechanism.

70. The fuel control apparatus of claim 69, wherein the first and second surface portions are mating planar surfaces.

71. A fuel control apparatus for an internal combustion engine, said fuel control apparatus comprising:

a modular air passage mechanism having an air intake end and an air outlet end, said modular air passage mechanism being constructed and arranged to accommodate airflow therethrough, the modular air passage mechanism having a first surface portion formed on an outer surface thereon;

a modular fuel pressure modifying mechanism constructed and arranged to receive fuel from a supply and deliver a portion of the fuel at a pressure that is different from the pressure of the fuel supply, the modular fuel pressure modifying mechanism being removably mountable to the first surface portion of the air passage mechanism;

the modular fuel pressure modifying mechanism constructed and arranged to be calibrated prior to being mounted to the air passage mechanism;

wherein the modular fuel pressure modifying mechanism comprises a second surface portion formed thereon, the second surface portion corresponding to the first surface portion of the air passage mechanism when the modular fuel pressure modifying mechanism is removably mounted thereto; and wherein each of the modular fuel pressure modifying mechanism and the modular fuel regulator mechanism are adapted to be removably mounted to the modular air passage mechanism independently from each other.

72. A fuel control apparatus for an internal combustion engine, said fuel control apparatus comprising:

a modular air passage mechanism having an air intake end and an air outlet end, said modular air passage mechanism being constructed and arranged to accommodate airflow therethrough, the modular air passage mechanism having a first surface portion formed on an outer surface thereon;

a modular fuel pressure modifying mechanism constructed and arranged to receive fuel from a supply and deliver a portion of the fuel at a pressure that is different from the pressure of the fuel supply, the modular fuel pressure modifying mechanism being removably mountable to the first surface portion of the air passage mechanism;

the modular fuel pressure modifying mechanism constructed and arranged to be calibrated prior to being mounted to the air passage mechanism;

a modular fuel regulator mechanism constructed and arranged to communicate with the airflow in the air passage mechanism and the modular fuel pressure modifying mechanism to regulate an amount of fuel delivered to the engine;

a venturi being mounted with the airflow channel of the main body, the venturi constructed and arranged to cause a pressure differential in the air flowing through the air passage mechanism, the pressure differential being the difference between air pressure generated by the venturi and air pressure generated by the impact of ambient air onto the modular air passage mechanism, said ambient air being substantially unaffected by the venturi, the pressure differential to be communicated to the fuel regulator mechanism;

wherein the venturi is formed in the shape of a bullet, the venturi being constructed and arranged to cause a drop in the air pressure as the air flows over the venturi; and wherein the venturi has a central axis, a forward end and a rearward end, and further comprises an internal airflow path formed substantially along the axis of the venturi, the internal airflow path comprising a nozzle shaped inlet and an annular outlet connected by an internal duct, the annular outlet positioned intermediate said forward and rearward ends, the venturi being constructed and arranged such that air flowing over an outer surface of the venturi causes a drop in air pressure, the drop in air pressure to be communicated to the nozzle shaped inlet via the annular outlet and internal duct which in turn increases a pressure drop generated by the nozzle shaped inlet.

73. The fuel control apparatus of claim 72, wherein the pressure generated at said shaped inlet and said impact air pressure is to be communicated to the modular fuel or mechanism.

74. The fuel control apparatus of claim 73, wherein when the venturi is mounted the main body of the modular air passage mechanism the axis of the venturi is substantially aligned with the axis of the main body.

75. A fuel control apparatus for an internal combustion engine, said fuel control apparatus comprising:

a modular air passage mechanism having an air intake end and an air outlet end, said modular air passage mechanism being constructed and arranged to accommodate airflow therethrough, the modular air passage mechanism having a first surface portion formed on an outer surface thereon;

a modular fuel pressure modifying mechanism constructed and arranged to receive fuel from a supply and deliver a portion of the fuel at a pressure that is different from the pressure of the fuel supply, the modular fuel pressure modifying mechanism being removably mountable to the first surface portion of the air passage mechanism;

the modular fuel pressure modifying mechanism constructed and arranged to be calibrated prior to being mounted to the air passage mechanism;

a modular fuel regulator mechanism constructed and arranged to communicate with the airflow in the air passage mechanism and the modular fuel pressure modifying mechanism to regulate an amount of fuel delivered to the engine;

wherein the modular air passage mechanism further comprises an airflow inhibiting device pivotally mounted within the airflow channel, said airflow inhibiting mechanism constructed and arranged to be actuated by a user, wherein actuation of the airflow inhibiting device varies its orientation within the channel to regulate the amount of air that flows therethrough to the engine;

wherein said modular fuel regulator mechanism further comprises an air diaphragm separating a first air diaphragm chamber and a second air diaphragm chamber and the impact air pressure to communicate with the second air diaphragm chamber;

wherein the modular pressure modifying mechanism further comprises a fuel inlet port for receiving fuel from the fuel supply;

wherein the modular pressure modifying mechanism further comprises a control valve that is constructed and arranged to split the flow of fuel into a first path and a second path, said first path being a path from unmetered fuel in direct communication with the modular fuel regulator mechanism;

wherein the control valve is constructed and arranged to be actuated by the user;

wherein the second path if a path for metered fuel and is to be communicated with the fuel regulator mechanism;

the modular pressure modifying mechanism further comprising a metered fuel valve actuated by the user, the metered fuel valve being constructed and arranged such that actuation thereof regulates the amount of fuel that flows from the second path to the engine, the metered fuel valve also being constructed and arranged to vary the engine speed from an idle power to a full power, the metered fuel valve at idle power being in an idle speed position and at full power being in a full power position; and wherein the modular pressure modifying mechanism further comprising a bypass channel constructed and arranged to divert fuel from the control valve and deliver the diverted fuel to the fuel supply when the engine is at low power, to thereby increase the fuel flow from the fuel supply at low engine power.

76. The fuel control apparatus of claim 75, wherein the metered fuel valve further comprises a bypass valve, the bypass valve restricting fuel flow through the bypass channel when the metered fuel valve is actuated to a position other than idle speed position.

77. A method of assembling a fuel control apparatus for an internal combustion engine, the fuel control apparatus comprising a modular air passage mechanism, a modular fuel regulator mechanism, and a modular fuel pressure modifying mechanism, each of the modular fuel pressure modifying mechanism and the modular fuel regulator mechanism being constructed and arranged to be removably mountable to the modular air passage mechanism independently from each other, the method comprising:

calibrating at least one of the modular fuel regulator mechanism and the modular fuel pressure modifying mechanism prior to being mounted to the modular air passage mechanism.

78. The method according to claim 77, further comprising:

mounting at least one of the calibrated modular fuel regulator mechanism and the calibrated modular fuel pressure modifying mechanism to the modular air passage mechanism to form a fuel control apparatus unit.

79. The method according to claim 78, further comprising testing the fuel control apparatus unit.

80. The method according to claim 78, wherein the modular fuel regulator mechanism comprises:

an air diaphragm separating a first air diaphragm chamber and a second air diaphragm chamber, the air pressure generated by a venturi to communicate with the first air diaphragm chamber and an ambient air impact pressure to communicate with the second air diaphragm chamber;

a fuel diaphragm separating a metered fuel diaphragm chamber and an unmetered fuel diaphragm chamber;

a regulator stem having a first end and a second end, said first end being connected to the air diaphragm, the second end constructed and arranged to operate as a portion of a fuel valve, the regulator stem being connected at an intermediate portion thereof to the fuel diaphragm;

a center body separating the air chambers from the fuel chambers; and a fuel valve seat constructed and arranged to be engaged by the second end of the regulator stem, the fuel valve seat and the second end comprising the fuel valve.

81. The method according to claim 80, wherein calibrating the fuel regulator mechanism comprises inputting a pressure signal to at least one of the first and the second air diaphragm chambers to simulate an air pressure signal.

82. The method according to claim 81, wherein calibrating the fuel regulator mechanism further comprises shimming the fuel valve seat.

83. The method according to claim 82, wherein calibrating the fuel regulator mechanism further comprises shimming at least one of the center body and the fuel valve seat.

84. The method according to claim 83, wherein calibrating the fuel regulator mechanism further comprises adjusting the position of the regulator stem.

85. The method according to claim 77, wherein the modular pressure modifying mechanism further comprises:

a control valve that is constructed and arranged to split the flow of fuel into a first path and a second path, said first path being a path from unmetered fuel in direct communication with the modular fuel regulator mechanism; and a metered fuel valve actuated by a user, the metered fuel valve being constructed and arranged such that actuation thereof regulates the amount of fuel that flows from the second path to the engine, the metered fuel valve also being constructed and arranged to vary the engine speed from an idle power to a full power, the metered fuel valve at idle power being in an idle speed position and at full power being in a full power position.

86. The method according to claim 85, wherein calibrating the modular fuel pressure modifying mechanism comprises pressure checking at least one of the metered fuel valve and the control valve.

87. A method of maintaining a fuel control apparatus installed on an internal combustion engine, the fuel control apparatus comprising a modular air passage mechanism, a modular fuel regulator mechanism, and a modular fuel pressure modifying mechanism, each of the modular fuel pressure modifying mechanism and the modular fuel regulator mechanism being removably mounted to the modular air passage mechanism independently from each other, the method comprising:

changing the modular fuel pressure modifying mechanism without changing the modular fuel regulator mechanism, or changing the modular fuel regulator mechanism without changing the modular fuel pressure modifying mechanism.

88. The method of claim 87, wherein changing the modular fuel pressure modifying mechanism comprises removing the modular fuel pressure modifying mechanism from the modular air passage mechanism.

89. The method of claim 87, wherein changing the modular fuel regulator mechanism comprises removing the modular fuel regulator mechanism from the modular air passage mechanism.

90. The method of claim 87, wherein changing the modular fuel regulator mechanism further comprises recalibrating the modular fuel regulator mechanism.

* * * * *